US012745808B2

(12) United States Patent
DePew et al.

(10) Patent No.: US 12,745,808 B2
(45) Date of Patent: Sep. 29, 2026

(54) SUPPORT GARMENT

(71) Applicant: NIKE, Inc., Beaverton, OR (US)

(72) Inventors: Andrew L. DePew, Portland, OR (US); Iustinia Koshkaroff, Mount Angel, OR (US); Ariana S. Levitt, Portland, OR (US); Yuan Mu, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 19/008,595

(22) Filed: Jan. 2, 2025

(65) Prior Publication Data

US 2025/0331579 A1 Oct. 30, 2025

Related U.S. Application Data

(60) Provisional application No. 63/720,539, filed on Nov. 14, 2024, provisional application No. 63/618,071, filed on Jan. 5, 2024.

(51) Int. Cl.
*A41C 3/00* (2006.01)

(52) U.S. Cl.
CPC ..... *A41C 3/0014* (2013.01)

(58) Field of Classification Search
CPC ..... A41C 3/0014
See application file for complete search history.

(56) References Cited

U.S. PATENT DOCUMENTS 2,457,369 A 12/1948 Harman
3,314,844 A 4/1967 Wilfred et al.
4,232,620 A 11/1980 Kurz
5,153,056 A 10/1992 Groshens
6,124,010 A 9/2000 Shih
6,478,656 B1 11/2002 Khouri
6,514,590 B1 2/2003 Shih
6,824,445 B2 11/2004 Oneyear et al.
6,851,125 B2 2/2005 Fujikawa et al.
(Continued)

FOREIGN PATENT DOCUMENTS

CN 115530452 A 12/2022
GB 0526433 A 9/1940
GB 1453447 A 10/1976

OTHER PUBLICATIONS

Ryzhova et al., "Flexa—3D Printed Sports Bra", Available online at: <https://www.anna-ryzhova.com/flexa>, Retrieved on Apr. 22, 2025, 3 pages.

(Continued)

*Primary Examiner* — Gloria M Hale
(74) *Attorney, Agent, or Firm* — Shook, Hardy & Bacon L.L.P.

(57) ABSTRACT

A support garment (e.g., upper-torso support garment, such as a bra) includes a mesh textile that is integrally formed and that is lightweight and breathable with zonal properties. For example, the mesh can include elongated members, which intersect with one another at nodes to form a grid of cells, and the mesh can continuously extend throughout one or more multiple portions of the support garment. In at least some instances, the mesh construction and/or the elongated members can vary from one portion of the support garment to another portion of the support garment, and the variation of the mesh and/or the elongated members can contribute to zonal properties.

26 Claims, 31 Drawing Sheets

(56) References Cited

U.S. PATENT DOCUMENTS

| | | | | |
|---|---|---|---|---|
| 7,421,805 | B2 | 9/2008 | Geer | |
| 7,878,881 | B2 | 2/2011 | Hendrickson | |
| 8,128,457 | B2 | 3/2012 | Reinisch et al. | |
| 8,413,661 | B2 | 4/2013 | Rousseau et al. | |
| 8,486,317 | B2 | 7/2013 | Warren | |
| 8,745,829 | B2 | 6/2014 | Wanzenboeck et al. | |
| 8,900,032 | B2 | 12/2014 | Punsal | |
| 8,915,764 | B2 | 12/2014 | Scott et al. | |
| 9,011,199 | B2 | 4/2015 | Yuasa et al. | |
| 9,474,309 | B2 | 10/2016 | Yip | |
| 9,655,715 | B2 | 5/2017 | Limem et al. | |
| 9,932,081 | B2 | 4/2018 | Jensen et al. | |
| 10,166,023 | B2 | 1/2019 | Vendely et al. | |
| 10,368,590 | B2 | 8/2019 | Diaz et al. | |
| 10,390,571 | B2 | 8/2019 | Mckeen et al. | |
| 10,640,915 | B2 | 5/2020 | Xing et al. | |
| 10,681,940 | B2 | 6/2020 | Castelazo | |
| 11,213,078 | B2 | 1/2022 | Mientjes et al. | |
| 11,484,076 | B2 | 11/2022 | Muhlenfeld et al. | |
| 11,529,227 | B2 | 12/2022 | Chhaya et al. | |
| 11,692,304 | B2 | 7/2023 | Farmer et al. | |
| 11,771,144 | B1 * | 10/2023 | Vansia | A41C 3/14 450/39 |
| 11,849,775 | B2 | 12/2023 | Rendone | |
| 12,063,986 | B2 | 8/2024 | Casillas et al. | |
| 12,127,608 | B2 | 10/2024 | Casillas et al. | |
| 12,213,556 | B2 | 2/2025 | Poegl et al. | |
| 12,302,955 | B1 * | 5/2025 | Turnbull-Morgenthaler | A41C 3/0014 |
| 2006/0025039 | A1 | 2/2006 | Barbour et al. | |
| 2006/0223414 | A1 | 10/2006 | Staub | |
| 2007/0293937 | A1 | 12/2007 | Biggs et al. | |
| 2008/0196136 | A1 | 8/2008 | Fellouhe et al. | |
| 2009/0203295 | A1 | 8/2009 | Kassel | |
| 2009/0305608 | A1 | 12/2009 | Bonnin et al. | |
| 2014/0288577 | A1 | 9/2014 | Robinson et al. | |
| 2015/0018936 | A1 | 1/2015 | Chen et al. | |
| 2016/0101333 | A1 | 4/2016 | Mccampbell | |
| 2017/0281367 | A1 | 10/2017 | Ketchum et al. | |
| 2019/0246741 | A1 | 8/2019 | Busbee et al. | |
| 2019/0291698 | A1 | 9/2019 | Camella | |
| 2019/0344477 | A1 | 11/2019 | Huffa et al. | |
| 2020/0375270 | A1 | 12/2020 | Holschuh et al. | |
| 2022/0095704 | A1 | 3/2022 | Salemeh et al. | |
| 2022/0248775 | A1 | 8/2022 | Todaro et al. | |
| 2022/0251379 | A1 | 8/2022 | Tago et al. | |
| 2023/0093048 | A1 | 3/2023 | Wallace et al. | |
| 2023/0301370 | A1 * | 9/2023 | Gunasekara | A41C 3/0014 |
| 2023/0320434 | A1 | 10/2023 | Rochelle | |
| 2023/0413926 | A1 | 12/2023 | Ho et al. | |
| 2024/0055146 | A1 | 2/2024 | Keum et al. | |
| 2025/0221470 | A1 | 7/2025 | Depew et al. | |
| 2025/0221471 | A1 * | 7/2025 | DePew | B33Y 80/00 |
| 2025/0331581 | A1 | 10/2025 | Depew et al. | |

OTHER PUBLICATIONS

Drstvenšek, I., "5th International Conference on Additive Technologies iCAT2014", Proceedings of 5th International Conference on Additive Technologies, Vienna, Oct. 2014, 270 pages.

International Search Report and Written Opinion received for PCT Patent Application No. PCT/US2025/010308, mailed on Jun. 11, 2025, 13 pages.

Non-Final Office Action received for U.S. Appl. No. 19/008,598, mailed on Jan. 27, 2026, 26 pages.

Non-Final Office Action received for U.S. Appl. No. 19/008,600, mailed on Jan. 20, 2026, 24 pages.

* cited by examiner

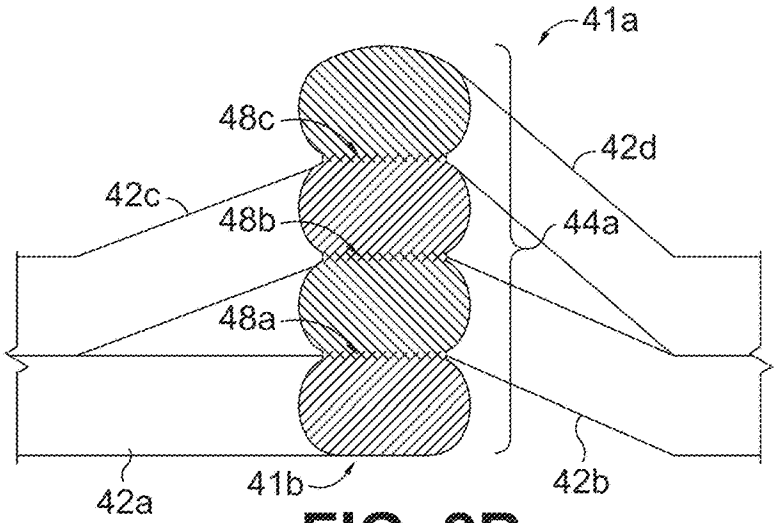
FIG. 2B
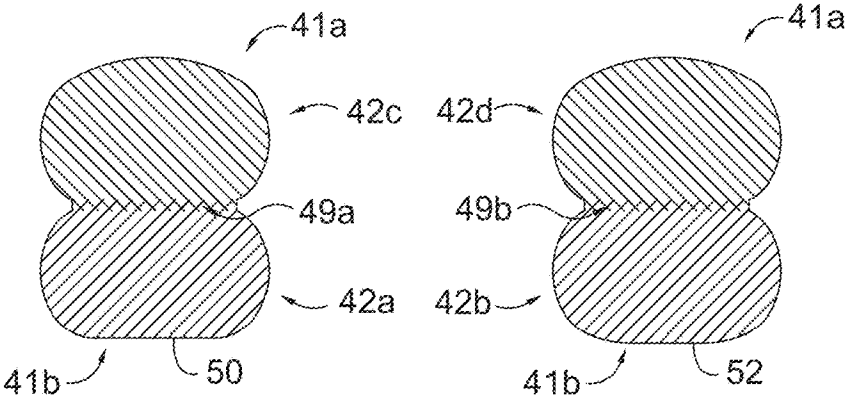
FIG. 2D
FIG. 2C
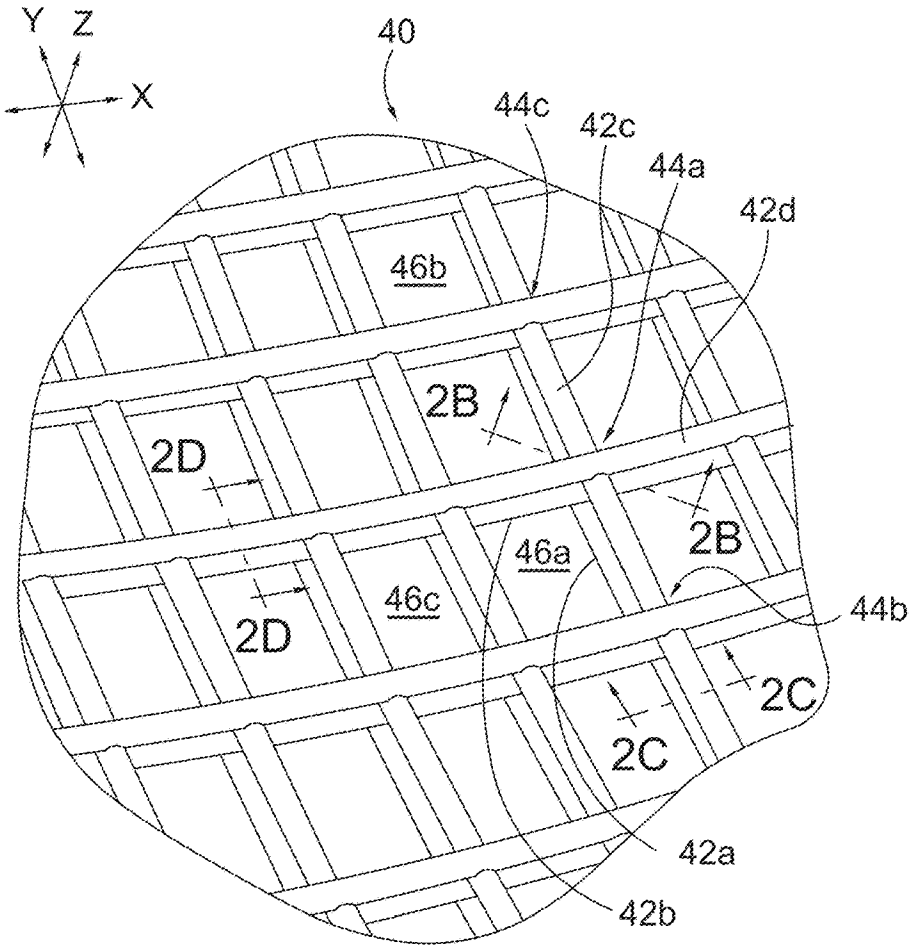
FIG. 2A

SUPPORT GARMENT

CROSS REFERENCE TO RELATED APPLICATIONS

This application claims priority benefit to U.S. Application No. 63/618,071 (filed Jan. 5, 2024), and claims priority benefit to U.S. Application No. 63/720,539 (filed Nov. 14, 2024). This application is related by subject matter to each of the following applications filed on Jan. 2, 2025: U.S. patent application Ser. No. 19/008,600; U.S. patent application Ser. No. 19/008,592; U.S. patent application Ser. No. 19/008,594; and U.S. patent application Ser. No. 19/008,598. The entirety of each of the aforementioned applications is incorporated herein by reference.

FIELD

This disclosure relates generally to support garments (e.g., upper-torso support garments), including support garments that have zonal properties and methods for making the same.

BACKGROUND

A support garment (e.g., upper-torso support garment or lower-torso support garment) can be configured to support various parts of a wearer's body a wearer's anatomy (e.g., breasts, glutes, etc.). Often, at least some portions of a support garment can be compressive, and compression can be imparted via textile structures and/or compositional material. For instance, compression can, in some cases, be imparted by knit structures, elastomeric yarns, and the like.

SUMMARY

This disclosure is related to a support garment (e.g., upper-torso support garment, such as a bra) that is lightweight and breathable with zonal properties. For example, the support garment can include a mesh that includes elongated members (e.g., unitary elongated members), which intersect with one another at nodes to form a grid of cells, and the mesh can continuously extend throughout one or more multiple portions of the support garment. In at least some instances, the mesh construction and/or the elongated members can vary from one portion of the support garment to another portion of the support garment, and the variation of the mesh and/or the elongated members can contribute to zonal properties. For example, the spacing of elongated members and the resulting cell size can very, which can contribute to the elastic properties of a zone. In some examples, the size and/or cross section of the elongated members can also vary, which can also impart desired properties to a given zone. The mesh can, in at least some parts of the support garment, form the entirety of the support garment with limited other textiles (e.g., with no other textiles).

Examples of this disclosure, in contrast to conventional support garments, are lightweight, breathable, and supportive of wearer anatomy in desired regions and are easier to don (e.g., put on) and doff (e.g., take off). That is, in at least some instances, a support garment of the present solution can include the mesh of elongated members that are customizable in a given portion of the support garment to impart a desired amount of support. The open construction of the mesh contributes to breathability and minimizes moisture absorption and retention. In some instances, the stretch properties of the mesh and/or the lower moisture absorption properties allows for a wearer to more easily manipulate the support garment when donning and/or doffing.

Examples of this disclosure can include an underband having zonal properties. For example, the underband can include elongated members that intersect with one another to form a mesh. In addition, any of the elongated members can include a waveform that can have varied properties (e.g., amplitude, frequency, etc.), which can contribute to zonal stretch properties.

In at least some examples, one or more portions of the support garment can include the mesh with elongated members without additional textile layers, such that the mesh forms both the outer face and the inner face of the support garment. In some examples, the mesh with elongated members can be combined with one or more textile layers, such as in the breast-covering region (e.g., to contribute to modesty features).

The various innovations of this disclosure can be used in combination or separately. This summary is provided to introduce a selection of concepts in a simplified form that are further described below in the detailed description. This summary is not intended to identify key features or essential features of the claimed subject matter, nor is it intended to be used to limit the scope of the claimed subject matter. The foregoing and other objects, features, and advantages of the disclosure will become more apparent from the following detailed description, claims, and accompanying figures.

BRIEF DESCRIPTION OF THE DRAWINGS

FIGS. 2A-2D illustrate a first mesh construction, based on an example.

DETAILED DESCRIPTION

Figure 1A:
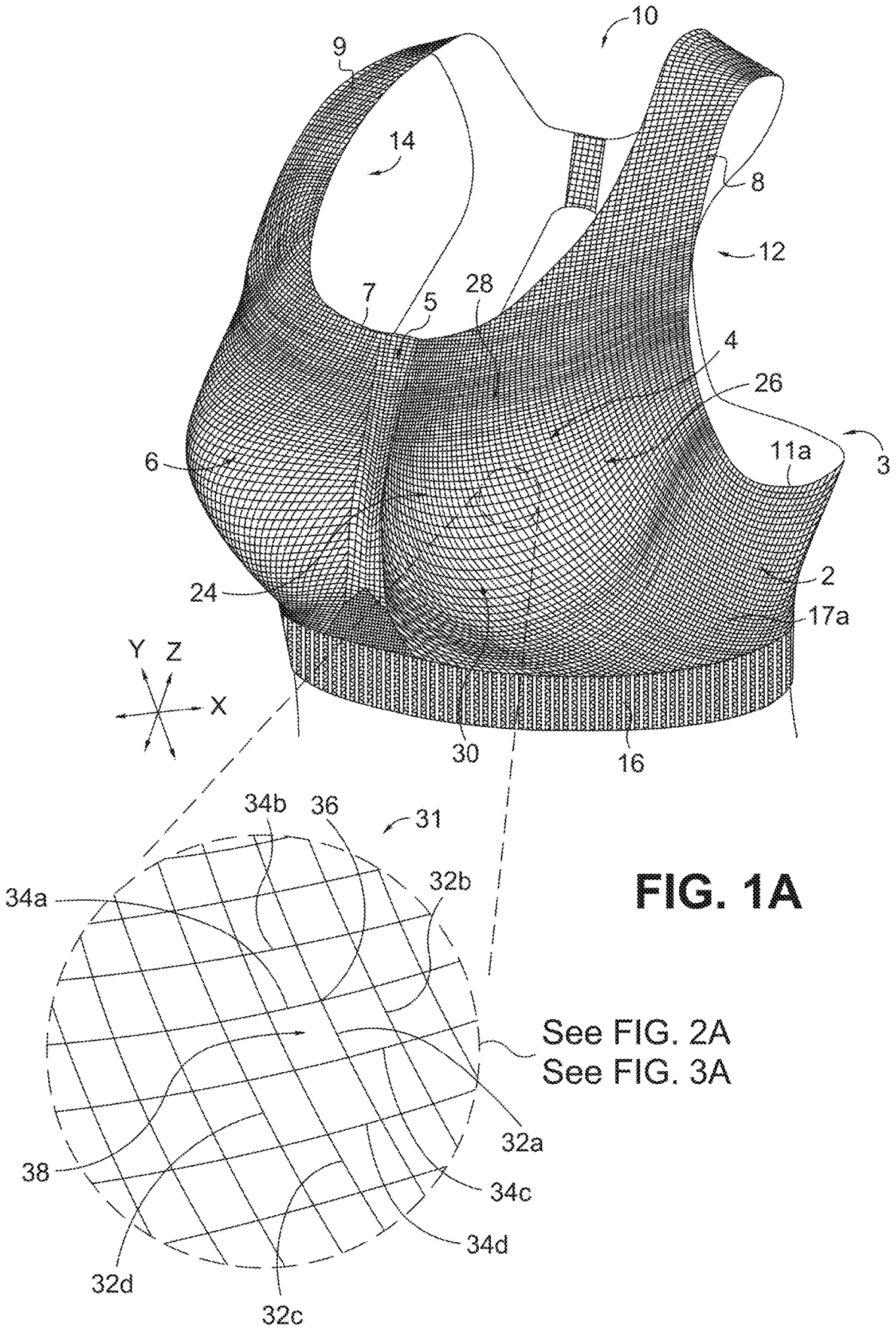
FIG. 1A illustrates a support garment in an as-worn configuration, based on an example.

This detailed description is related to a support garment (e.g., upper-torso support garment, such as a bra) that is integrally formed and that is lightweight and breathable with zonal properties. For example, the support garment can include a mesh that includes elongated members (e.g., unitary elongated members), which intersect with one another at nodes to form a grid of cells, and the mesh can continuously extend throughout one or more multiple portions of the support garment. In at least some instances, the mesh construction and/or the elongated members can vary from one portion of the support garment to another portion of the support garment, and the variation of the mesh and/or the elongated members can contribute to zonal properties. For example, the spacing of elongated members and the resulting cell size can very, which can contribute to the elastic properties of a zone. In some examples, the size and/or cross section of the elongated members can also vary, which can also impart desired properties to a given zone. The mesh can, in at least some parts of the support garment, form the entirety of the support garment with limited other textiles (e.g., with no other textiles).

Conventional support garments (e.g., upper-torso support garment, such as a bra) are configured to provide compressive support to one or more parts of a wearer's anatomy (e.g., wearer's breasts), and often, compressive support is imparted via a combination of one or more textiles and/or via elastomeric yarns (e.g., elastane or spandex). For example, conventional support garments can be constructed of one or more various textiles (e.g., knit, woven, nonwoven, foam, films, etc.), which are sometimes combined in a composite or other multilayer construction. However, conventional support garments can undesirably absorb and retain moisture (e.g., perspiration) and can sometimes lack desired breathability. These aspects of conventional support garments can contribute to discomfort, odor retention, and challenges with donning and doffing. In addition, some conventional support garments can be lightweight and breathable; however, these conventional support garments typically fail to provide adequate support to the wearer, especially for the wearer when engaging in various activities (e.g., exercising and other day-to-day activities).

Examples of this disclosure, in contrast to conventional support garments, are lightweight, breathable, and supportive of wearer anatomy in desired regions. As such, the garments of the present invention can be associated with various benefits, such as improved comfort due to the garment quickly drying and maintaining breathability, while still providing a desired amount of support. In some examples, the fast-drying nature of the garments might have a cooling effect on the wearer (e.g., as the perspiration evaporates and is exhausted). In at least some instances, the support garment can be easier to don (e.g., put on) and doff (e.g., take off) based on the combination of the stretch properties and lower absorptive properties (e.g., since wet garments can be tougher to manipulate or adjust when putting on or taking off).

Stated in another way, in at least some examples, a support garment of the present solution can include the mesh of elongated members that are customizable in a given portion or zone of the support garment to impart a desired amount of support. For instance, the properties of the mesh can be varied across different zones of the support garment to impart zonal properties. The open construction of the mesh contributes to breathability and minimizes moisture absorption and retention. In some instances, the stretch properties of the mesh and/or the diminished moisture absorption allows for a wearer to more easily manipulate the support garment when donning and/or doffing.

The term "upper-torso support garment" when used herein refers to an upper-body garment primarily configured to provide support to a wearer's breasts. As such, the support garment may be in the form of a bra, including a nursing bra and/or athletic bra, a tank top, an athletic top, a swimsuit top, and the like.

When the garment is in the form of an upper-torso support garment or bra, the term "breast covering area" or "breast-covering portion" means the portion of the support garment configured to cover a wearer's breast. As such, the breast covering area generally extends (e.g., from within about 0.1 mm to about 5 cm) from a top part (e.g., near the wearer's clavicle) to a lower part (e.g., the wearer's inframammary fold) of each of the wearer's breasts and from a medial edge (e.g., near the wearer's sternum) to a lateral edge (e.g., near the wearer's axilla) of each of the wearer's breasts. The breast covering area can include a breast cup.

Positional or directional terms used to describe the support garment such as front, back, sides, interior, inner, outer, innermost, right, left, central, medial, lateral, upper or superior, lower or inferior, leading, trailing, and the like refer to the garment being worn as intended by a wearer standing upright.

The term "front" or "front portion" means configured to cover an upper front torso area of a wearer including the breast area, and the term "back" or "back portion" means configured to cover an upper back torso area of a wearer. The term "side" or "side portion" means configured to cover a side torso area of a wearer including the underarm area of the wearer. The term "right" means positioned on a right side of a wearer's body, and the term "left" means positioned on a left side of the wearer's body when the support garment is worn. The term "central" means located generally along a vertical midline of a wearer's body. The term "medial" means located closer to a midline of the garment or a wearer wearing the garment, and the term "lateral" means located closer to a side of the support garment or a wearer wearing the garment. The term "upper" or "superior" means located closer to a head area of a wearer, and the term "lower" means located closer to a foot area of the wearer. Positional terms such as "medial" and "lateral" might also be used in the customary anatomical sense. These various terms can also be relative (e.g., where one element is lateral as compared to another element).

The terms "external" and "internal" as used herein are relative terms such that a layer that is external is positioned external to one or more internal layers, and a layer that is internal is positioned internal to one or more external layers. The term "innermost" when used with respect to the support garment means a structure that is positioned closest to a body surface of a wearer compared to other layers of the support garment (e.g., innermost layer, innermost face, innermost surface, innermost-facing surface). The term "outermost" when used with respect to the support garment means a structure that is positioned closest to the external environment with respect to other layers of the support garment (e.g., outermost layer, outermost face, outermost-facing surface).

The term "apex region" when referring to the support garment generally means the area where a shoulder strap extends from or is joined to the breast covering area or other portions of the support garment.

The term "underband" when used in relation to, for instance, a bra refers to the portion of the bra that forms a lower margin of at least the front portion of the bra. The underband is configured to encircle the upper torso area of a wearer and may include a separate pattern piece or may include an integral extension of the front portion. In some instances, an underband can be referred to as a chestband.

The term "panel" or "material panel" refers to one or more sheets of material used to form at least a portion of a garment. A panel can be formed by one or more various techniques, such as knit, woven, nonwoven, extrusion, casting, and the like. In some cases, a panel can include a textile, fabric, film, and the like. A panel can include a single layer or multiple layers. A panel can include a composite (e.g., multiple layers joined together with mechanical and/or chemical bonds). A panel can include multiple sheets of material joined together at seams or other interfaces.

The term "textile" refers to a material including intersecting elongated members. In some textiles, the elongated members can be interlaced, intertwined, interleaved, or entangled. In some textiles, the elongated members can be joined and/or co-formed at the intersections. Textiles can be constructed using various techniques to intersect the elongated members, such as knitting, weaving, braiding, nonwoven techniques, extrusion (e.g., 3D printing), casting, and the like.

The term "mesh" or "mesh textile" refers to a textile having a network of members that intersect with one another to form openings throughout the structure. In some examples, the openings can be a consistent size and shape and are arranged in a repeating pattern. In some examples, the size and shape of the openings can vary. Mesh textiles can be constructed from various techniques, such as weaving, knitting, braiding, extruding (e.g., 3D printing), casting, and the like.

In examples, extruding can be used to describe printing techniques that can be used to construct elongated members and/or a mesh structure. Printing systems can be used to print 2D structures or layers of ink as well as 3D structures formed from various kinds of 3D printing materials. The term "3D printing" can generally refer to various systems and methods, such as solid deposition modeling (SDM), electron beam freeform fabrication (EBF), selective laser sintering (SLS) as well as other kinds of three-dimensional printing technologies. In some examples, "3D printing" can refer to a technique in which material is forced through the nozzle of an extruder and onto a substrate (e.g., glass substrate, textile/fabric substrate, etc. that can be flat or have a 3D form), upon which the material can solidify into an elongated member, which can also be referred to as a filament or extrudate. The extruded material can include any material conventionally known and used in solid deposition modeling arts (e.g., thermoplastics such as acrylonitrile butadiene styrene (ABS), polylactic acid (PLA), high-impact polystyrene (HIPS), thermoplastic polyurethane (TPU), aliphatic polyamides (nylon), and/or other materials as are conventionally known and used in the solid deposition modeling arts). The term "solid deposition modeling" can include processes known in the art as "fused filament fabrication" and "fused deposition modeling."

A mesh textile can be formed of elongated members that converge with one another, or otherwise meet at, points of intersection, which can be referred to as nodes. The term "elongated member" refers to a structure that has a longer length than width. For example, the length of the member as measured from one node to another node is larger than the width. An elongated member can span from one node to an adjacent node. In some examples, an elongated member can span across multiple nodes. A node refers to a point at which two or more elongated members converge and are coupled to one another. In at least some examples, an elongated member can include a filament.

In at least some examples, the two or more elongated members are fixedly coupled or fixedly joined to one another at a node. For example, the two or more elongated members can be chemically bonded and/or mechanically bonded. In some instances, the two or more elongated members are thermally bonded (e.g., thermally welded) at a node, such as where the elongated members are extruded and intersect at (e.g., are interleaved at) the node. In at least some examples, the two or more elongated members are co-formed with one another (e.g., by molding, casting, etc.) in a shape or configuration that includes the two or more elongated members converging at the node (e.g., where a mesh is constructed as a unitary structure).

As used in this disclosure, a thermal weld can include a bond between two components that is formed when at least one of the two components is heated to at least a softening point and is brought into contact with the other of the two components, such that upon cooling, the two components are bonded. In some examples, the two components are bonded by a chemical bond, by a mechanical bond, or by a combination of chemical bonds and mechanical bonds. For example, in some cases, a thermal weld can include chemical bonding based on van der Waals forces, dipole interactions, and/or dispersion forces, although covalent bonding of the components might not necessarily be modified or changed (e.g., neither created or destroyed). In at least some examples, a thermal weld can include a mechanical bond, such as where the softened material of the heated component flows around a portion of the other component and, upon cooling, is solidified to at least partially encapsulate the portion. In at least some examples, at least a small amount of material from a first component might mix with at least a small amount of material from the first component. An extent of mixing can depend on various factors, such as the extent to which one or both components are heated and/or the amount of time during which heat is applied.

The term "cell" refers to a unit in a mesh that includes the interconnecting members (e.g., elongated members), the nodes at which the interconnecting members converge and are joined, and the opening that is defined or bound by the combination of the interconnecting members and the nodes. Cells can have various sizes and shapes, such as circular, ovular, triangular, rectangular, square, and any other n-side polygonal forms. Adjacent cells can share at least some common components, including the interconnecting members (e.g., shared elongated members along a common border) and the nodes (e.g., shared nodes at common vertices).

The term "grid" refers to a mesh in which cells are arranged in rows and columns. The columns and rows are typically formed by a set of first elongated members that intersect at nodes with a set of second elongated members. Often the set of first elongated members do not overlap one another, and the set of second elongated members do not overlap one another. In some examples, at least part of a grid can include a radial grid, in which the set of first elongated members are concentric to one another and are arranged in a pattern that extends outward from center, and the set of second elongated members radially extend from the center while intersecting at nodes with the set of first elongated members.

The term "unitary" refers to a structure that is constructed of a single, solid, continuous part (e.g., without seams, joints between, or couplings of sub-components). In examples, an elongated member can be unitary, such as where the elongated member is extruded (e.g., an elongated extrudate). In some instances, a unitary elongated extrudate can be a filament (e.g., a 3D printed filament). In examples, a mesh structure can be unitary, such as where the mesh is formed by casting, molding, and the like. A twisted yarn or thread is typically not unitary, based on the twisted yarn or thread being formed of a plurality of fibers spun, or otherwise twisted/entangled, together. Some examples that are unitary can be referred to as "non-fibrous," which indicates that a structure (e.g., elongated member) is not constructed of smaller fibers that are combined (e.g., entangled, spun, etc.) to form a larger structure.

The term waveform refers to a shape of an element (e.g., an elongated member) that includes one or more peaks and valleys. A waveform can be sinuous, triangular, square, sawtooth, and the like. A waveform can include an amplitude measuring the height of one or more peaks, as well as a frequency indicating the number of crests in along a given segment of the elongated member.

The term "color" or "color property" as used herein when referring to the mesh textile or other components of the support garment generally refers to an observable color of a structure (e.g., an elongated member and/or a mesh) that form the textile. Such aspects contemplate that a color may be any color that may be afforded to fibers using dyes, pigments, and/or colorants that are known in the art. As such, structures may be configured to have a color including, but not limited to red, orange, yellow, green, blue, indigo, violet, white, black, and shades thereof. In one example aspect, the color may be imparted to the structure when the structure is formed (dye, pigment, or other colorant is mixed with the material prior to depositing into the form of an elongated member or a mesh).

Aspects related to a color further contemplate determining if one color is different from another color. In these aspects, a color may comprise a numerical color value, which may be determined by using instruments that objectively measure and/or calculate color values of a color of an object by standardizing and/or quantifying factors that may affect a perception of a color. Such instruments include, but are not limited to spectroradiometers, spectrophotometers, and the like. Thus, aspects herein contemplate that a "color" of a mesh imparted by the elongated members may comprise a numerical color value that is measured and/or calculated using spectroradiometers and/or spectrophotometers. Moreover, numerical color values may be associated with a color space or color model, which is a specific organization of colors that provides color representations for numerical color values, and thus, each numerical color value corresponds to a singular color represented in the color space or color model.

In these aspects, a color may be determined to be different from another color if a numerical color value of each color differs. Such a determination may be made by measuring and/or calculating a numerical color value of, for instance, a first textile having a first color with a spectroradiometer or a spectrophotometer, measuring and/or calculating a numerical color value of a second textile having a second color with the same instrument (i.e., if a spectrophotometer was used to measure the numerical color value of the first color, then a spectrophotometer is used to measure the numerical color value of the second color), and comparing the numerical color value of the first color with the numerical color value of the second color.

In another example, the determination may be made by measuring and/or calculating a numerical color value of a first area of a textile with a spectroradiometer or a spectrophotometer, measuring and/or calculating a numerical color value of a second area of the textile having a second color with the same instrument, and comparing the numerical color value of the first color with the numerical color value of the second color. If the numerical color values are not equal, then the first color or the first color property is different than the second color or the second color property, and vice versa.

Further, it is also contemplated that a visual distinction between two colors may correlate with a percentage difference between the numerical color values of the first color and the second color, and the visual distinction will be greater as the percentage difference between the color values increases. Moreover, a visual distinction may be based on a comparison between colors representations of the color values in a color space or model. For instance, when a first color has a numerical color value that corresponds to a represented color that is black or navy and a second color has a numerical color value that corresponds to a represented color that is red or yellow, a visual distinction between the first color and the second color is greater than a visual distinction between a first color with a represented color that is red and a second color with a represented color that is yellow.

As used in this application, the singular forms "a," "an," and "the" include the plural forms unless the context clearly dictates otherwise. Additionally, the term "includes" means "comprises." Further, the terms "coupled" or "secured"

encompass mechanical and chemical couplings, as well as other practical ways of coupling or linking items together, and do not exclude the presence of intermediate elements between the coupled items unless otherwise indicated, such as by referring to elements, or surfaces thereof, being "directly" coupled or secured. Furthermore, as used herein, the term "and/or" means any one item or combination of items in the phrase.

As used herein, the term "exemplary" means serving as a non-limiting example, instance, or illustration. As used herein, the terms "e.g.," and "for example," introduce a list of one or more non-limiting embodiments, examples, instances, and/or illustrations. As used herein, "e.g." means "for example," and "i.e." means "that is."

As used herein, the terms "fixedly attached" and "fixedly coupled" refer to two components joined in a manner such that the components may not be readily separated from one another without destroying and/or damaging one or both of the components. Exemplary modalities of fixed attachment may include joining with permanent adhesive, stitches, welding or other thermal bonding, and/or other joining techniques. In addition, two components may be "fixedly attached" or "fixedly coupled" by virtue of being integrally formed, for example, in a molding process.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the detailed description, abstract, and drawings.

Unless otherwise noted, all measurements provided herein are measured at standard ambient temperature and pressure (25 degrees Celsius or 298.15 K and 1 bar) with the support garment in a resting (un-stretched) state.

Fabric growth and recovery can be measured using ASTM2594 testing standard and is expressed as a percentage.

The term "stretch" as used herein means a textile characteristic measured as an increase of a specified distance (e.g., length or width) under a prescribed tension and is generally expressed as a percentage of the original benchmark distance (i.e., the resting length or width). In at least some examples, a textile of the present disclosure can include desired stretch property, which can be assessed using ASTM D2594 (e.g., loop and 5 lb weight). In some examples, textiles or zones can have different degrees of relative stretch. For example, a first zone, when subjected to a prescribed tension, can stretch by X %, and a second zone, when subjected to the same prescribed tension, can stretch by Y %. Where Y is bigger than X, the stretch property of the second zone can include a larger elongation property than the first zone (e.g., the second zone elongatedly stretches more than the first zone under the same prescribed tension).

The term "growth" as used herein means an increase in distance of a specified benchmark (i.e., the resting length or width) after extension to a prescribed tension for a time interval followed by the release of tension and is usually expressed as a percentage of the original benchmark distance.

"Recovery" as used herein means the ability of a textile to return to its original benchmark distance (i.e., its resting length or width) and is expressed as a percentage of the original benchmark distance. In at least some examples, a textile of the present disclosure can include desired recovery property, which can be assessed using ASTM D2594 (e.g., loop and 5 lb weight).

In at least some examples, a textile of the present disclosure can include desired air permeability, which can be assessed via one or more known testing methodologies, such as ASTM D737.

In at least some examples, a textile of the present disclosure can include desired bursting strength, which can be assessed via ASTM D6797-2015 (e.g., 25 mm Ball Burster, where textile can withstand min. lbf.).

In at least some examples, a textile of the present disclosure can include desired absorption properties, which can be assessed via one or more known testing methodologies, such as gravimetric testing in which a known weight of fabric is placed in contact with a liquid, and the amount of liquid absorbed is measured by weighing the fabric before and after absorption.

As used herein, the terms "about" and "substantially" mean +/−10% of a given value, such (but not limited to) as a linear dimension value (e.g., height, width, etc.), a weight value, a material property. In addition, with respect to an angle or angular dimension, or the terms parallel and perpendicular, the terms "about" and "substantially" mean within 10 degrees. If the "about" or "substantially" is otherwise used, the terms include equivalents of the subject element, where appropriate.

Referring now to FIG. 1A, FIG. 1A depicts a perspective view of an upper-torso support garment 10, based on an example of this disclosure. The support garment 10 is in the form of a bra. FIG. 1A includes an outermost-facing surface of a front portion 2 of the support garment 10, which can also include a back portion 3. In examples, the support garment 10 can be mostly symmetrical (e.g., relative to a midline between a left side and a right side), such that description associated with one side of the support garment (e.g., the left side) can similarly (e.g., equally) apply to the other side (e.g., the right side).

The front portion 2 of the support garment 10 generally includes a first breast-covering portion 4 and a second breast-covering portion 6. Further, the front portion 2 comprises a plurality of cells, as described further below with respect to enlarged reference view of FIG. 1A. The plurality of cells each have a polygonal shape (e.g., quadrilateral). In some examples, the first breast-covering portion 4 and the second breast-covering portion can include a breast cup. In some examples, the breast-covering portions are not molded to include a cup shape. In some examples, the breast-covering portions can be molded to include a cup shape (e.g., molded by applying heat and/or pressure to the breast-covering portion while held in a 3D mold having a desired cup shape and then allowing the textile to cool and retain the cup shape of the 3D mold).

In addition, the front portion includes a center bridge 5 (e.g., also referred to as a center gore) between the breast-covering portions 4 and 6. In some examples, the center bridge 5 can have a distinct structure (e.g., cell arrangement) to impart properties (e.g., less stretch) in that region of the support garment.

In some examples, the center bridge 5 can include a continuous grid pattern that gradually transitions from the breast covering portions into the middle without a distinct structure or arrangement that demarcates the center bridge 5.

In examples, the front portion 2 of the support garment 10 can include a neckline 7. The neckline 7 can, in some instances, continuously extend along a top portion (e.g., top edge in some cases) of the front portion 2 from one shoulder strap to the other shoulder strap. In some cases, the neckline 7 can be at the top of the breast-covering portions. In some examples, the neckline 7 can include a right-side neckline segment on the right side of the center bridge 5 and a left-side neckline segment of the left side of the center bridge 5.

In addition, the support garment 10 can include a first armhole 12 (e.g., left-side armhole 12) and a second armhole 14 (e.g., right-side armhole 14). Further, the front portion 2 (or the side portions) can include a left-side underarm top edge 11*a* and a right-side underarm top edge 11*b* (obscured from view in FIG. 1A but shown in FIG. 1B as reference numeral 11*b*). In examples, each of the underarm top edges can extends from the apex and towards the side, in the opposite direction as the neckline. In some cases, the underarm top edge can continuously extend from a respective strap, along the lateral portion (e.g., lateral edge) of the front portion 2, along a top of the side portion (e.g., wing), and to the back portion 3 of the support garment 10.

The support garment 10 can also include a first shoulder strap 8 (e.g., left shoulder strap 8) and a second shoulder strap 9 (e.g., right shoulder strap 9) connecting the front portion 2 to the back portion 3.

In at least some examples, the support garment 10 can also include an underband 16.

In examples, the support garment 10 can include other parts. For example, the support garment 100 can include a wing on each side of the support garment, and the wing generally extends between the underarm top edge (e.g., 11*a*) and the underband 16 (or other bottom edge or hem). In addition, the wing can form a side portion of the support garment 10 that extends from the front portion 2 to the back portion 3 and beneath a respective armhole. FIG. 1A depicts a left-side wing 17*a*, and the right-side wing 17*b* is obscured from view (but shown and labeled in FIG. 1B).

In some examples, the support garment 10 can include (e.g., on each side) a cradle that extends underneath the breast-covering portion. For example, the cradle can extend from a more central portion (e.g., near the center bridge) to the side or wing. In some examples, the cradle can contribute to encapsulation of the lower portion of the breast tissue, such as near the inframammary fold. In some examples, the cradle extends between the breast-covering portion and the underband. In examples, a clear demarcation may not separate a breast-covering portion from a cradle and in some cases, the breast-covering portion can seamlessly and gradually transition to a cradle. In some examples, the support garment 10 can omit a cradle.

In examples, parts, portions, and zones of the support garment 10, do not necessarily include clear demarcations therebetween. For example, in some instances, a breast-covering portion can seamlessly transition between a strap and a wing without a clear seam, joint, or other transitional structure connecting the two parts.

In general, a breast-covering portion can extend from an upper extent or margin of the front portion to a lower extent or margin. The upper extent or margin of the breast-covering portion can be near or at the neckline 7, apex (e.g., connection between breast-covering portion and shoulder strap), and the respective side underarm top edge, and the lower extent or margin of the breast-covering portion can be at a lower transitional edge or shoulder or at the underband. For example, the left breast-covering portion 4 can extend from near the neckline 7 on the left side and from near the left-side underarm edge 11*a* down to near the underband 16. The right breast-covering portion can include similar features and be defined similarly.

Each breast-covering portion 4 and 6 can include a medial portion or zone and a lateral portion or zone—the medial portion being closer to the center bridge 5 or midline of the support garment 10. For example, the breast-covering portion 4 can include a medial portion 24 and a lateral portion 26, where the medial portion 24 is closer to the center bridge 5. Although not labeled in FIG. 1A, the right breast covering area 6 can also include a medial portion and a lateral portion. In some examples, "medial" and "lateral" with respect to the breast-covering portion describes relative positions. In some examples, the breast-covering portion can include a midline between a medial-most edge and a lateral-most edge, and the midline can divide the breast cup into the medial portion and the lateral portion.

Each breast-covering portion 4 and 6 can include an upper portion or zone and a lower portion or zone—the upper portion being closer to the apex or neckline 7 of the support garment 10 and the lower portion being closer to the underband 16. For example the breast-covering portion 4 can include an upper portion 28 and a lower portion 30, where the lower portion 30 is closer to the underband 16. In some examples, "upper" and "lower" with respect to portions or zones of the breast-covering portion describes relative positions.

In at least some examples of the present disclosure, one or more various portions of the support garment 10 can include a construction that is lightweight and breathable with zonal properties. For example, the support garment 10 can include a material panel that includes a mesh 31 (see enlarged reference view in FIG. 1A) with elongated members (e.g., 32*a* and 34*a*), which intersect with one another at nodes (e.g., 36) to form a grid of cells (e.g., 38). The support garment 10 and the mesh 31 can include one example, and a variety of other designs and configurations are contemplated and are within the scope of this disclosure and can functionally operate to attain the zonal properties. For example, the angles of the elongated members can be modified in other constructions, as well as the size and shape of the resulting cells. In addition, the straightness or waviness of the elongated members can also be modified in one or more alternative designs.

In at least some instances, the grid of cells can be formed by a first plurality of elongated members 32*a*-32*d* (e.g., first elongated members) that longitudinally extend generally in a similar direction (e.g., in the x-y plane) and that may not overlap one another, and by a second plurality of elongated members 34*a*-34*d* (e.g., second elongated members) that longitudinally extend generally in a similar direction (e.g., in the x-y plane) and that may not overlap one another. In examples, the first plurality of elongated members 32*a*-32*d* can intersect with the second plurality of elongated members 34*a*-34*d* to form the cells. In at least some instances, a cell refers to a unit within the mesh 31 that includes an opening or void in the mesh, in combination with the portions of the elongated members and the nodes that form a boundary around the opening or void. For example, the cell 38 includes a unit within the mesh 31 that includes the portions or segments of the elongated members 32*a*, 34*a*, 32*c*, and 34*c* that intersect at nodes (e.g., 36), the nodes themselves, and the void or opening defined or bounded by the elongated members and the nodes.

In at least some examples of the present disclosure, the open cell structure of the mesh can impart and/or contribute to breathability. For example, the open cell structure can permit air, vapor, moisture, etc. to more easily pass through the mesh textile (e.g., as compared to some other textiles, such as knit, woven, foams, etc.). In addition, the open cell structure of the mesh can be less absorptive to perspiration (e.g., as compared to some other textiles, such as knit, woven, foams, etc.). In some instances, the lower moisture absorption properties of the mesh textile can contribute to easier doffing or removal of the upper-torso support garment, such as after the wearer has engaged in physical activity. For example (and without being bound by theory), lower moisture retention in the mesh textile can contribute to less surface friction as between the mesh textile and the wearer's skin when the wearer is manipulating the support garment over their head, and the less surface friction can make it easier to doff the support garment.

In examples, the elongated members of the mesh 31 can compositionally include an elastomer, which can include a thermoplastic elastomer or a thermoset elastomer. An elastomer generally includes a polymer or co-polymer that can stretch at least twice its length when subjected to a force and that can recover to near its original shape when the force is removed. Examples of elastomers can include (but are not limited to) rubber, polyurethane, thermoplastic polyurethane, polyester, thermoplastic polyester elastomer, and silicone. The compositional material of the elongated members (and the mesh) can include various other properties, such hardness.

In some examples, the compositional material can include a shore hardness in a range of about 40 A to about 85 A. In some examples, the shore hardness is in a range of about 55 A to about 75 A. In some examples, the shore hardness is about 60 A. In some examples, the shore hardness is about 70 A.

In at least some instances, the mesh construction and/or the elongated members can vary from one portion of the support garment 10 to another portion of the support garment 10, and the variation of the mesh and/or the elongated members can contribute to zonal properties. For example, the spacing of elongated members (e.g., 32*a*-32*d* and/or 34*a*-34*d*) and the resulting cell size can very, which can contribute to the elasticity and stretch properties of a zone (e.g., such as in examples in which the elongated members compositionally include an elastomer). In some examples, the size and/or cross section of the elongated members can also vary, which can also impart desired properties to a given zone.

Figure 1B:
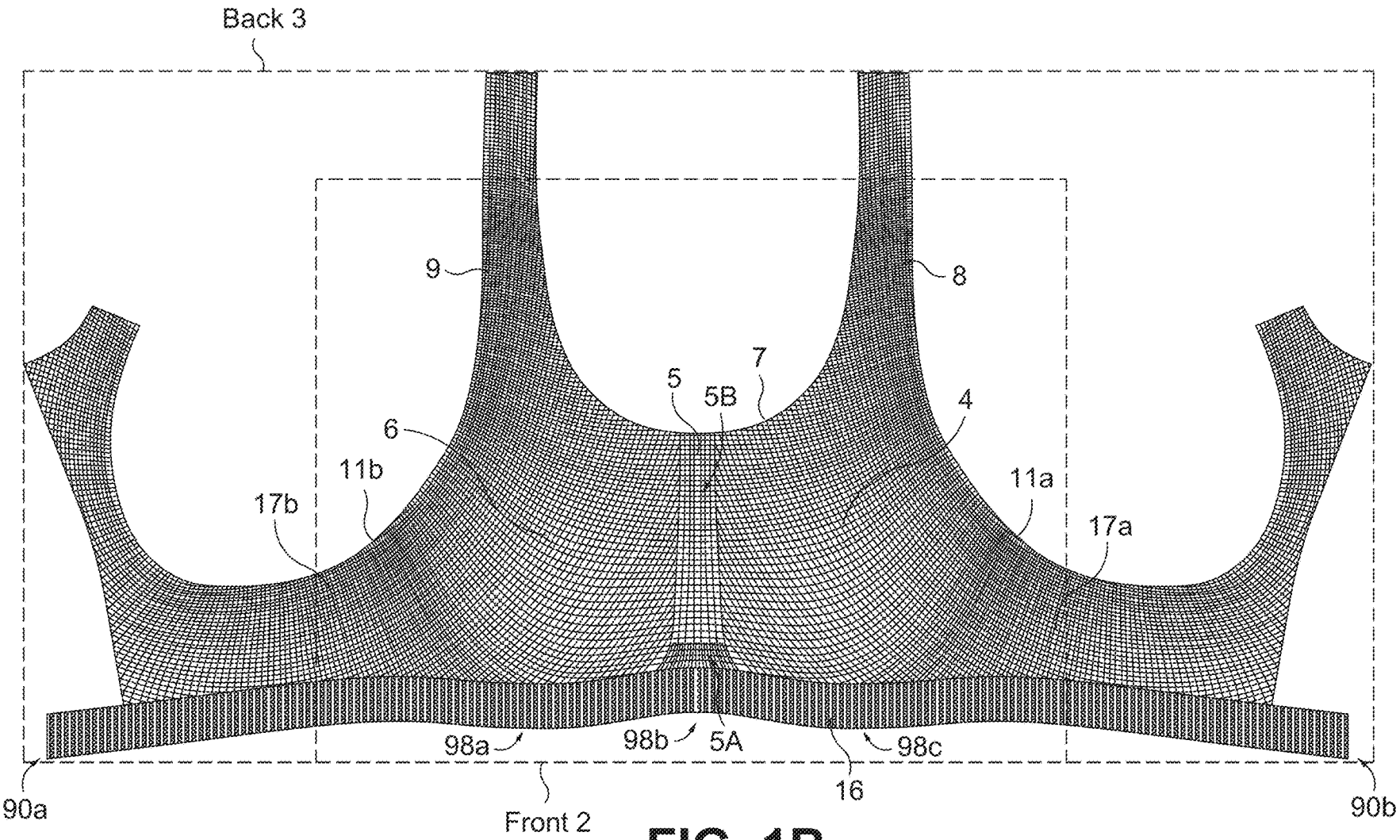
FIG. 1B illustrates the support garment of FIG. 1A in a laid-flat configuration, based on an example.
Figure 1C:
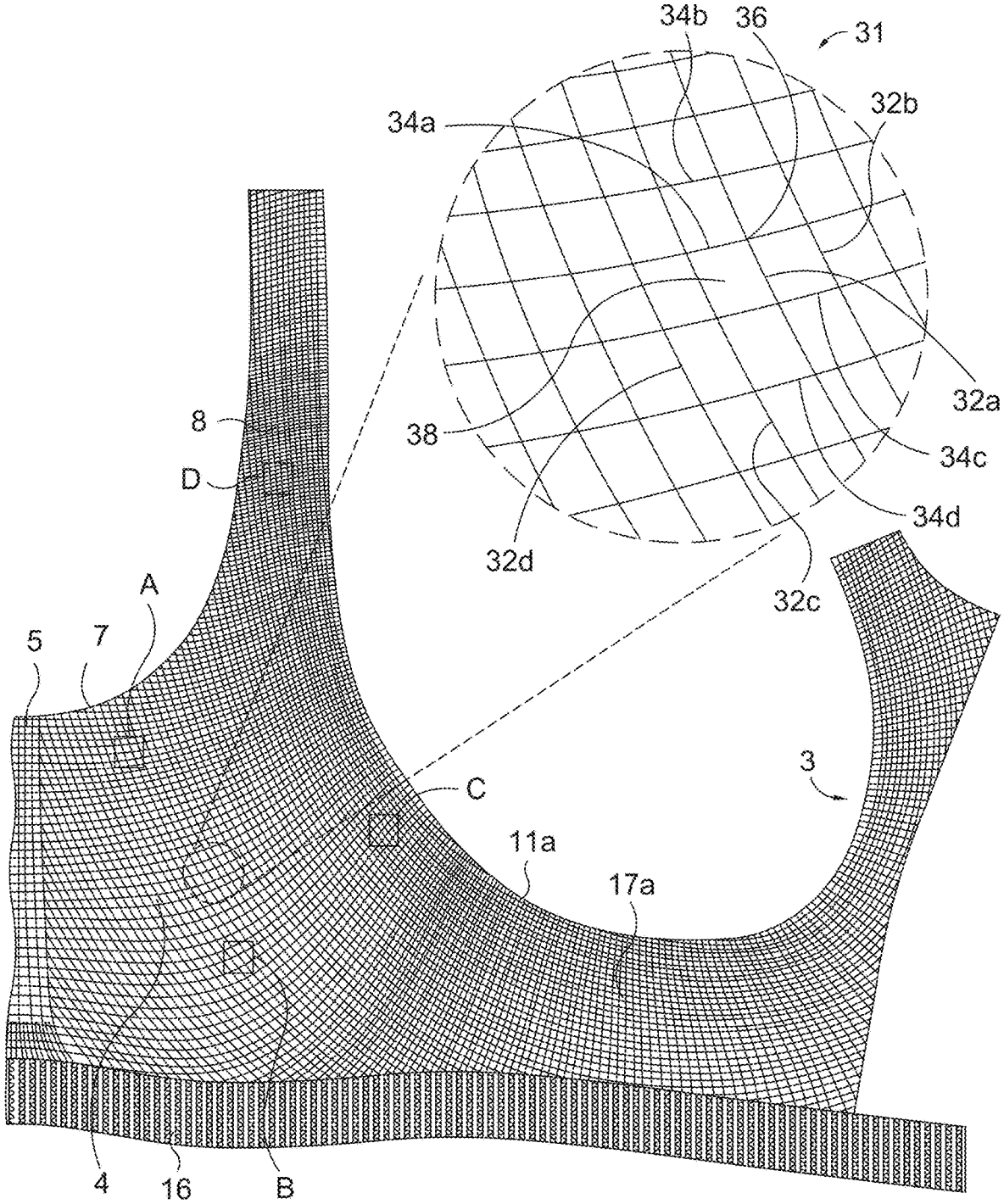
FIG. 1C illustrates an enlarged view of the left side of the support garment in the laid-flat configuration, based on an example.
Figure 1D:
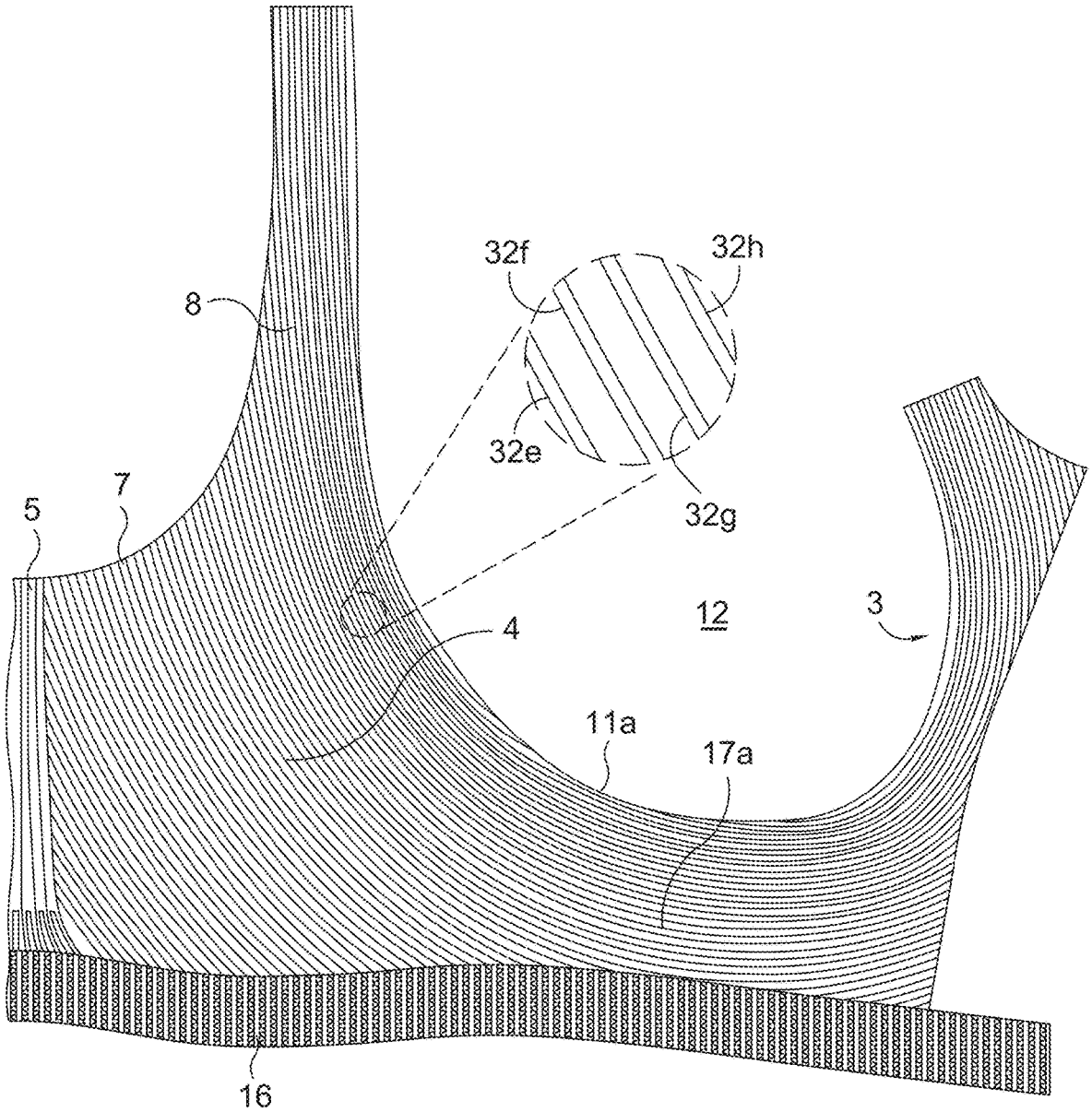
FIG. 1D illustrates an enlarged view of first elongated members, based on an example.
Figure 1E:
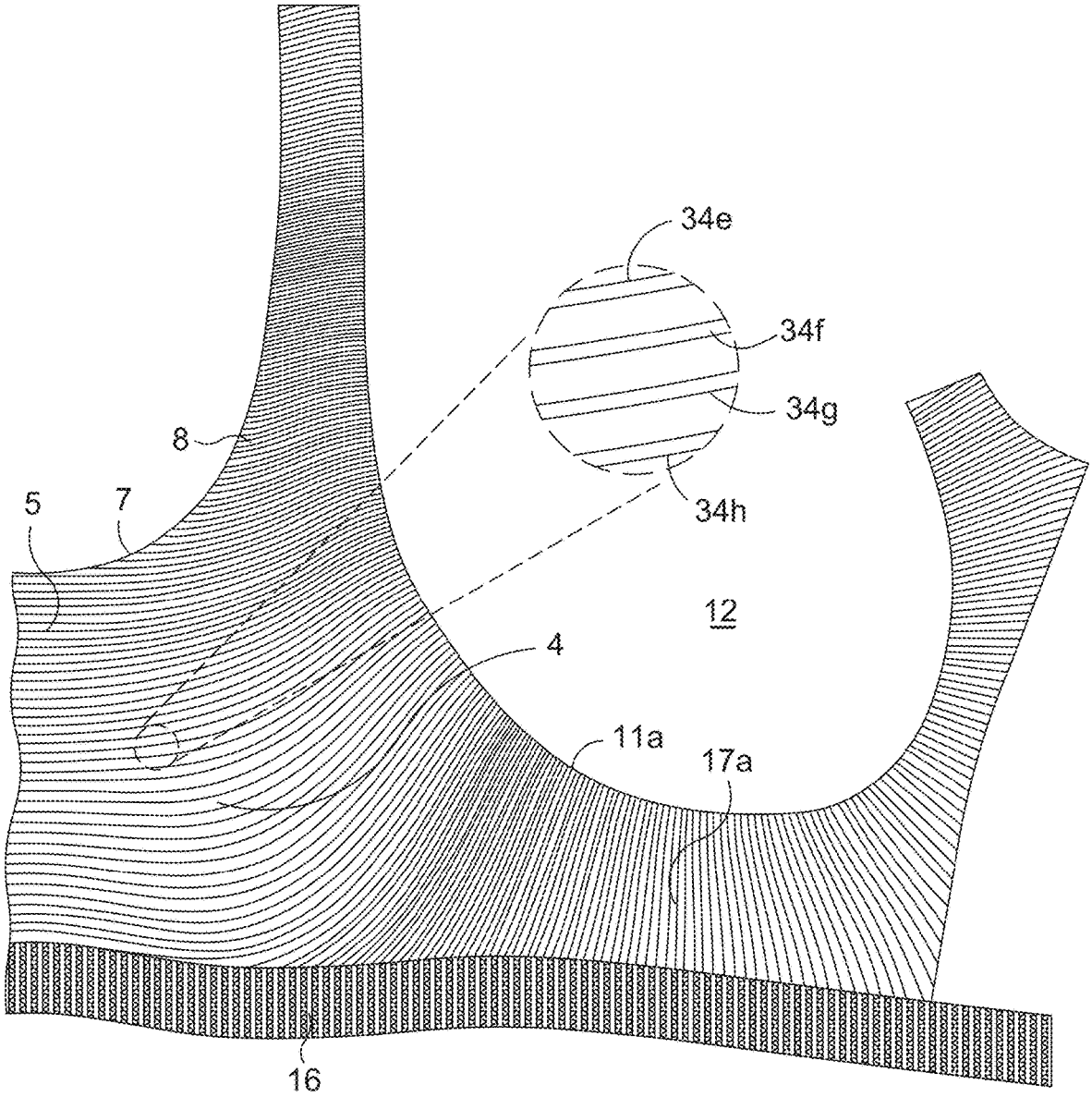
FIGS. 1E and 1F illustrate an enlarged view of second elongated members, based on an example.
Figure 1F:
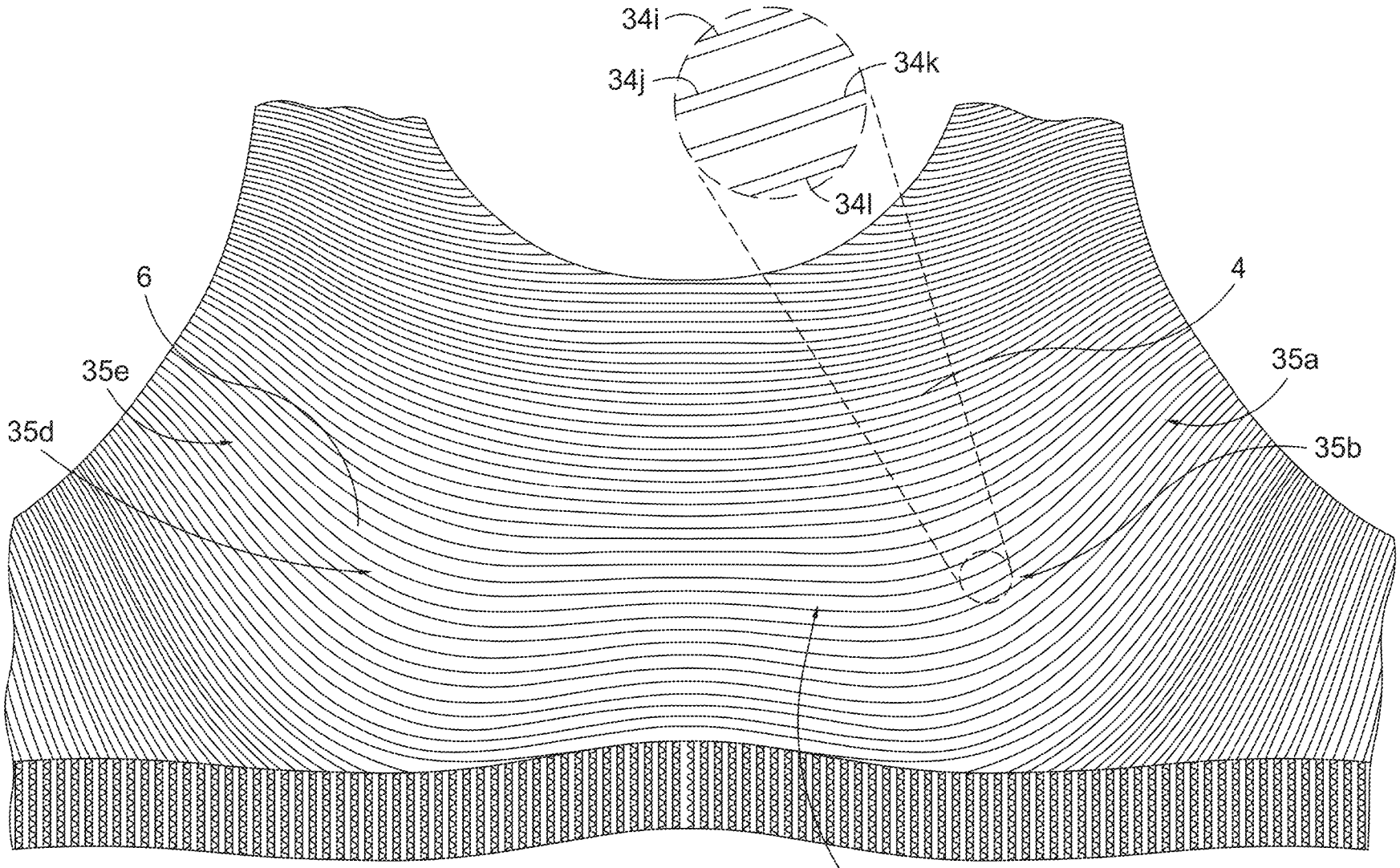

Referring to FIGS. 1C, 1D, 1E, and 1F, enlarged views are provided. For example, FIG. 1C includes a first plurality of elongated members 32*a*-32*d* (e.g., first elongated members) that longitudinally extend generally in a similar direction (e.g., in the x-y plane) and that may not overlap one another, and FIG. 1C also includes a second plurality of elongated members 34*a*-34*d* (e.g., second elongated members) that longitudinally extend generally in a similar direction (e.g., in the x-y plane) and that may not overlap one another. In FIG. 1C, the first plurality of elongated members intersects with the second plurality of elongated members and form the grid of cells. As an illustrative aid to help describe the first plurality of elongated members (e.g., 32*a*-32*d*), FIG. 1D depicts the first plurality of elongated member (e.g., first elongated members 32*e*-32*h*), and the second plurality of elongated members have been omitted from the drawing. As an illustrative aid to help describe the second plurality of elongated members, FIGS. 1E and 1F depict the second plurality of elongated members (e.g., second elongated members 34*e*-34*l*), and the first plurality of elongated members have been omitted from the drawing.

In examples of the present disclosure, FIGS. 1C and 1D include first elongated members (e.g., 32*e*-32*h*). In at least some examples, at least portions of the adjacent elongated members of the first elongated members do not overlap with another. In some examples, the first elongated members are concentrically arranged, and one example of this type of concentric arrangement is illustrated in FIG. 1D. For example, the first elongated members can include a series of rings that progressively extends outward and away from a more central position (e.g., the armhole).

The first elongated members (e.g., 32*e*-32*h*) can extend through multiple portions of zones of the support garment. For example, in at least some instances, the first elongated members can extend from an upper zone or portion of the breast-covering portion 4 to a lower zone or portion of the breast-covering portion 4. In some examples, the first elongated members can continuously extend from a shoulder strap 8, through the side or wing 17*a*, and into the back portion of the support garment (e.g., while also in some cases extending through the breast-covering portion 4 between the shoulder strap 8 and the side or wing 17*a*).

In at least some examples, a spacing between adjacent first elongated members (e.g., adjacent rings) of the first elongated members can vary throughout different zones or portions of the support garment 10. For example, a spacing between adjacent first elongated members in the strap 8 can be different than a spacing between adjacent first elongated members in the breast-covering area 4. In at least one example, the spacing between the adjacent first elongated members in the strap 8 can be shorter or smaller than the spacing between adjacent first elongated members in the breast-covering area 4. In some examples, a spacing between adjacent first elongated members that are closer to the armhole can be different than a spacing between adjacent first elongated members that are farther from the armhole. In at least one example, the spacing between adjacent first elongated members that are closer to the armhole is shorter or smaller than the spacing between adjacent first elongated members that are farther from the armhole.

In some examples, varying the spacing between adjacent first elongated members can contribute to the zonal properties associated with the support garment 10. For example, smaller spacing as between adjacent first elongated members can contribute to one or more smaller grid cells in the mesh (e.g., the mesh 31). In at least some examples, smaller grid cells in the mesh can (as comparted to larger grid cells in the mesh) be associated with more stability and/or less stretch. For example, more stability and/or less stretch can be evidenced by a larger modulus of elasticity (e.g., elongation when subjected to a tension force). In at least some examples, smaller grid cells with more stability and less stretch in the shoulder strap 8 (e.g., as compared to the breast covering portion) can contribute to better overall support by distributing more of the load onto the shoulder of the wearer. In at least some examples, larger grid cells with more stretch in the breast covering portion 4 can contribute to a desired amount of compressive support and encapsulation of the breast tissue by stretching more to conform to the wearer's anatomy.

In at least some examples, a directionality of a first elongated member (e.g., 32*a*-32*h*) can contribute to a stretch property. That is, the stretch or elasticity of the mesh can decrease in a direction that is more aligned with the longitudinal orientation of the first elongated members. For example, if a first elongated member extends more in a vertical direction (e.g., in the strap where the first elongated members extend in a more inferior-to-superior orientation), then the mesh can, in that zone, tend to be less stretchy or elastic in an orientation that is aligned with the vertical direction, as compared to an orientation that is not aligned with the vertical direction. In at least some examples, the orientation of the first elongated members can change as they extend among the various zones or regions, such that in one zone the first elongated members can decrease stretch in one orientation (e.g., in the vertical direction in the straps) and in another zone the first elongated members (e.g., the same elongated members) can decrease stretch in a different orientation (e.g., in the horizontal direction in the wing or side 17*a*).

The first elongated members 32*a*-32*h* can include various constructions, and in at least some instances, the first elongated members 32*a*-32*h* include unitary elongated members. For example, the first elongated members 32*a*-32*h* can be molded or cast, which can yield unitary elongated members. In some examples, the first elongated members 32*a*-32*h* can be extruded (e.g., 3D print), which can also yield unitary elongated members.

In examples of the present disclosure, FIGS. 1C, 1E, and 1F include second elongated members (e.g., 34*e*-34*l*). In at least some examples, at least a portion of adjacent second elongated members of the second elongated members do not overlap with another. In some examples, the second elongated members are radially arranged. For example, the second elongated members 34*e*-34l can include a series of elongated members that radially extend outward and away from a more central position (e.g., the armhole). In at least some examples, the second elongated members 34*e*-34l can extend laterally across the front of the support garment, such that the second elongated members extend through the first breast-covering portion 4, the center bridge 5, and the second breast-covering portion 6. In some examples, the second elongated members can extend from the armhole towards the underband 16 (e.g., in the side or wing).

In at least some examples, a spacing between adjacent second elongated members (e.g., adjacent radially extending elongated members) of the second elongated members can vary throughout different zones or portions of the support garment 10. For example, a spacing between adjacent second elongated members in a more lateral portion or zone (e.g., closer to the armhole 12) of the breast-covering portion 4 can be different than a spacing between adjacent second elongated members in a more medial portion or zone (e.g., closer to the center bridge 5) of the breast-covering area 4. In at least one example, adjacent second elongated members in the more lateral portion or zone (e.g., closer to the armhole 12) of the breast-covering portion 4 can be smaller than the spacing between adjacent second elongated members in the more medial portion or zone (e.g., closer to the center bridge 5) of the breast-covering area 4.

In at least some examples, a spacing between adjacent second elongated members in the strap portions can be different than a spacing between adjacent second elongated members in the breast-covering area 4.

In some examples, the second elongated members (e.g., 34*i*-34*l*) can extend across the front portion of the support garment, such as from the lateral portion of the left breast-covering portion 4, across the center bridge 5, and into the lateral portion of the right breast-covering portion. For example, the adjacent second elongated members 34*j* and 34*k* can continuously extend from the first position 35*a*, to the second position, 35*b*, to the third position 35*c*, to the fourth position 35*d*, and to the fifth position 35*e*. In some examples, a spacing between adjacent second elongated members (e.g., 34*j* and 34*k*) can vary as the adjacent second elongated members extend across the front. For example, the adjacent second elongated members 34*k* and 34*j* can include a first spacing at the first position 35*a* and a second spacing that is at the second position 35*b* and that is different than the spacing at the first position 35*a*. In some examples, the spacing at the second position 35*b* is larger than the spacing at the first position 35*a*. In at least some examples, the third spacing at the third position 35*c* between the adjacent second elongated members 34*j* and 34*k* can be different than the second spacing. For example, the third spacing can be less than the second spacing.

In at least some examples, a directionality of a second elongated member (e.g., 34*a*-32*l*) can contribute to a stretch property. That is, the stretch or elasticity of the mesh can decrease in a direction that is more aligned with the longitudinal orientation of the second elongated members. For example, if a second elongated member extends more in a vertical direction (e.g., in the side or wing where the second elongated members extend in a more inferior-to-superior orientation), then the mesh can, in that zone, tend to be less stretchy or elastic in an orientation that is aligned with the vertical direction, as compared to an orientation that is not aligned with the vertical direction. In at least some examples, the orientation of the second elongated members can change as they extend among the various zones or regions, such that in one zone the second elongated members can decrease stretch in one orientation (e.g., in the diagonal direction in the lateral portion of the breast covering portion) and in another zone the second elongated members can decrease stretch in a different orientation (e.g., in the horizontal direction in a more medial portion of the breast-covering portion).

The second elongated members 34*a*-34*l* can include various constructions, and in at least some instances, the second elongated members 34*a*-34*l* include unitary elongated members. For example, the second elongated members can be molded or cast, which can yield unitary elongated members. In some examples, the second elongated members can be extruded (e.g., 3D print), which can also yield unitary elongated members. In some examples, an extruded elongated member can be referred to as a filament.

Referring to FIGS. 1A through 1F collectively, varying the spacing between adjacent first elongated members (e.g., 32*a*-32*h*) and varying the spacing between adjacent second elongated members (e.g., 34*a*-34*l*) can contribute to the zonal properties associated with the support garment 10. In addition, varying the orientation of the elongated members can also contribute to the zonal properties. That is, cells of the grid of cells in the mesh 31 are formed by a pair of adjacent first elongated members (e.g., 32*a*-32*h*) that intersect with a pair of adjacent second elongated members (e.g., 34*a*-34*l*), and as such, the spacing between those pairs at least partially determines the size of the cell(s). For example, smaller spacing as between adjacent elongated members can contribute to one or more smaller grid cells in the mesh (e.g., the mesh 31), whereas larger spacing as between adjacent elongated members can form larger grid cells. In at least some examples, smaller grid cells in the mesh can (as comparted to larger grid cells in the mesh) be associated with more stability and/or less stretch. For example, more stability and/or less stretch can be evidenced by a larger modulus of elasticity (e.g., elongation when subjected to a tension force).

In at least some examples, the spacing between adjacent elongated members (and the resulting cell size) is configured to impart stretch properties (e.g., modulus of elasticity as related to elongation and/or maximum elongation under a given force) in a particular zone. For example, FIG. 1C depicts a first unit area A, a second unit area B, a third unit area C, and a fourth unit area D. In this disclosure, unit area(s) can refer to a commonly sized area of the mesh textile that is isolated for assessing a property of the mesh textile. In some examples, the unit area can include a size that is conducive to the testing methodology (e.g., a 1 cm×1 cm square or a 2 cm×2 cm square or a 3 cm×3 cm square). The unit area can be isolated by marking off or by cutting away, again depending on what form of isolation is necessary for the testing methodology. In some instances, unit areas can be used to test stretch properties in a zone (e.g., modulus of elasticity related to elongation, maximum elongation, growth, and recovery). In some instances, unit areas can be used to assess cell size or other cell properties, such as aspect ratio, cell density, and the like.

The unit areas A, B, C, and D can include positions that are relative to one another. For example, unit area A is, as compared to unit area B, in an upper zone or region of the breast-covering portion; and unit area B is, as compared to unit area C, more medially positioned. Unit area D is in the strap. These are just examples, and unit areas can be in other portions of the support garment, such as in the side portions or wings 17*a*, in the underband 16, on the back portion 3, in the center bridge 5, and the like.

In at least some examples, the unit area A can include a smaller cell than the unit area B (e.g., smaller than any cell in unit area B). In some examples, the smaller cell in unit area A can be in a same column or row of cells that extend through unit area B, such as where a pair of adjacent first elongated members (e.g., 32*a*-32*h*) extend through both unit areas. In at least some examples, the unit area C can include a smaller cell than the unit area B (e.g., smaller than any cell in unit area B). In some examples, the smaller cell in unit area C can be in a same column or row of cells that extend through unit area B, such as where a pair of adjacent second elongated members (e.g., 34*a*-34*l*) extend through both unit areas. In at least some examples, the unit area D can include a smaller cell than in the unit area B (e.g., smaller than any cell in unit area B).

In at least some examples, smaller grid cells with more stability and less stretch in the wing or side portion 17*a* or lateral part of a breast-covering portion can contribute to encapsulation of the breast tissue and compressive support in the underarm region. In at least some examples, larger grid cells with more stretch in the breast covering portion 4 can contribute to a desired amount of compressive support of the breast tissue by stretching more to conform to the wearer's anatomy. In at least some examples, smaller grid cells with more stability and less stretch in the shoulder strap 8 (e.g., as compared to the breast covering portion) can contribute to better overall support by distributing more of the load onto the shoulder of the wearer.

In at least some examples, the center bridge 5 can have different cell properties as compared to the breast-covering portions 4 and 6 (e.g., a unit area in the center bridge 5 can have different cell properties as compared to a unit area in the breast-covering portions). For example, the breast-covering portions 4 and 6 can each include a first set of cells that include a first average aspect ratio (e.g., a ratio between a longest side and a shortest side of the cell), and the center bridge 5 can include a second set of cells having a second average aspect ratio. The second average aspect ratio can be different from the first average aspect ratio. For example, the second average aspect ratio can be smaller compared to the first average ratio. Or, one aspect ratio can be closer to 1.0.

As another example, a first average density of cells (e.g., a number of cells per unit area) can be greater in the center bridge region compared to a second average density of cells in the breast-covering portions.

As another example, at least some of the cells in the center bridge 5 can have a different shape as compared to cells in the breast-covering portions 4 and 6. For instance, at least some cells in the center bridge 5 can be more rectangular as compared to the cells in the breast-covering portions 4 and 6. Rectangularity of a cell can be based on a ratio of the area of the cell to the area of that cell's minimum bounding rectangle (e.g., the smallest rectangle that can fully enclose the subject cell), and a higher ratio is associated with more rectangularity (e.g., the smaller the difference between the subject cell's area and its minimum bounding rectangle area, the more rectangular it is).

FIG. 1C includes (based on one example) a perimeter border demarcation (e.g., 5C) around at least part of the center bridge 5. In some other examples, the mesh textile can omit the perimeter border demarcation and cell properties can gradually transition from the breast-covering portions 4 and 6 into the center bridge 5. For instance, the aspect ratio of cells can gradually decrease from a first unit area further from the center bridge to a second unit area within the center bridge 5. In another example, cells can gradually transition to higher degrees of rectangularity from a first unit area further from the center bridge to a second unit area within the center bridge 5.

Figure 1G:
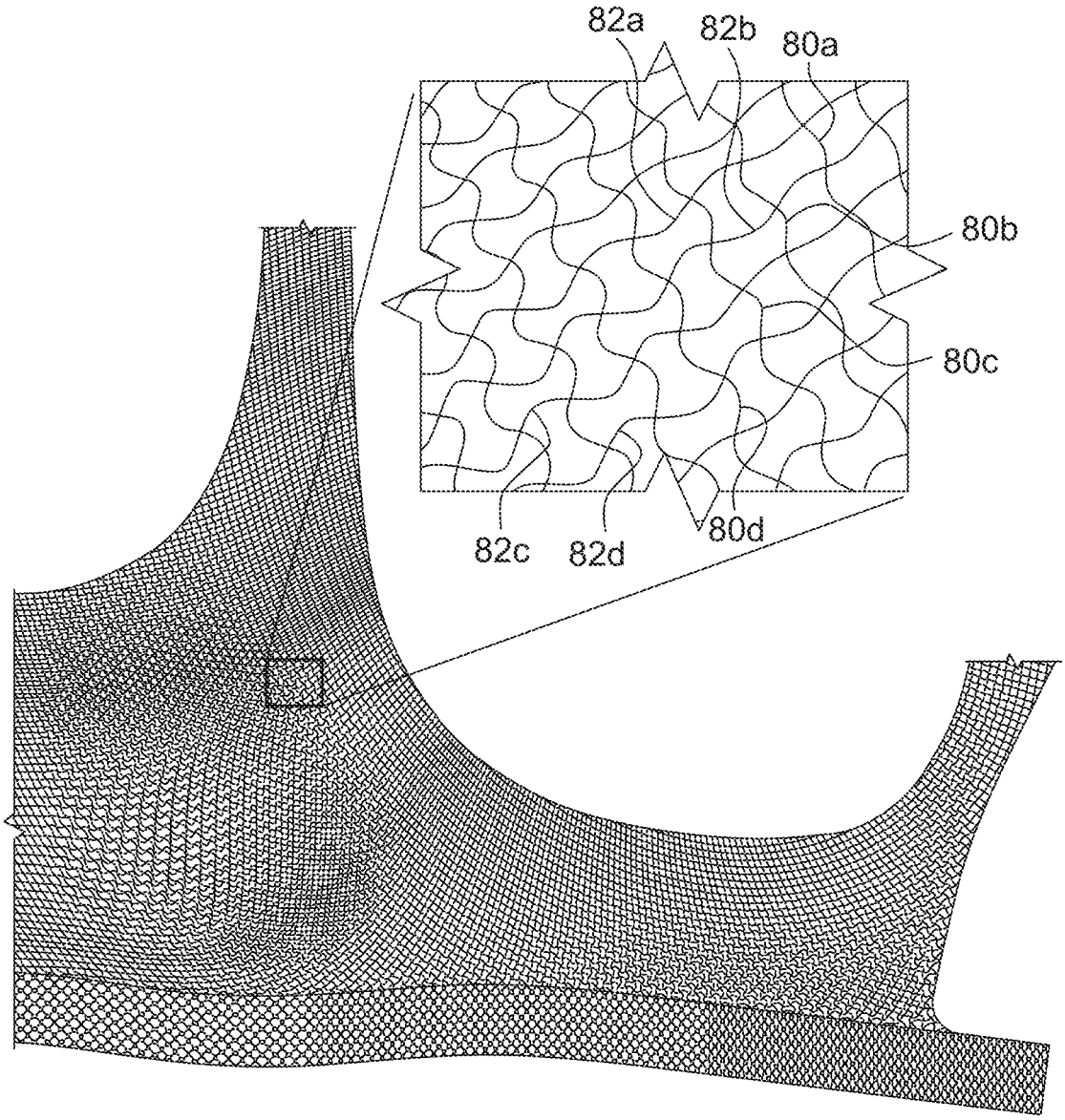
FIG. 1G illustrates an alternative configuration of elongated members that include a waveform, based on an example.
Figure 2E:
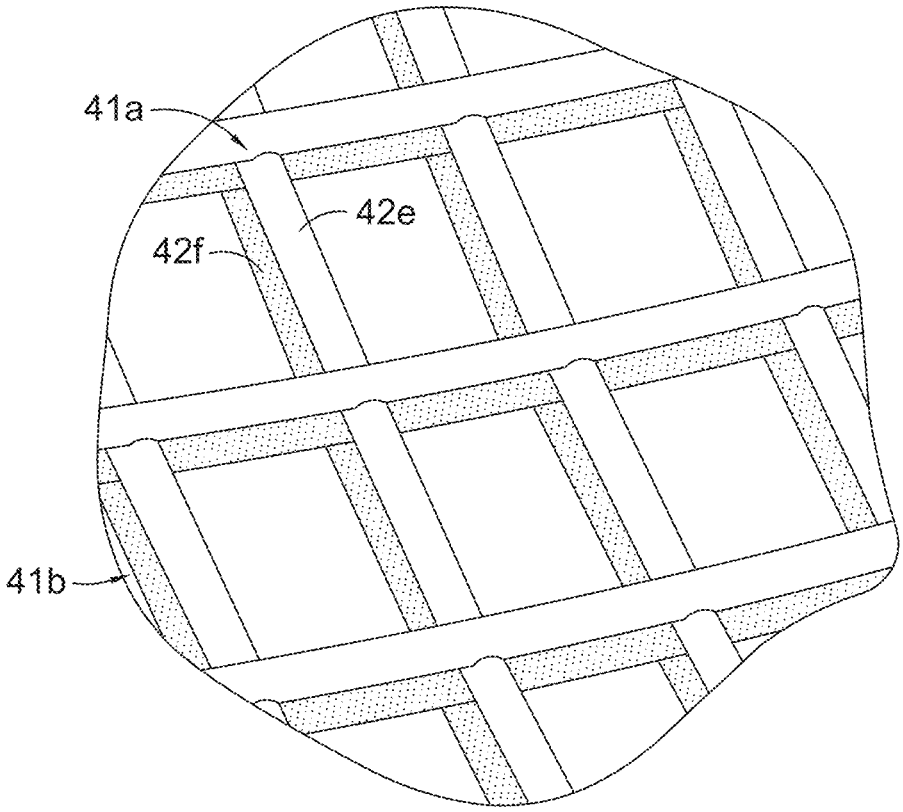
FIG. 2E illustrates a version of the first mesh construction in which one or more layers have different color properties.

The mesh of the support garment 10 can have various other properties. For example, in at least some examples, one or more of the elongated members can include a waveform, such as a sinuous waveform. In some examples, an elongated member can include at least one first segment or portion that does not include any waveform and at least one second segment or portion that is continuous with the first segment or portion and that does include a waveform. In some examples, the first segment can include a waveform with a first property (e.g., amplitude, frequency, etc.) and the second segment can include a waveform with a second property that is different from the first property (e.g., larger amplitude). For example, referring to FIG. 1G, the mesh textile includes first elongated members 80*a*-80*d* that are concentrically arranged (e.g., similar to the elongated members 32*e*-32*f*), and the first elongated members 80*a*-80*d* can include at least one segment or portion with a waveform (e.g., sinuous waveform). In at least some examples, the mesh textile can include second elongated members 82*a*-82*d* that radially extend (e.g., relative to the first elongated members 80*a*-80*d* and similar to the elongated members 34*e*-34*l*), and the second elongated members 82*a*-82*d* can also include at least one segment or portion with a waveform.

In at least some examples, the waveform can impart mechanical elongation properties to the elongated member, to the cell, and to the mesh. That is, the curves or bends in the elongated member that are embodied in the waveform can, under a tensional load (such as when the support garment is worn), straighten to permit the mesh to expand. In addition, the elongated member can return to the curved or bent form once the load is removed.

In at least some, the properties of the waveform can be varied to impart desired properties in different zones. For example, the amplitude and/or frequency of the waves can be increased in order to increase the elongation in a given zone. In at least some examples, the breast covering portion can include elongated members with a first waveform that is larger (e.g., larger amplitude) than waveforms in other zones of the support garment, which can impart higher relative elongation properties (e.g., maximum elongation) in the breast-covering portion.

The mesh (e.g., 31) of the present disclosure can include constructions that might vary from one another in some respects, and that are still consistent with the examples described with respect to FIGS. 1A through 1F. In at least one example, FIGS. 2A-2E illustrate a material panel (e.g., first mesh 40) that could include any of the elements of the mesh 31 and the various mesh attributes and characteristics described with respect to FIGS. 1A-1F. In at least on example, FIGS. 3A-3E illustrate a second material panel (e.g., second mesh 60) that could include any of the elements of the mesh 31 and the various mesh attributes and characteristics described with respect to FIGS. 1A-1F.

In an example, FIGS. 2A-2E illustrate the mesh 40, which includes elongated members (e.g., elongated members 42*a*, 42*b*, 42*c*, and 42*d*) that intersect with one another at nodes (e.g., nodes 44*a*, 44*b*, and 44*c*). In examples, the network of elongated members and nodes form cells (e.g., 46*a*, 46*b*, and 46*c*) that can include a center void or opening bound by the nodes and portions of the elongated members.

In examples of the present disclosure, the mesh 40 includes a first side 41*a* that forms an outer-facing side when the mesh 40 is incorporated into the support garment 10, and the mesh 40 include a second side 41*b* that forms an inner-facing side when the mesh 40 is incorporated into the support garment 10. For instance, the first side 41*a* can face away from the wearer, and the second side 41*b* can face towards the wearer. In some examples, the first side 41*a* can form an outermost face or side of at least a portion of the support garment (e.g., there are no other textiles coupled to and covering the first side 41*a* in that portion of the support garment). In some examples, the second side 41*b* can form an innermost face or side of at least a portion of the support garment, such that the second side 41*b* can be a skin-contacting side or surface. In some examples, another textile can be arranged adjacent to the second side 41*b* in at least a portion of the support garment.

In at least some instances, a grid of the mesh 40 can be formed by a first plurality of elongated members that longitudinally extend generally in a similar direction (e.g., in the x-y plane) and that may not overlap one another, and by a second plurality of elongated members that longitudinally extend generally in a similar direction (e.g., in the x-y plane) and that may not overlap one another. In examples, the first plurality of elongated members can intersect with the second plurality of elongated members to form the cells.

In examples, the elongated members 42*a*, 42*b*, 42*c*, and 42*d* can each include a unitary strand structure that is continuous from one node to an adjacent node, and in some cases, across a plurality of nodes. For example, an elongated member can include a portion of the elongated member 42*c* extending from the node 44*a* to the node 44*c*. In some examples, an elongated member can include a portion of the elongated member 42*c* extending across multiple nodes, from at least the node 44*b*, through the node 44*a*, and to at least the node 44*c*. In some examples, the strand structure can include a unitary body having a uniform composition.

The elongated members 42*a*, 42*b*, 42*c*, and 42*d* can be formed by various techniques, such as by 3D printing (e.g., SDM, FDM, FFF, EBF, SLS, etc.) or other extrusion methods. In some examples of this disclosure, the elongated members 42*a*, 42*b*, 42*c*, and 42*d* can be referred to as filaments. In at least one example, to form each elongated member, material can be forced through the nozzle of an extruder onto a substrate, which may be formed of glass or other appropriate material. In at least some examples, the width of an elongated member can be less than 3 mm wide, and in some examples, less than 2 mm wide, less than 1.5 mm wide, less than 1 mm wide, or even less than 0.75 mm wide.

In at least some examples in which the elongated members are extruded, the nozzle diameter may be somewhat narrower than the final extruded width of the elongated member (e.g., because the heated filament material may tend to flatten out after being deposited path segment or even may be pushed downward by the extruder nozzle). In general, increasing the temperature of the material being extruded may cause the elongated member to flatten out more. In examples, the nozzle diameter may be about 0.4 mm, although the nozzle diameter may range, for example, from 0.25 mm to 2.5 mm (and in some examples, from 0.3 mm to 2 mm). In addition, the surface of the substrate may be smooth or otherwise textured, and the characteristics of the bottom surface of the elongated member may form to and take the shape (e.g., smooth or textured characteristics) of the substrate surface on which it contacts and is formed.

In at least some examples, a first elongated member (e.g., 42*a*) can be extruded, after which one or more second elongated members (e.g., 42*b*) can be extruded in a direction to cross or intersect the first elongated member. According to some examples, a resulting structure can be seen in FIGS. 2A through 2E and FIG. 10. The second elongated member can directly contact the first elongated member as it is being extruded, and in some instances, heat from the material of the second elongated member during the extrusion thereof (and/or another heat source) can cause the second elongated member to fuse together with the first elongated member at location(s) where they contact one another (e.g., the material of the second elongated member can polymerize with and seamlessly join the material of the first elongated member, and heat from the extruded second elongated member as it is being deposited can support this fusion feature). In this manner, the first elongated member can be fixedly joined to the second elongated member in an adhesive free manner at contact locations.

In at least some examples, the elongated members 42*a*, 42*b*, 42*c*, and 42*d* can compositionally include an elastomer (e.g., thermoplastic elastomer), including any elastomer described in this disclosure or any equivalent thereof. In some examples, the elongated members of the mesh 40 can include a co-polymer. In some examples, the elongated members of the mesh 40 can include TPU.

The compositional material of the elongated members (and the mesh) can include various other properties, such hardness. In some examples, the compositional material can include a shore hardness in a range of about 40 A to about 85 A. In some examples, the shore hardness is in a range of about 45 A to about 75 A. In some examples, the shore hardness is about 52 A. In some examples, the shore hardness is about 60 A. In some examples, the shore hardness is about 70 A. In some examples, the compositional material includes a TPU with a shore harness of about 70 A.

In at least some examples, the elongated members 42*a*, 42*b*, 42*c*, and 42*d* can include a filament. In at least some examples, the elongated members 42*a*, 42*b*, 42*c*, and 42*d* can include a monofilament. In some examples, the elongated members 42*a*, 42*b*, 42*c*, and 42*d* can include an extrudate. For example, the elongated members 42*a*, 42*b*, 42*c*, and 42*d* can each include a 3D printed elongated member. In some examples, the extrudate is a single component extrudate. In some examples, the extrudate can include a multi-component extrudate (e.g., side-by-side extruded elongated members).

In examples, the elongated members 42*a*, 42*b*, 42*c*, and 42*d* are layered or stacked. For example, the mesh 40 can include, extending from one node to an adjacent node, multiple elongated members that are extending in the same orientation (e.g., the elongated members 42*a* and 42*c* are axially aligned with one another in the same orientation) between nodes and are layered or stacked. Stated differently, the elongated members generally longitudinally extend in the x-direction or in the y-direction, and in examples, the mesh 40 can include elongated members extending in the same x-direction between nodes and stacked in the z-direction. For example, the elongated members 42*a* and 42*c* are extending in the same direction (e.g., follow a similar x-y trajectory and are axially aligned) and the elongated member 42*c* is stacked on the elongated member 42*a* in the z-direction. The stacked arrangement of the elongated member 42*c* on the elongated member 42*a* is depicted in FIGS. 2B and 2C. In another example, the elongated members 42*b* and 42*d* are extending in the same direction (e.g., follow a similar x-y trajectory and are axially aligned) and the elongated member 42*d* is stacked on the elongated member 42*b* in the z-direction. The stacked arrangement of the elongated member 42*d* on the elongated member 42*b* is depicted in FIGS. 2B and 2D.

As indicated, the elongated members can converge and/or intersect with one another at nodes. In at least some examples, such as where the mesh includes layered or stacked elongated members, the intersecting elongated members interleave with one another. For example, the elongated members 42*a* and 42*c* intersect with the elongated members 42*b* and 42*d* at the node 44*a*. In examples, at the node 44*a* the elongated member 42*b* interleaves between the elongated members 42*a* and 42*c*, and the elongated member 42*c* interleaves between the elongated members 42*b* and 42*d*.

In examples, the elongated members can be bonded at one or more portions, such as by chemical bonding and/or mechanical bonding. In at least some examples, elongated members can be thermally bonded at one or more positions. For instance, elongated members can be thermally welded at one or more positions.

In at least some examples, a node 44*a* can include one or more portions of the intersecting elongated members that are thermally welded to one another. For example, in association with the node 44*a*, a thermal weld 48*a* can bond the elongated member 42*b* to the elongated member 42*a*; a thermal weld 48*b* can bond the elongated member 42*c* to the elongated member 42*b*; and a thermal weld 48*c* can bond the elongated member 42*d* to the elongated member 42*c*.

In at least some examples, a thermal weld can bond the elongated members that are extending in the same direction (e.g., follow a similar x-y trajectory) and that are stacked (in the z-direction). For example, a thermal weld 49*a* (FIG. 2C) can bond the elongated member 42*c* to the elongated member 42*a*. In some instances, a thermal weld 49*b* (FIG. 2D) can bond the elongated member 42*d* to the elongated member 42*b*.

Thermal bonding as between the elongated members can contribute to various properties of the mesh and ultimately to the support garment 10. For example, the thermal bonding can contribute to a more cohesive structure that more evenly distributes forces and retains its shape after repeated stretch and release cycles. In addition, the thermal bonding can help retain the elongated members in a desired position and orientation for maintaining the structure of the mesh and impede the elongated members from sliding out of position. In at least one example, the thermal bonding as between the various elongated members can enable the mesh 40 to include properties that are consistent with the mesh 31. For example, the thermal weld 49*a* can join the elongated members 42*c* and 42*a*, such that the elongated members 42*c* and 42*a* can operate as a single elongated member, similar to the first elongated members 32*a*-32*h*. Similarly, the thermal weld 49*b* can join the elongated members 42*d* and 42*b*, such that the elongated members 42*d* and 42*b* can operate as a single elongated member, similar to the second elongated members 34*a*-34*l*.

The elongated members can include one or more cross-sectional shapes and profiles. For example, in some examples, the one or more elongated members that form the second side 41*b* can include a flat face. For instance, as depicted in FIGS. 2B and 2C, at least a portion of the elongated member 42*a* can form at least part of the second side 41*b* of the mesh 40 and can include a flat face 50. In addition, as depicted in FIG. 2D, at least a portion of the elongated member 42*b* can form at least part of the second side 41*b* of the mesh 40 and can include a flat face 52. In some examples, the one or more elongated members that form the second side 41*b* can include a face that is flatter, as compared to the portion of the elongated member forming the first side 41*a*.

The flat face(s) on the second side 41*b* can contribute to one or more properties of the mesh 40. In some examples, the flat face(s) can provide a smoother second side 41*b* (e.g., as compared to a more ovular or circular cross section that has little or no flat face), which can be an innermost side or face of the support garment. As such, the flat face(s) can improve comfort against the wearer's skin. In at least some examples, the flat face(s) can contribute to desired stretch properties of the elongated member(s). For example, the flat face(s) can more evenly distribute tensile forces, such as when the elongated member(s) stretch to conform to the wearer's body. In at least some instances, this more even tensile force distribution can reduce pressure of the elongated member(s) against the skin (as compared to an elongated member with little to no flat face), since the force is spread out over a larger surface area.

In examples, elongated members can have different cross-sectional shapes as compared to one another. For example, the flat face 50 of the elongated member 42*a* can include a different width (e.g., side-to-side width based on the view in FIG. 2C) as compared to the flat face 52 of the elongated member 42*b*. In some instances, the flat face 50 can be wider than the flat face 52. In some examples, the flat face 50 and the flat face 52 can have a similar width.

The flat face, surface, or portion of the elongated member (s) forming the second side 41*b* can be imparted in various manners. In at least one example, when constructing the mesh 40, an elongated member (e.g., 42*a*) is extruded (e.g. by 3D printing) onto a flat surface (e.g., glass) while the material is at least partially softened, such that upon cooling/curing, the portion of the extrudate contacting the flat surface is at least partially formed into the flat face. In some examples, a difference in sizes of the flat faces (e.g., where the flat face 50 is wider than the flat face 52) can arise from a difference in viscosity of the extrudate upon contacting the flat surface and/or the extent to which the extrudate might be partially suspended above the flat surface, such as between two nodes. That is, when an extrudate extends from one node to an adjacent node, at each node the extrudate might be stacked atop one or more other nodes, such that a lesser amount of the extrudate flows into contact with the flat surface before cooling/curing.

In at least one example, the elongated member 42*a* is extruded as part of a first filament layer that is deposited by an extruder (e.g., by the extruder forcing material through a nozzle while moving in a tool path that matches a pattern corresponding to the first filament layer). In some examples, the first filament layer can correspond with FIG. 1D (and/or FIG. 12). For example, the first filament layer can be deposited such that the elongated members 42*a* are initially positioned to form a perimeter around the entire panel. In addition, after the perimeter of the elongated members 42*a* has been deposited, the extruder can deposit additional elongated members 42*a* that correspond with the first elongated members (e.g., 32*a*-32*h*). For example, the elongated members 42*a* can serpentine back and forth within the perimeter to fill in the material panel with the first elongated members.

In at least some examples, the face of the elongated member that forms the second side 41*b* (e.g., the flat face 50 and/or the flat face 52) can be treated or textured to impart a desired property. For example, the flat surface (e.g., glass) onto which the elongated member is extruded can be frosted or otherwise textured, such that the portion of the elongated member in contact with the surface retains a texture upon cooling and/or curing. That is, the flat face 50 or 52 can include the texture imparted by the frosted/textured glass. In examples, the texture of the flat face 50 or 52 is different as compared to the other sides of the elongated member that are not in contact with the glass upon cooling, and these other sides can be smoother as compared to the flat face(s). In examples, the textured flat face(s) 50 or 52 can impart desired properties, such as handfeel, and/or can reduce cling (e.g., against the skin).

In examples, the first side 41*a* of the mesh and the second side 41*b* of the mesh can have different color properties. For example, referring to FIG. 2E, one or more elongated members 42*e* forming the first side 41*a* can have a different color property than one or more elongated members 42*f* forming the second side 41*b*. In at least some examples, the color property can be at least partially based on a dye or pigment mixed with the material prior to 3D printing. The mesh with varied color properties as between the first side 41*a* and the second side 41*b* can operate in various manners in association with a support garment. For example, the mesh with varied color properties can have a camouflaging effect to obscure the underlying skin surface, which can contribute to improved modesty and perceived skin coverage without adding as much weight and bulk as might otherwise be associated with an additional textile layer.

Referring to FIGS. 3A-3D, an example of the present disclosure can include the mesh 60. In examples, the mesh 60 can include elongated members (e.g., elongated members 62*a*, 62*b*, 62*c*, and 62*d*) that intersect with (e.g., converge with) one another at nodes (e.g., nodes 64*a*, 64*b*, 64*c*, and 64*d*). In examples, the network of elongated members and nodes form cells (e.g., 66) that can include a center void or opening bound by the nodes and by portions of the elongated members.

In examples of the present disclosure, the mesh 60 includes a first side 61*a* that forms an outer-facing side when the mesh 60 is incorporated into the support garment 10, and the mesh 60 includes a second side 61*b* that forms an inner-facing side when the mesh 60 is incorporated into the support garment 10. For instance, the first side 61*a* can face away from the wearer, and the second side 61*b* can face towards the wearer. In some examples, the first side 61*a* can form an outermost face of at least a portion of the support garment (e.g., in that portion there are no other textiles coupled to and covering the first side 61*a* in the portion of the support garment). In some examples, the second side 61*b* can form an innermost face or side of the support garment, such that the second side 61*b* can be a skin-contacting side or surface. In some examples, another textile can be arranged adjacent to the second side 61*b* in at least a portion of the support garment.

In at least some instances, a grid of the mesh 60 can be formed by a first plurality of elongated members (e.g., 62*a* and 62*c*) that longitudinally extend generally in a similar direction (e.g., in the x-y plane) and that may not overlap one another, and by a second plurality of elongated members (e.g., 62*b* and 62*d*) that longitudinally extend generally in a similar direction (e.g., in the x-y plane) and that may not overlap one another. In examples, the first plurality of elongated members (e.g., first elongated members) can intersect with (e.g., converge with) the second plurality of elongated members (e.g., second elongated members) to form the cells.

In examples, an elongated member (e.g., 62*a*, 62*b*, 62*c*, and 62*d*) can include a unitary body having a uniform structure that is continuous from one node to an adjacent node, and in some cases, across a plurality of nodes. For example, an elongated member can include a portion of the elongated member 62*a* extending from the node 64*a* to the node 64*c*. In some examples, an elongated member can include a portion of the elongated member 62*a* extending across multiple nodes, such as from at least the node 64*c*, through the node 64*a*, and to at least the node 64*b*. In some examples, the mesh 60 can include a unitary mesh structure (e.g., formed by casting).

In at least some examples, the elongated members 62*a*, 62*b*, 62*c*, and 62*d* can compositionally include an elastomer (e.g., thermoplastic elastomer), including any elastomer described in this disclosure or any equivalent thereof. In some examples, the elongated members of the mesh 40 can include a co-polymer. In some examples, the elongated members of the mesh 60 can include a polyurethane, including a thermoplastic polyurethane. In some examples, the elongated members of the mesh 60 can include a silicone.

The compositional material of the elongated members (and the mesh) can include various other properties, such hardness. In some examples, the compositional material can include a shore hardness in a range of about 40 A to about 85 A. In some examples, the shore hardness is in a range of about 45 A to about 75 A. In some examples, the shore hardness is 52 A. In some examples, the shore hardness is 60 A. In some examples, the shore hardness is 70 A. In some examples, the compositional material includes a polyurethane with a shore harness of 60A.

As indicated, the elongated members (e.g., 62*a*, 62*b*, 62*c*, and 62*d*) can converge and/or intersect with one another at nodes. In at least some examples, the elongated members are fixedly joined at the nodes, such as where the mesh 60 of elongated members and nodes is co-formed. In at least some examples, the mesh 60 is formed by a molding process. In at least some examples, the mesh is formed by a casting process. In at least some examples, the mesh 60 is formed by a subtractive or reductive process, such where the openings are cut into a film or sheet (e.g., laser cut, die cut, stamped, etc.).

Figure 3A:
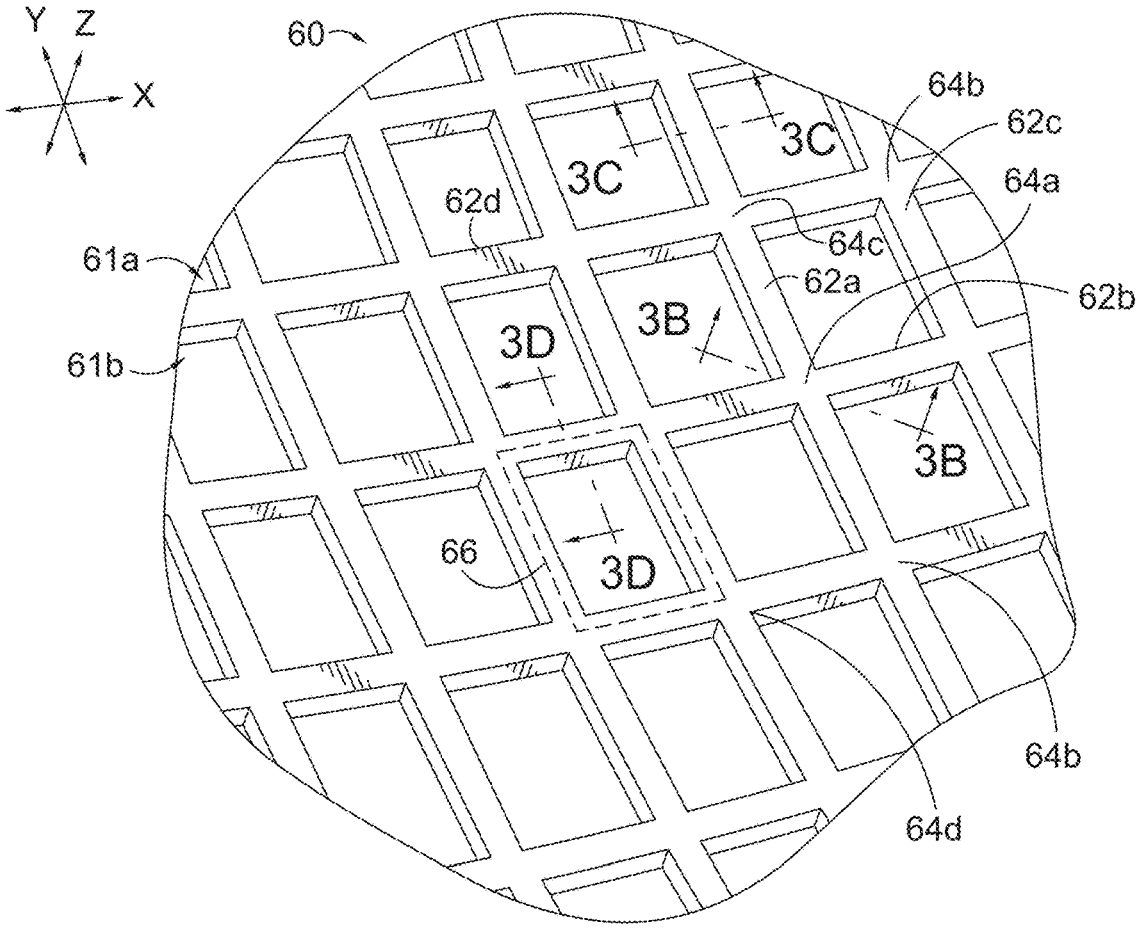
FIGS. 3A-3D illustrate a second mesh construction, based on an example.
Figure 3B:
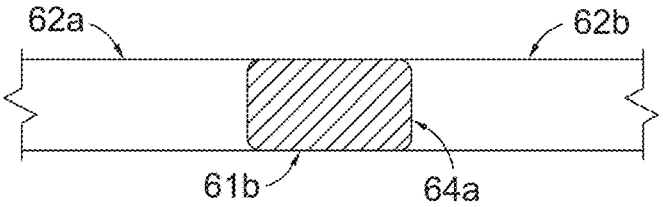
Figure 3C:
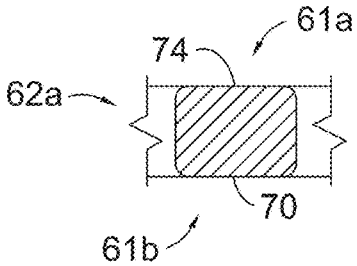
Figure 3D:
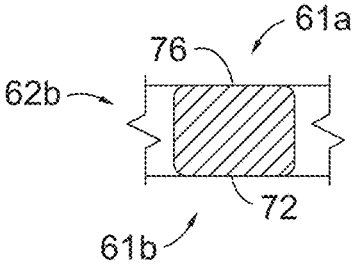
Figure 3E:
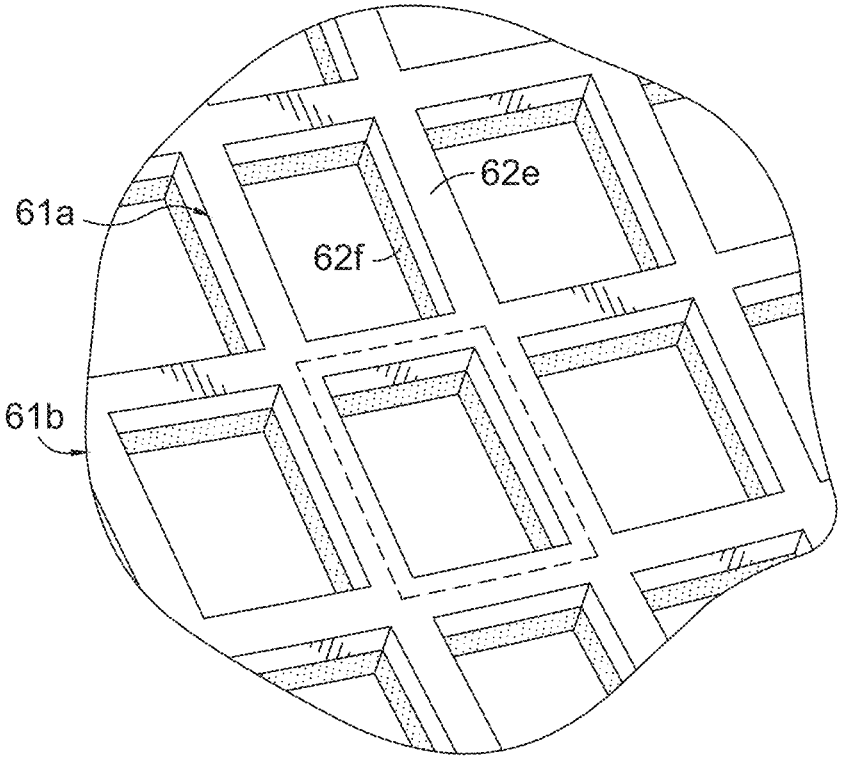
FIG. 3E illustrates a version of the second mesh construction having different color properties.

The elongated members can include one or more cross-sectional shapes and profiles. For example, in some cases, the one or more elongated members that form the second side 61*b* can include a flat face. For instance, as depicted in FIGS. 3B, 3C, and 3D, at least a portion of the elongated members 62*a* and 62*b* can form at least part of the second side 61*b* of the mesh 60. In addition, the portions of the elongated members 62*a* and 62*b* that form the second side 61*b* can include flat faces 70 and 72 (respectively). In some examples, the portions of the elongated members 62*a* and 62*b* forming the second side 61*b* can be substantially co-planar (e.g., when laid flat). In some examples, one of the flat faces 70 or 72 of the elongated members 62*a* or 62*b* can be offset (relative to the other) in the z direction.

In at least some examples, the one or more elongated members that form the first side 61*a* can include a flat face. For instance, as depicted in FIGS. 3B, 3C, and 3D, at least a portion of the elongated members 62*a* and 62*b* can form at least part of the first side 61*a* of the mesh 60. In addition, the portions of the elongated members 62*a* and 62*b* that form the first side 61*a* can include flat faces 74 and 76 (respectively).

The flat face(s) on the second side 61*b* can contribute to one or more properties of the mesh 60. In some examples, the flat face(s) can provide a smoother second side 61*b*, which can be an innermost side or face of the support garment. As such, the flat face(s) can improve comfort against the wearer's skin. In at least some examples, the flat face(s) can contribute to desired stretch properties of the elongated member(s). For example, the flat face(s) can more evenly distribute tensile forces, such as when the elongated member(s) stretch to conform to the wearer's body. In at least some instances, this more even tensile force distribution can reduce pressure of the elongated member(s) against the skin (as compared to an elongated member with little to no flat face), since the force is spread out over a larger surface area.

The flat face, surface, or portion of the elongated member(s) forming the second side 61*b* can be imparted in various manners. In at least one example, the surface contours of a mold used to mold or cast the mesh 60 can be configured to impart the flat face.

The flat face, surface, or portion of the elongated member(s) forming the first side 61*a* can be imparted in various manners. In at least one example in which the mesh 60 is cast, the flat faces 74 and 76 can be formed by a scraping or wiping (e.g., with a squeegee or similar tool) excess material away from the casting form before the material has fully set or cured.

In some examples, the cross-sectional profile across a plurality of different elongated members can be uniform. In some examples, the cross-sectional profile can vary within single elongated member and/or across a plurality of different elongated members, which can contribute to zonal properties. For example, one cross-sectional profile can be smaller as compared to another cross-sectional profile, and the smaller cross-sectional profile can contribute to a lower modulus of elasticity (e.g., for elongation) associated with that elongated member. In some examples, the shape of the cross-sectional profile can vary in order to impart zonal properties. For example, a first segment of an elongated member can include a flatter ribbon style cross section, whereas a second segment of the elongated member (or of a different elongated member) can include a rounder cross-sectional profile or more square cross-sectional profile. The flatter ribbon style cross section can contribute to more flexibility in responses to a bending force (e.g., applied from a direction of the innermost face).

In examples, the first side 61*a* of the mesh and the second side 61*b* of the mesh can have different color properties. For example, referring to FIG. 3E, one or more elongated members 62*e* forming the first side 61*a* can have a different color property than one or more elongated members 62*f* forming the second side 61*b*. In at least some examples, the color property can be at least partially based on a dye or pigment mixed with the material prior to curing or otherwise depositing in to a mold or cast. For example, a first material having a first color property can be deposited into the mold to form the one or more elongated members 62*f*, and then, a second material having a second color property can be deposited into the mold and over the first material to form (e.g., co-form) the one or more elongated members 62*e*. The mesh with varied color properties as between the first side 61*a* and the second side 61*b* can operate in various manners in association with a support garment. For example, the mesh with varied color properties can have a camouflaging effect to obscure the underlying skin surface, which can contribute to improved modesty and perceived skin coverage without adding as much weight and bulk as might otherwise be associated with an additional textile layer.

In examples (e.g., 1B and FIG. 4), the underband 16 can have various properties. For example, the upper-torso garment can include a main body 85, and the underband 16 can include an upper portion 86 that connects to the main body 90 and a lower portion 87 that is opposite the upper portion. In some examples, the lower portion 87 can include a bottom edge. The underband 16 can include a widthwise orientation 88 extending from the upper portion to the lower portion and a lengthwise orientation 89.

In examples, the underband 16 can extend in the lengthwise orientation from a first end 90*a* to a second end 90*b* (e.g., FIG. 1B). In examples, the ends 90*a* and 90*b* can connect in a back portion 3 of the support garment 10. In some examples, the ends 90*a* and 90*b* can be fixedly coupled to one another (e.g., stitched, thermally bonded, adhered, etc.). In some examples the ends 90*a* and 90*b* can include hardware for releasably connecting to one another (e.g., hooks, buckles, clips, snaps, hook-and-loop, etc.). In examples, the underband 16 can extend fully around the support garment from the back 3, around one side to the front 2, across the front to the other side, around the other side, and to the opposing side on the back 3.

In at least some examples, the underband 16 can include a mesh construction that includes elongated members, which intersect with one another at nodes to form cells. The mesh construction of the underband 16 can include any one or more of the properties described with respect to the mesh 31, the mesh 40, and the mesh 60 (e.g., compositional material, method of make, etc.). For example, the mesh of the underband 16 and the component parts thereof (e.g., elongated members and nodes) can be 3D printed, cast, molded, cut, etc.

Figure 4:
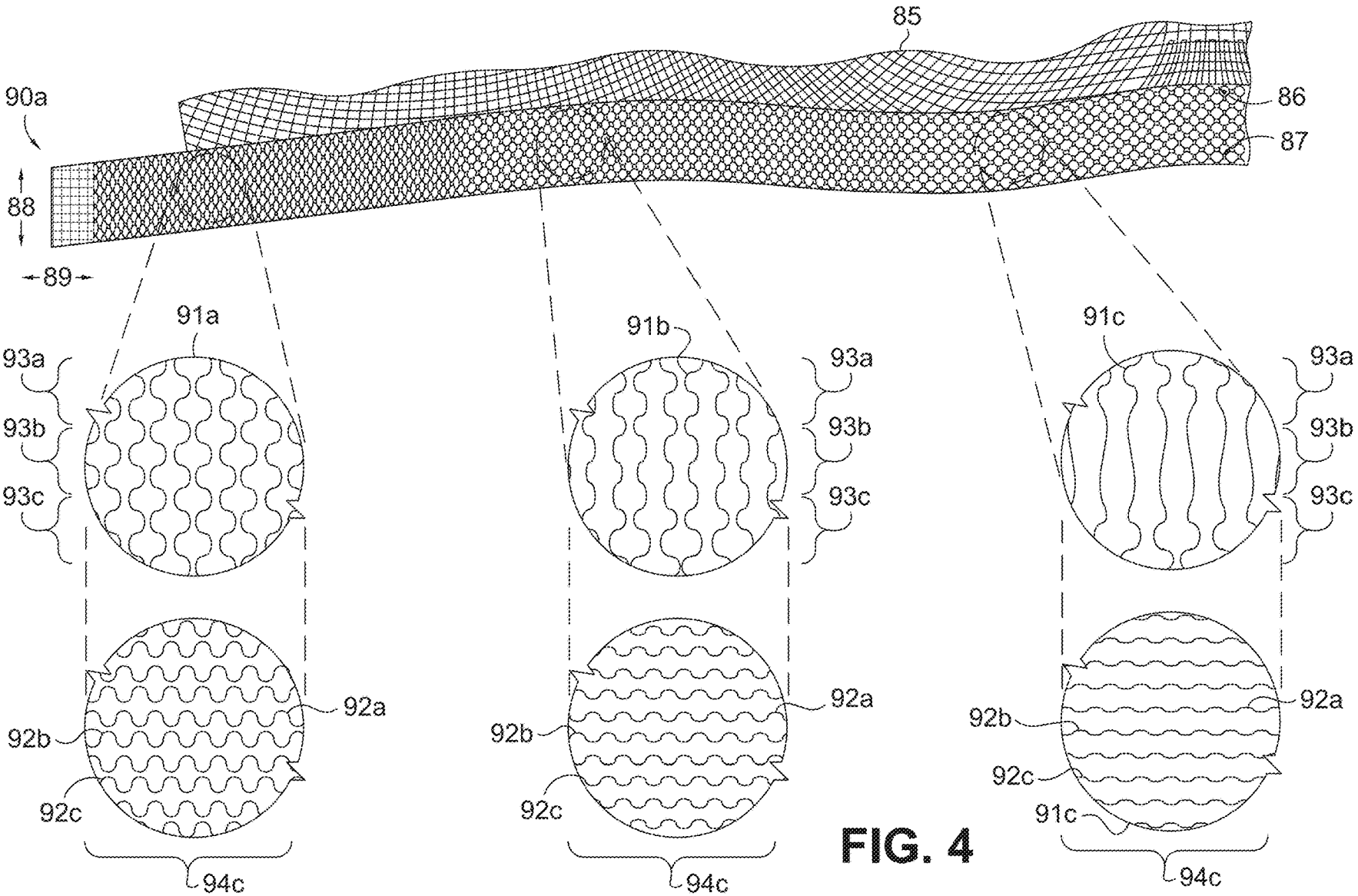
FIG. 4 illustrates an underband, based on an example.

In at least some instances, the mesh can include a first plurality of elongated members 91 (e.g., 91 collectively and/or the first elongated members 91*a*-91*c*) that longitudinally extend generally from the upper portion 86 to the lower portion 87 (e.g., the first plurality of elongated members 91 extend widthwise relative to the underband 16). The first elongated members (or at least a portion thereof) might not overlap one another. In addition, the mesh in the underband 16 can include a second plurality of elongated members 92 (e.g., 92 collectively and/or second elongated members 92*a*-92*c*) that longitudinally extend in the lengthwise orientation 89 and that can intersect with the first elongated members to form the cells of the mesh. In FIG. 4, each of the second elongated members 92*a*-92*c* can continuously extend across the underband, such that each is depicted in each of the enlarged views (e.g., each of the enlarged views depicts a different segment of the second elongated members 92*a*-92*c*).

In at least some examples, the first elongated members 91*a*-91*c* and the second elongated members 92*a*-92*c* can include a waveform, such as a sinuous waveform. In examples, the waveform can contribute to mechanical elongation of the elongated members in the underband 16. In addition, the properties of the waveform (e.g., amplitude, frequency, etc.) can be configured to impart zonal stretch properties (e.g., to different zones of the underband). For example, larger amplitude and/or higher frequency can increase relative stretch properties.

In at least some examples, the first elongated members 91*a*-91*c* can include an upper segment 93*a* closer to the upper portion 86, a lower segment 93*c* closer to the lower portion 87, and a middle segment 93*b* that is between the upper segment 93*a* and the lower segment 93*c*. The segments 93*a*-93*c* need not have the same lengths or be evenly divided (although they can be). In this disclosure, a segment of an elongated member that includes a waveform can include a portion of the elongated member that includes at least one complete wave extending from one crest to an adjacent crest. In at least some examples, the properties of the waveform in the segments 93*a*-93*c* can vary, which can contribute to zonal stretch properties that are different as between the upper, middle, and lower portions of the underband 16. In addition, the properties of the waveform can vary as between elongated members that are located at different positions along the length of the underband 16. For example, the elongated member 91*c* can be positioned, as compared to the elongated member 91*b*, closer to a center of the front of the support garment and the underband, whereas the elongated member 91*b* can be positioned, as compared to the elongated member 91*a*, closer to one of the ends 90*a* or 90*b*. The elongated member 91*a* can be positioned, as compared to the elongated members 91*b* and 91*c*, closer to one of the ends 90*a* or 90*b*.

In at least some examples, the waveform of one or more of the first elongated members (e.g., extending from the upper portion to the lower portion) can include a lower amplitude in the middle segment 93*b* as compared to the upper section 93*a* and/or the lower section 93*c*. In at least some examples, this lower amplitude can contribute to different or zonal stretch properties in the portion of the underband 16 between the upper portion 86 and the lower portion 87. For example, that middle portion can include lower maximum elongation, less growth or stretch under a given tensile force, and/or higher modulus of elasticity (as it related to elongation). In FIG. 4, the first elongated members 91*b* and 91*c* are examples of a first elongated member that extends from the upper portion to the lower portion and that includes a middle segment 93*b* with a lower amplitude (e.g., the waveform in that segment has a lower amplitude).

In at least some examples, the waveform of the first elongated members can vary at different relative positions along the lengthwise orientation of the underband 16. For example, the first elongated members 91*a*-91*c* can each be arranged at a different relative position around the lengthwise orientation of the underband 16. The first elongated member 91*c* can be positioned closer to a middle of a front side of the upper-torso garment; the first elongated member 91*a* can be positioned closer to a middle of a back side of the upper-torso support garment (e.g., closer to one of the ends 90*a* or 90*b*); and the first elongated member 91*b* can be positionally between the first elongated members 91*a* and 91*c*. In at least some examples, the first elongated member 91*c* can include one or more segments (e.g., in the middle segment) having a smaller amplitude than a corresponding segment of the first elongated members 91*b* and 91*a*. In addition, the first elongated member 91*b* can include one or more segments having a smaller amplitude than a corresponding segment of the first elongated member 91*a*.

In at least some examples, the varied waveform properties as between the different elongated members 91*a*-91*c* can contribute to zonal stretch properties at different positions around the lengthwise orientation of the underband 16. For example, zones that include first elongated members having lower amplitudes (or at least some segments with lower amplitudes) can be associated with lower maximum elongation, less growth under a given tensile force, and/or higher modulus of elasticity (as it related to elongation).

The second elongated members 92*a*-92*c* can continuously and longitudinally extend along the lengthwise orientation 89, and in some examples, can include segments. For example, the segments can be arranged at a different relative position around the lengthwise orientation of the underband 16. In some instances, a first segment 94*a* can be positioned closer to a middle, center, or midline of a front side of the upper-torso garment; a second segment 94*c* can be positioned closer to a middle, center, or midline of a back side of the upper-torso support garment (e.g., closer to one of the ends 90*a* or 90*b*); and a third segment 94*b* can be positionally between the first segment and the second segment.

In at least some examples, the segments 94*a*-94*c* can have varied waveform properties (e.g., amplitude and frequency) relative to one another. For example, along the second elongated member 92*a*, the first segment 94*a* can have different waveform properties than the second segment 94*b*, which can have different waveform properties than the third segment 94*c*. In at least some examples, the varied waveform properties as between the different segments 94*a*-94*c* can contribute to zonal stretch properties at different positions around the lengthwise orientation of the underband 16. For example, zones that include segments having lower amplitude can be associated with less elasticity, lower maximum elongation, less growth under a given tensile force, and/or higher modulus of elasticity (as it related to elongation). In at least some examples, the segment 94*c* can include first waveform having a higher amplitude than a second waveform of the segment 94*b*. In addition, the segment 94*b* can include a waveform having a higher amplitude than the waveform associated with the segment 94*a*. In at least some examples, waveform of the second elongated members 92*a*-92*c* transitions in a stepwise manner across three or more consecutive segments, which can contribute to a gradual transition of stretch properties across zones.

In at least some examples, the bottom portion 87 of the underband 16 can include one or more curved portions (e.g., curved bottom edges), such as elements 98*a* and 98*c* in FIG. 1B. That is, the underband 16 can include a first portion 98*b* that is vertically aligned with the center bridge 5 (or the midline) and that includes, along the bottom portion 87, a concave curvature, which curves into the underband 16. In addition, the bottom portion can include, on either side of the first portion 98*b*, convex portions that curve away from the upper portion 86. In at least some examples, the combination of the concave and convex curvature of the bottom portion 87 can contribute to improved fit for a wearer. For example, the combination of the concave and convex curvature of the bottom portion 87 can contribute to the underband 16 laying flat against the wearer and not puckering outward or gaping.

Referring to FIG. 1B, the center bridge 5 can have various constructions, including a mesh (e.g., the mesh 31) having elongated members that intersect to form a grid of cells. In at least some examples, the center bridge 5 can include a first zone or unit area 5A that is closer to the underband 16 and a second zone or unit area 5B that is farther from the underband (e.g., closer to the neckline 7). In examples, the first zone can include one or more cells that are smaller than cells (e.g., any cells) of the second zone. In at least some instances, the smaller cells in the first zone can contribute to a relatively lower amount of stretch, which can help encapsulate the breast tissue and impede the breast tissue from lateral movement, left to right.

FIGS. 5 through 13 illustrate an exemplary support garment 100, which can be similar to the support garment 10. For example, the support garment 100 can include a mesh textile that is similar to the mesh textile 31 (e.g., the same mesh textile in one or more properties). For example, the support garment 100 can include a mesh textile that includes elongated members that converge with one another at nodes to form a grid of cells. At least some of the detailed description (and in some cases all of the detailed description) that is associated with FIGS. 5 through 13 can also apply to the examples associated with FIGS. 1A through 4, and vice versa.

Though the garment 100 is shown in a laid-flat configuration it should be understood that portions of the garment can be coupled together to form a three-dimensional, wearable garment (e.g., the support garment 10 in FIG. 1A). In some examples, such as shown in FIGS. 5-13, the support garment 100 can be an upper garment worn on a wearer's upper torso, for example, a bra or cropped shirt. In other examples, a mesh textile described in this disclosure can comprise at least a portion of a lower-torso article of apparel, such as, for example, underwear, shorts, leggings, etc. In still other examples, the support garment can be full-torso or full-body garment such as a swimwear garment, leotard, or unitard.

Figure 5:
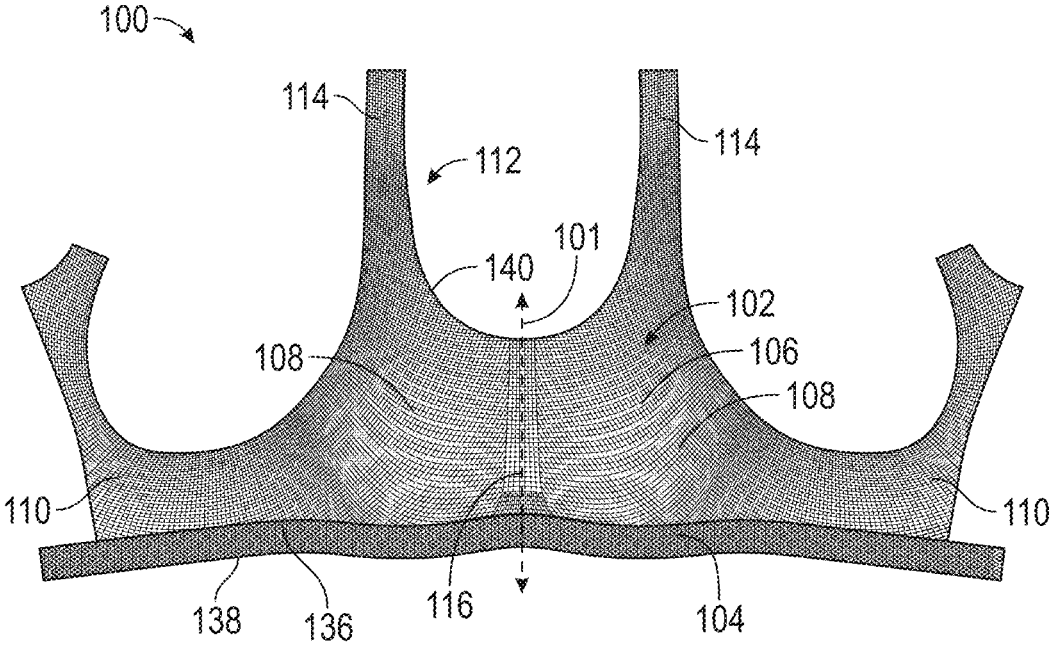
FIG. 5 illustrates a support garment, according to one example, shown in a flattened configuration.

Referring to FIG. 5, the support garment 100 can comprise a main body 102 and a band 104 (also referred to as a "band region" or an underband). The main body 102 can comprise one or more regions, for example, a cup region 106 (e.g., breast-covering portion) comprising one or more cups 108, a back region 110, and a strap region 112 comprising one or more straps 114. In some examples, the cup region 106 can further comprise a center front region 116 disposed between first and second cups 108. The garment 100 is bilaterally symmetrical about median axis 101. The cup regions may or may not include cupped, domal, or other dimensionality in the z-direction In some examples, the garment can be 3D printed allowing the garment to be customized for the wearer's body. The regions of support and stretch can be customized to have a specific amount of support and/or stretch based on the wearer's body and/or preference. For example, a potential wearer can be measured or scanned in-store and the support garment can then be custom printed according to their specific measurements and/or preferences. For example, spacing between elongated members can be increased or decreased in a zone (e.g., in the cup or breast-covering portion) to increase or decrease the size of one or more cells in that zone.

In some examples, one or more portions of the garment 100 (and in some cases all of the garment 100) can comprise a pure material or substance. In some examples, one or more portions of the garment 100 (and in some cases all of the garment 100) can comprise a homogenous material (e.g., a homogenous polymer or other homogenous blend of smaller units). In some instances, the entirety of the garment can include the same homogenous material throughout. In some examples, different portions of the garment can comprise the same material and different densities, moduli of elasticity, hardness (durometer), etc. In some examples, the material (e.g., homogenous material) can comprise a polymer, for example, thermoplastic polyurethane (TPU), for example, TPU-70A, TPU-60A, and/or TPU-85A. In other examples, the material can comprise polyurethane (PU). In some examples, the material is any other elastomer described in this disclosure for the mesh.

In at least some examples, homogeneity of a material composition can be based on one or more analytical techniques, such as spectroscopy or other known techniques.

In at least some examples, homogeneity (e.g., a degree or relative amount of homogeneity) can be determined based on an average measured parameter in n number of regions of interest (ROI) having a standard deviation equal to, or less than, "X" units of the average value. In some examples, a property can be considered substantially homogenous when the standard deviation is 5.0 or less and can be considered highly homogenous when the standard deviation is 1.0 or less. In at least some examples, n can be at least three or more.

Forming the garment to shape from a homogenous material as described above, can advantageously lead to improved sustainability/recyclability due to reduced waste (e.g., there is no cutting of the garment from a larger piece of material). In some examples, the garment itself can be comprised of recycled material and/or can be recycled at the end of the garment's life. In at least some instances, less processing (and thus fewer resources) may be necessitated to recycle a garment constructed of a homogenous material, since parts of the garment may not need to be separated (e.g., cut away) before recycling.

In at least some examples, various structures that can be used to form a support garment can be described as "homogenous" or "substantially homogenous," including elongated members, mesh, seams, and the like. In some examples, those structures can be extruded or cast using a homogenous material composition. In at least some examples, additional materials can be applied to those structures after they are formed (e.g., printing, flocking, or other finishing techniques), and those structures can still be considered to include a homogenous material composition.

The garment can be movable between a relaxed configuration, for example, when not being worn, a stretched configuration, for example, when being put on, and a use configuration (also referred to as a "partially stretched" configuration), for example, when being worn by the wearer. Referring still to FIG. 5, the garment 100 can comprise a mesh material including a plurality of open cells 120 (see e.g., FIG. 9). The mesh material can advantageously provide increased breathability and increased sweat evaporation as well as decreased weight. The shape, orientation, and density of the cells 120 can change depending on the location (i.e., region) in which the cells are disposed in order to provide selected properties (e.g., a desired amount of stretch) in certain regions.

In some examples (see e.g., FIG. 30), when in the relaxed configuration, the smallest of the open cells can have a minimum width of about 1.2 mm to about 2 mm, about 1.3 mm to about 1.9 mm, about 1.4 mm to about 1.8 mm. In some examples, when in the relaxed configuration, the smallest of the open cells can have a minimum height of about 0.8 mm to about 1.4 mm, about 0.9 mm to about 1.3 mm, about 1 mm to about 1.2 mm. In some examples, when in the relaxed configuration, the largest of the open cells can have a minimum width of about 3.0 mm to about 4.0 mm, about 3.2 mm to about 3.8 mm, of about 3.4 mm to about 3.6 mm. In some examples, when in the relaxed configuration, the largest of the open cells can have a minimum height of about 4.6 mm to about 5.6 mm, about 4.8 mm to about 5.4 mm, of about 5.0 mm to about 5.2 mm.

Figure 6:
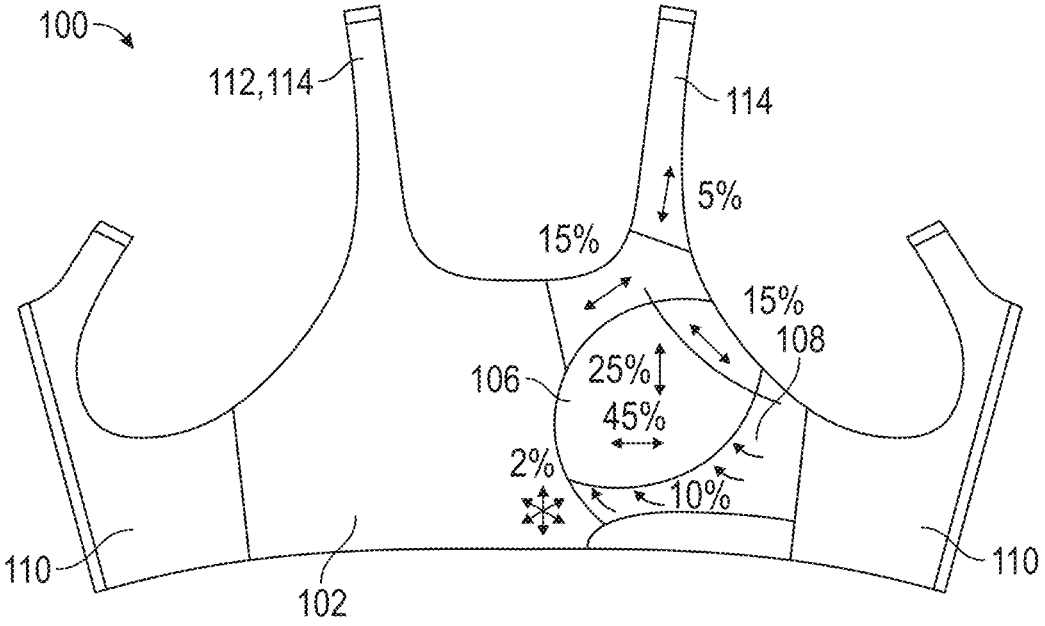
FIG. 6 illustrates a portion of the support garment of FIG. 5, shown schematically to illustrate the amount and direction of stretch.

For example, as shown in FIGS. 6-9, certain regions of the garment 100 can have areas of increased stretch in the vertical and horizontal directions relative to other regions of the garment. FIG. 6 illustrates a general overview of the directions of stretch for specified regions. The percentages refer to the general relative percentage of stretch, with the higher numbers indicating a greater amount of stretch in those regions.

Figure 7:
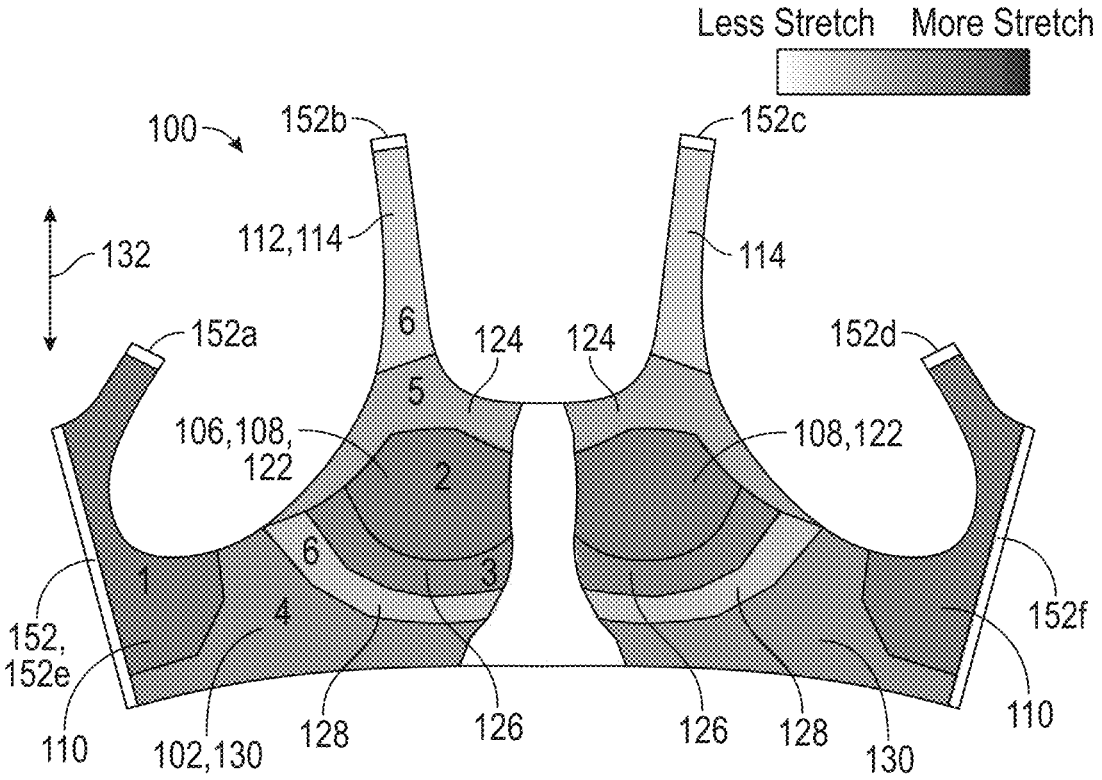
FIG. 7 illustrates a portion of the support garment of FIG. 5 showing a map of the vertical stretch.

Referring to FIG. 7, each cup 108 can have a central cup region 122, an upper cup region 124, a first lower cup region 126, a second lower cup region 128 (also referred to as a 'support region'), and a side region 130. The central cup region 122 can be configured to have more stretch in the vertical and horizontal directions (i.e., a lower modulus of elasticity) than the surrounding regions 112, 124, 126, 128, such that it can stretch/deform to contour to the wearer's breasts. The back 110 and side regions 130 can likewise be configured to have more stretch in the vertical and horizontal directions (i.e., a lower modulus of elasticity) than regions 112, 124, 126, 128, which can advantageously allow the user to deform/stretch the garment when putting it on (e.g., by pulling it over their head) and then allow the garment to contour to the wearer's body during wearing.

Referring to FIG. 7 (which illustrates the relative vertical stretch of each region, the vertical direction being indicated by arrow 132), generally the amount of stretch in the vertical direction (referred to as "vertical stretch") can proceed from greatest amount of vertical stretch to least amount of vertical stretch in the following order (which is indicated using numbers 1-6 in FIG. 3): (1) back region 110, (2) central cup region 122, (3) first lower cup region 126, (4) side region 130, (5) upper cup region 124, and (6) the strap region 112 and second lower cup region 128, which have substantially the same amount of vertical stretch. Stretch can be based on the extent to which a region elongates when subjected to a prescribed tensional force, such that a region that experiences more elongation (e.g., stretches to a longer length) when subjected to the prescribed tensional force has more stretch than a region that experiences less elongation when subjected to the same prescribed tensional force.

Figure 8:
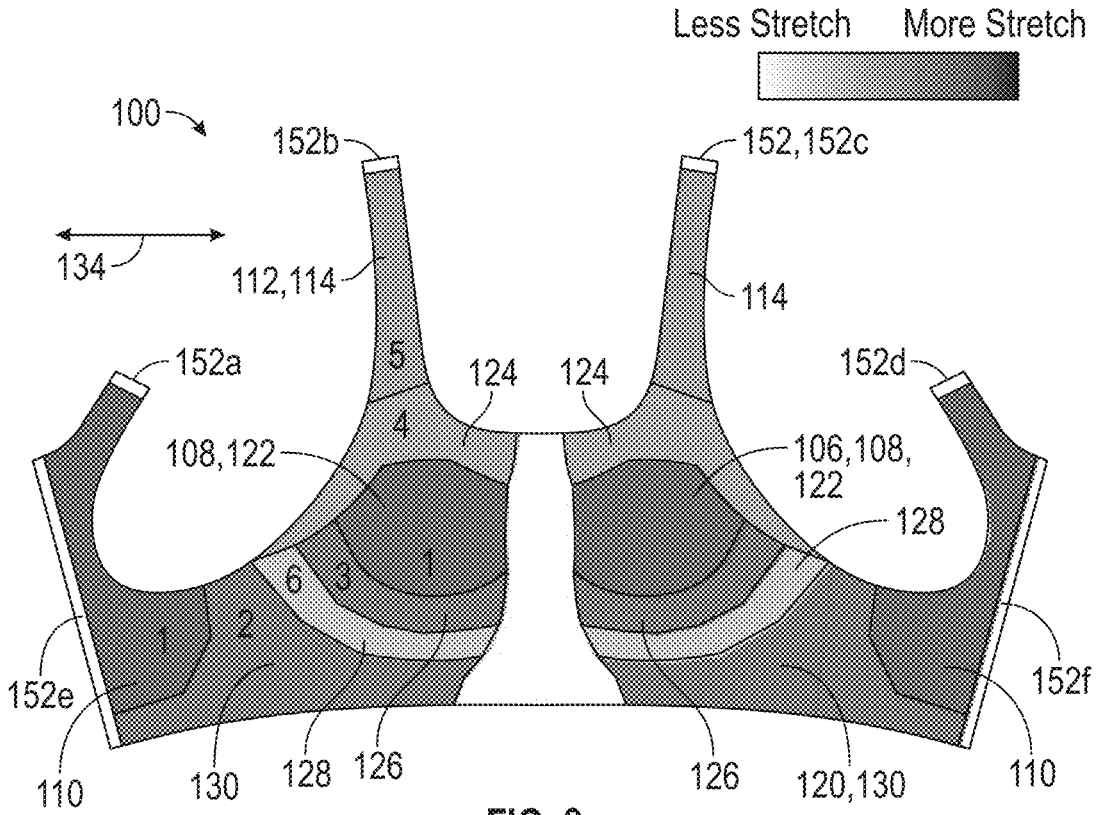
FIG. 8 illustrates a portion of the support garment of FIG. 5 showing a map of the horizontal stretch.

Referring to FIG. 8 (which illustrates the relative horizontal stretch of each region, the horizontal direction being indicated by arrow 134), generally the amount of stretch in the horizontal direction (referred to as "horizontal stretch") can proceed from greatest amount of horizontal stretch to least amount of horizontal stretch in the following order (which is indicated using numbers 1-6 in FIG. 4): (1) back region 110 and central cup region 122, which have substantially the same amount of horizontal stretch, (2) side region 130, (3) first lower cup region 126, (4) upper cup region 124, (5) strap region 112, and (6) second lower cup region 128.

Figure 15:
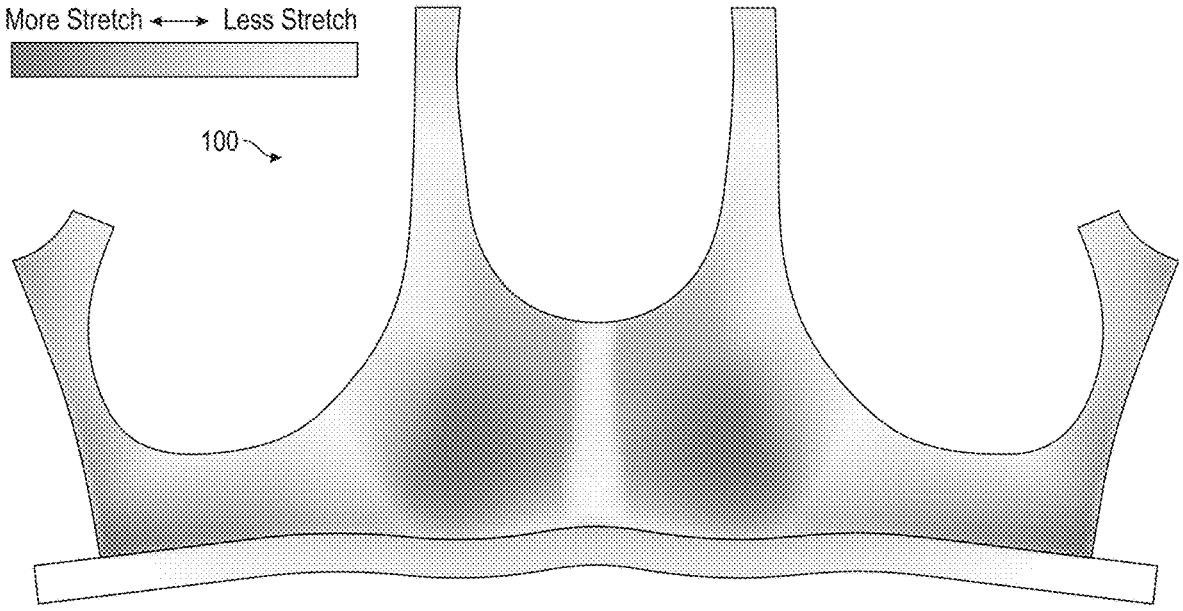
FIG. 15 illustrates a map of the support garment of FIG. 5 illustrating the amount of stretch.

This configuration of vertical and horizontal stretch regions advantageously allows for the most stretch in the cups 108 and back 110, allowing the garment to contour to the wearer's chest. The relatively lesser amount of stretch in the second lower cup region 128 advantageously provides support under the wearer's breast area, which can simulate the supportive feeling of underwire. Likewise, the relatively lesser amount of stretch in the strap region 112 can advantageously provide support for the garment during the wearer's movement. While FIGS. 6-8 do not illustrate the band region 104 or center front region 116, it should be understood that a band region 104 and/or center front region 116 can be incorporated as part of any of the garments described herein. FIG. 15 illustrates the stretch zones of the garment 100 including both the vertical and horizontal stretch.

Referring again to FIG. 5, as mentioned previously, the garment 100 can comprise a band region 104. The band region 104 can be coupled to a bottom edge 136 of the main body 102. The band region 104 can provide high stretch in the vertical and horizontal directions, in order to allow the wearer to the pull the garment on over the head. The band region 104 can further comprise a low modulus of elasticity such that it can easily return to its original shape in order to hold the bottom edge 138 of the garment in place when in the use configuration. In some examples, as described in further detail herein, the band region 104 can comprise an auxetic design configured to allow the band region 104 to avoid vertical collapse (i.e., narrowing) when stretched horizontally. In some examples, the band region 104 can include features of the underband 16, such as those elements described with respect to FIG. 4.

As also mentioned previously, the garment 100 can comprise a center front region 116, disposed between the two cups 108. The center front region 116 can be an elongated strip of cells extending from an upper edge 140 of the main body 102 to the lower edge 136 of the main body. The center front region 116 can be configured to provide little to no stretch. The configuration of the center front region 116 is one example, and in other examples, the center front region can include a different arrangement of elongated members.

Figure 9:
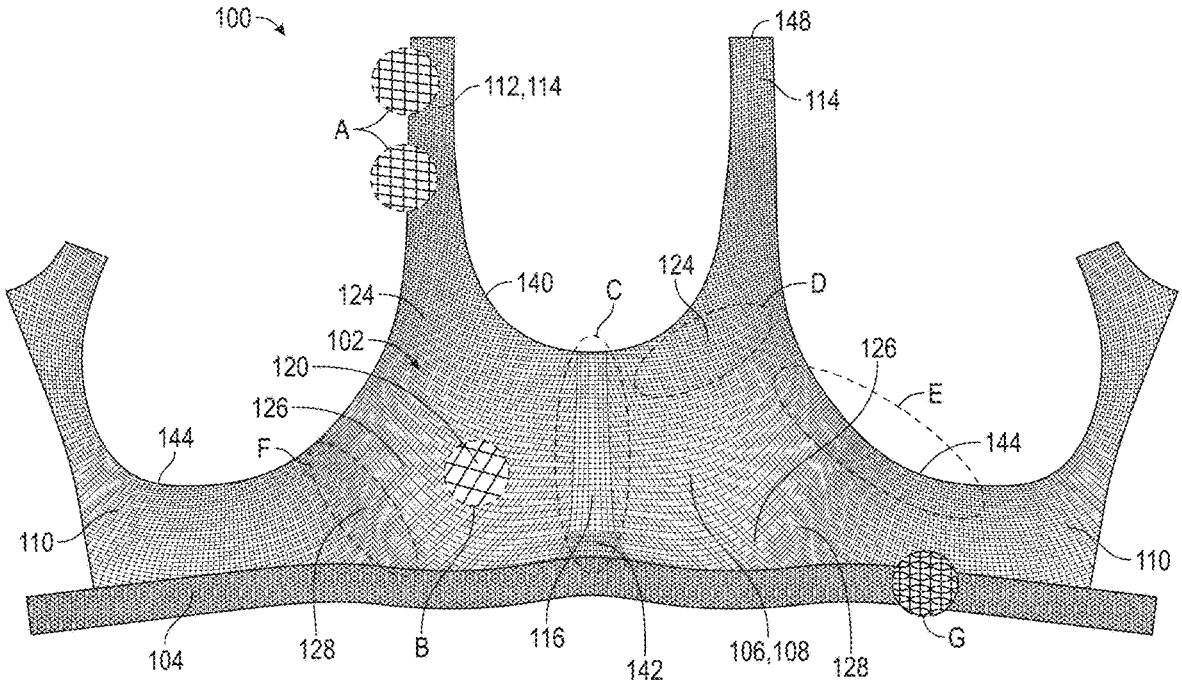
FIG. 9 is another illustration of the support garment of FIG. 5.

Referring FIG. 9, the garment can comprise a plurality of struts (e.g., elongated members) defining a plurality of open cells 120 that make up the garment 100. The cells 120 can be oriented in different directions depending on the desired amount and direction of stretch. For example, the cells 120 of the main body 102 can have a substantially square or rectangular shape (which can also be considered a diamond shape depending on the orientation of the cell relative to the top edge 140 of the main body 102). The "square" orientation, wherein a strut of the cell is aligned with (i.e., substantially parallel to) the uppermost edge 148 of the garment, can provide less stretch, while the "diamond" orientation, wherein an apex of the cell (i.e., the place where two struts meet) is oriented toward the uppermost edge 148 of the garment, can provide more stretch. Cells can be rotationally oriented in any position between square and diamond depending on the desired amount of stretch.

Figure 31:
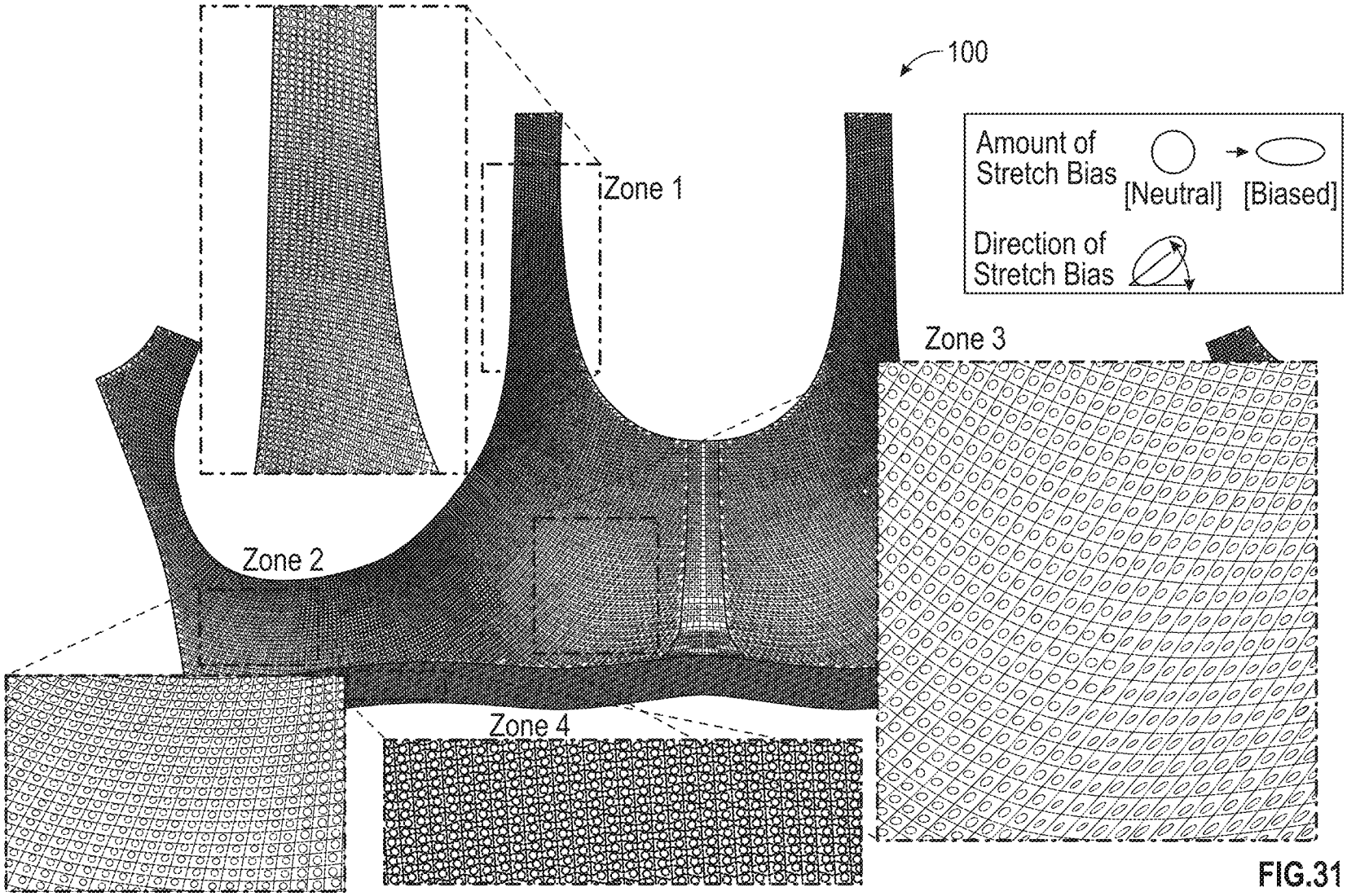
FIG. 31 illustrates the support garment of FIG. 5 illustrating the amount and direction of stretch bias when the garment is in the relaxed configuration.

FIG. 31 shows the garment 100 with the cells 120 shown in an enlarged view for different zones 1-4 corresponding to the strap region 112 (zone 1), the side region 130 (zone 2), the cup region 106 (zone 3), and the band region 104 (zone 4). For purposes of illustration only, the cells 120 in FIG. 31 include a shape (e.g., a circle or oval) disposed within the cell that indicates the amount and direction of stretch for that cell when the garment 100 is in the relaxed configuration. It should be understood that the shapes are for purposes of illustration only and do not exist in the final garment.

As shown in FIG. 31, the cells in zones 1 and 2 are generally neutral when the garment is in the relaxed configuration, while the cells in zone 3 include some stretch bias even when in the relaxed configuration. This configuration allows for increased stretch in zone 3, and increased support in zones 1 and 2.

Call-outs A and B in FIG. 9 illustrate the orientation of the cells in the strap region 112 and cup region 106, respectively. As shown in call-out A, the cells 120 in the strap region 112 are oriented in a "square" direction. As shown in call-out B, the cells 120 in the cup region 106 are oriented in a "diamond" direction, in other words, each cell 120 is on a bias relative to the uppermost edge 148 of the garment. Referring to call-out C, the cells 120 of the center front region 116 can be positioned in a square orientation. As shown, in some examples, the lower portion 142 of the center front region 116 (call-out C) has increased cell density. This can provide additional support (e.g., decreased stretch) at the lower portion 142.

Referring still to FIG. 9, selected areas of the garment can have differing cell densities (i.e., the number of cells per square inch or unit area). Higher cell density can provide additional support by reducing the amount of stretch in selected areas. Areas of greater cell density can have smaller cells in order to provide such density. For example, call-outs D, E, and F in FIG. 5 indicate areas of higher cell density in the upper cup region 124 (call-out D), the underarm region (call-out E), and the second lower cup region 128 (call-out F). Though only one upper cup region 124, underarm region, and second lower cup region 128 are indicated in FIG. 9, it should be understood that since the garment is bilaterally symmetrical the cell density is mirrored on both sides. Less stretch along the underarm region can allow the arm hole 144 to fit snugly against the wearer's body without gapping. Less stretch along the upper cup region 124 can advantageously mitigate upward movement of the wearer's breasts during movement, which can be painful or distracting for the wearer. Less stretch along the second lower cup region can advantageously help lift and support the wearer's breasts during movement.

As mentioned previously, the band region 104 can comprise an auxetic pattern configured to allow the band region 104 to avoid vertical collapse (i.e., narrowing) when stretched horizontally. Auxetic patterns have a negative Poisson's ratio, meaning that when they are stretched they become thicker perpendicularly to the applied force. Call-out G in FIG. 9 shows one example of the band region 104 comprising an auxetic pattern. In some examples, the band region 104 does not include an auxetic pattern. In some examples, the band region 104 can include properties described with respect to the underband in FIG. 4.

Figure 14:
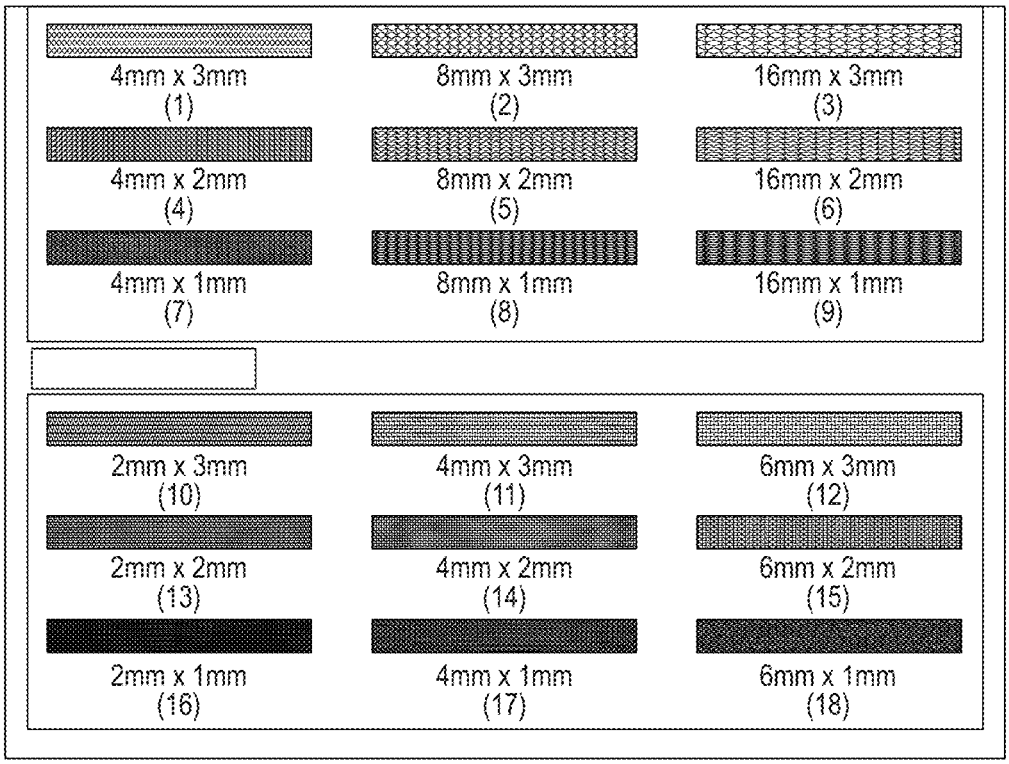
FIG. 14 illustrates various exemplary auxetic patterns.

FIG. 14 illustrates various auxetic patterns numbered (1) through (18). In some examples, the band region 104 can comprise one or more of the auxetic patterns shown in FIG. 14. In other examples, the band region 104 can comprise any other auxetic pattern. Referring to FIG. 14, the dimensions below each pattern refer to the height and width of each cell when the material is in the relaxed configuration. For example, pattern (1) includes cells that are 4 mm high by 3 mm wide when in the relaxed configuration and pattern (14) includes cells that are 4 mm high by 2 mm wide when in the relaxed configuration. Each auxetic pattern can include a plurality of cells arranged such that when they are stretched the cells become thicker perpendicularly to the applied force. For example, pattern (1) includes a plurality of diamond-shaped cells in combination with a variety of bowtie-shaped cells (which can also be referred to as butterfly-shaped), patterns (10) through (18) each include a plurality of bowtie-shaped cells arranged such that the rows are offset from one another to form an interlocking pattern.

Figure 30:
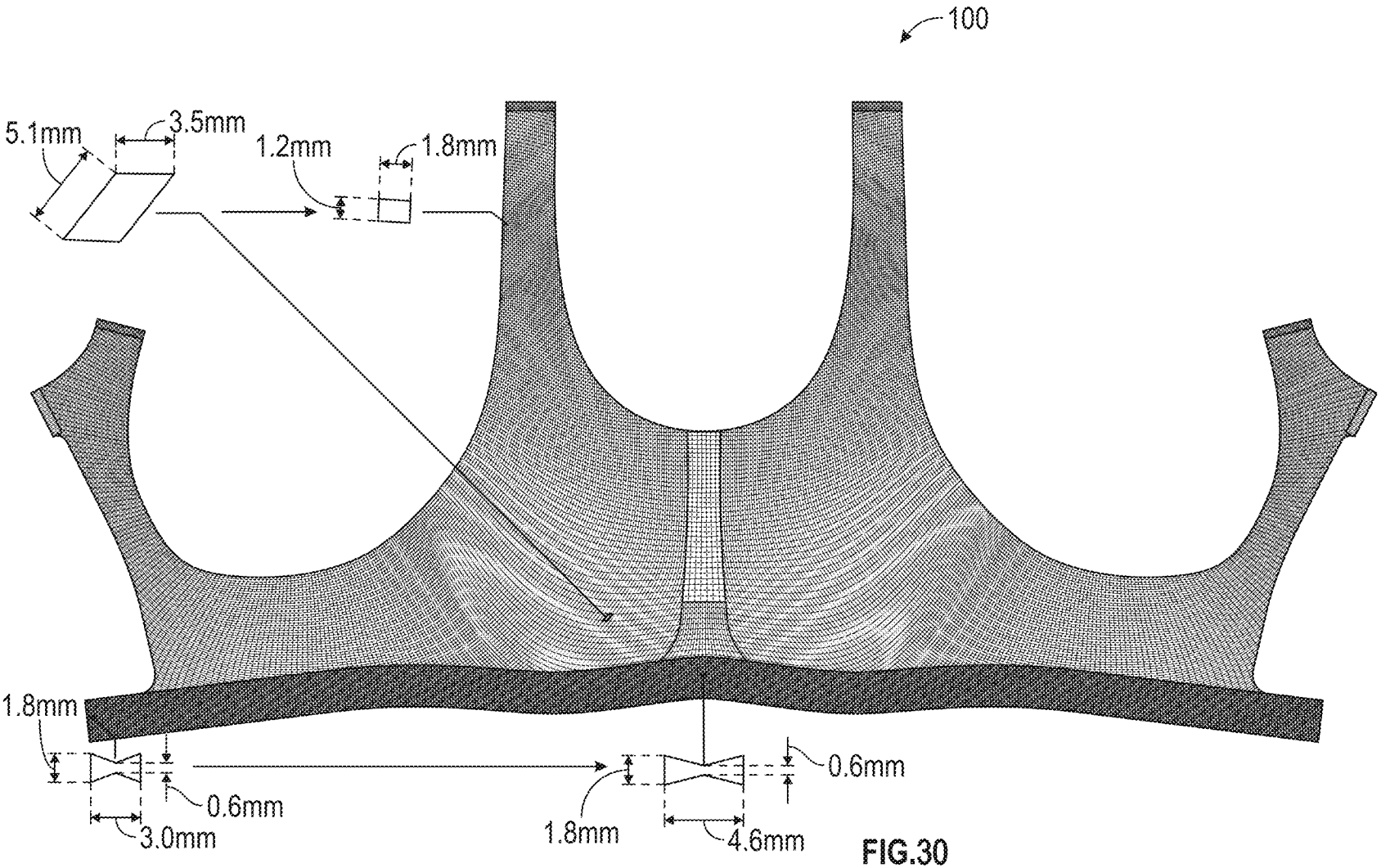
FIG. 30 illustrates the support garment of FIG. 5 showing close-ups of specific cells.

In some examples (e.g., as shown in FIG. 30), the auxetic pattern can include a plurality of bowtie-shaped cells that have a width, a first height at the first and second ends of the cell, and a second height at the center of the cell, which is less than the first height. When in the relaxed configuration, the smallest cells of the auxetic pattern can have a minimum width of between about 2.0 mm to about 4.0 mm, of about 2.5 mm to about 3.5 mm, of about 2.8 mm to about 3.2 mm. When in the relaxed configuration, the smallest cells of the auxetic pattern can have a minimum first height of between about 1.4 mm to about 2.2 mm, of about 1.6 mm to about 2.0 mm, of about 1.7 mm to about 1.9 mm. When in the relaxed configuration, the smallest cells of the auxetic pattern can have a minimum second height of between about 0.2 mm to about 1.0 mm, of about 0.4 mm to about 0.8 mm, of about 0.5 mm to about 0.7 mm.

In some examples (e.g., as shown in FIG. 30), when in the relaxed configuration, the largest cells of the auxetic pattern can have a minimum width of between about 4.2 mm to about 5.0 mm, of about 4.4 mm to about 4.8 mm, of about 4.5 mm to about 4.7 mm. When in the relaxed configuration, the largest cells of the auxetic pattern can have a minimum first height of between about 1.4 mm to about 2.2 mm, of about 1.6 mm to about 2.0 mm, of about 1.7 mm to about 1.9 mm. When in the relaxed configuration, the largest cells of the auxetic pattern can have a minimum second height of between about 0.2 mm to about 1.0 mm, of about 0.4 mm to about 0.8 mm, of about 0.5 mm to about 0.7 mm.

Figure 10:
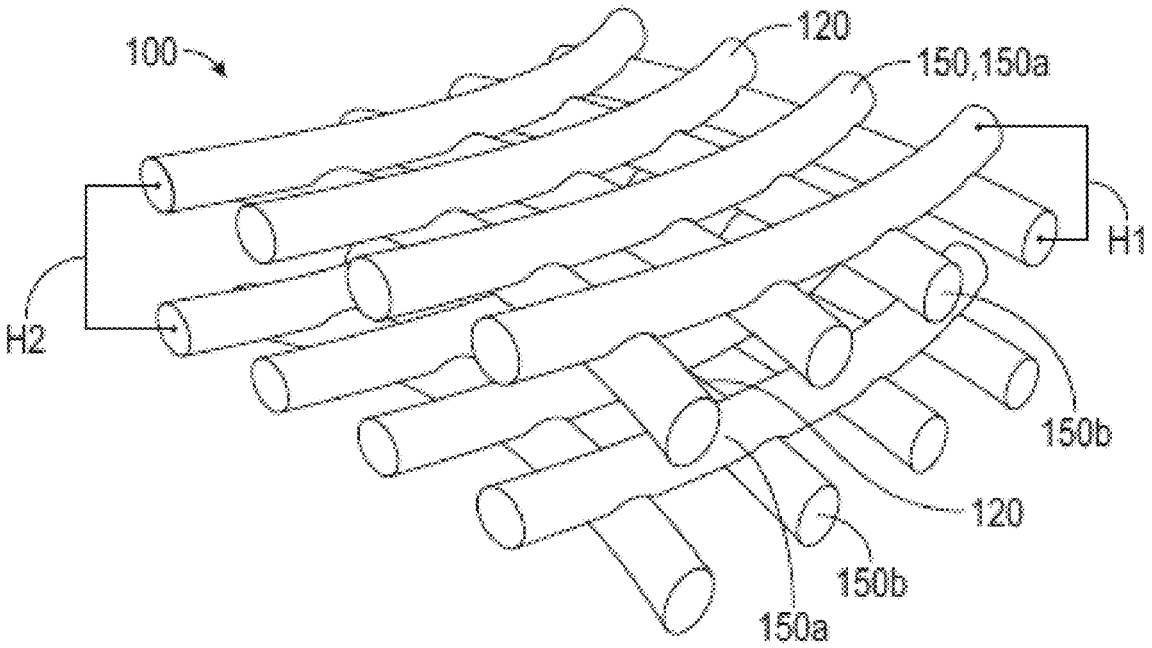
FIG. 10 is an enlarged partial cross-sectional view of the material of the support garment of FIG. 5.

Referring now to FIG. 10, in some examples, the garment can comprise a plurality of filament layers 150. In some examples, the plurality of filament layers can include one or more elements (e.g., all of the elements) described with respect to the mesh 40 (e.g., FIG. 2A). In addition, the mesh 40 can include one or more of the features described with respect to the layers 150. The layers 150 can be arranged on top of one another such that the filaments of a first layer 150*a* extend in a different direction than the filaments of an adjacent second layer 150*b*. In the illustrated example, the garment 100 includes four filament layers 150 which include two first layers 150*a* extending in a first direction (e.g., the elongated members are axially aligned) and two second layers 150*b* extending in a second direction different than the first direction (e.g., the elongated members in the second direction are also axially aligned). However, in other examples, the garment can comprise a greater or fewer number of filament layers, for example, one, two, three, five, six, seven, eight, nine, or ten layers. Additional filament layers can be added to the garment to, for example, provide additional stretch and/or support in selected areas, or provide increased durability in selected areas. In some examples, the different filament layers can comprise different materials, which can be used to achieve different properties for the garment.

The first and second layers 150*a*, 150*b* can be disposed in an alternating pattern. The distance between a center point (axial centerline) of each first filament layer 150*a* and a center point of each adjacent second filament layer 150*b* can be referred to as H1. In some examples, H1 can be about 0.1 mm (e.g., in a range of about 0.75 to about 1.25 mm). The distance between a center point of two adjacent first filament layers 150*a* and two adjacent second filament layers 150*b* can be referred to as H2. In some examples, H2 can be about 0.15 mm. Together, the filament layers 150*a*, 150*b* define the plurality of cells 120. In at least some examples, the overall thickness of the filament layers (e.g., between an innermost face and an outermost face) can be in a range between about 0.40 mm and 0.55 mm.

Figure 12:
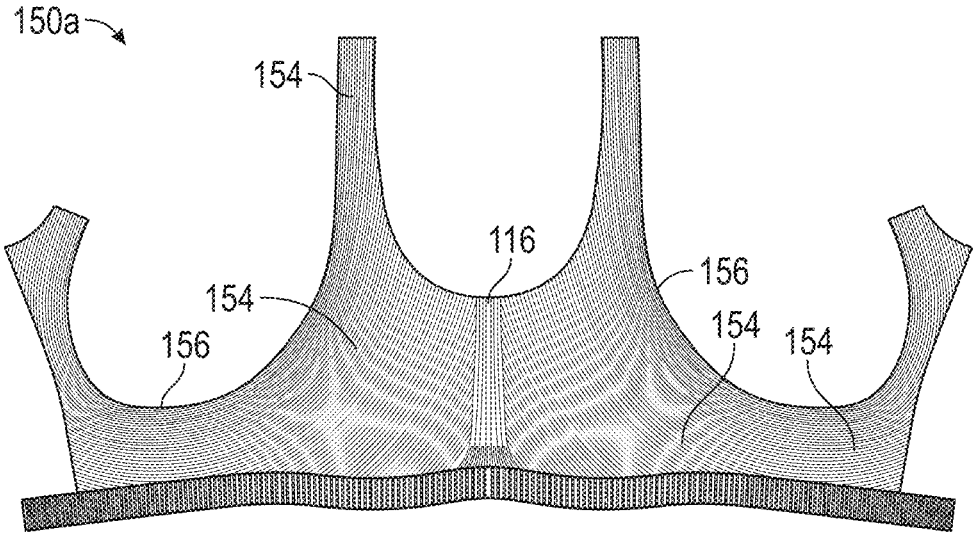
FIG. 12 illustrates the first and third layers of the support garment of FIG. 5.
Figure 13:
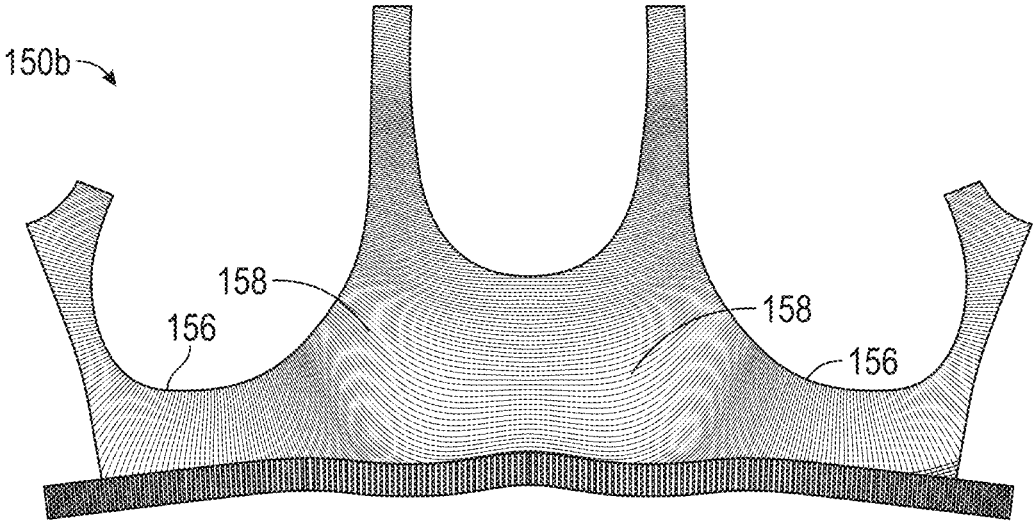
FIG. 13 illustrates the second and fourth layers of the support garment of FIG. 5.

FIG. 12 illustrates the garment 100 showing only the first filament layers 150*a*, which, in a garment having four layers can be, for example, the first and third layers. In some examples, the elements and description associated with FIG. 12 can equally apply to the elements and description of FIG. 1D, and vice versa. FIG. 13 illustrates the garment 100 showing only the second filament layers 150*b*, which, in a garment having four layers can be, for example, the second and fourth layers. In some examples, the elements and description associated with FIG. 13 can equally apply to the elements and description of FIGS. 1E and 1F, and vice versa. As shown in FIGS. 12-13, the filaments 150*a* extend in a different direction than the filaments 150*b* such that when they formed together they define the plurality of cells 120.

For example, referring to FIG. 12, the first filament layers 150*a* (aside from the center front region 116) can comprise a plurality of first filaments 154 that mimic the curvature of the armholes 156 of the garment and radiate from the armholes 156 of the garment toward the center front region 116. Referring to FIG. 13, the second filament layers 150*b* can comprise a plurality of second filaments 158 that extend from the armholes 156 of the garment in a radial ray pattern.

Figure 11A:
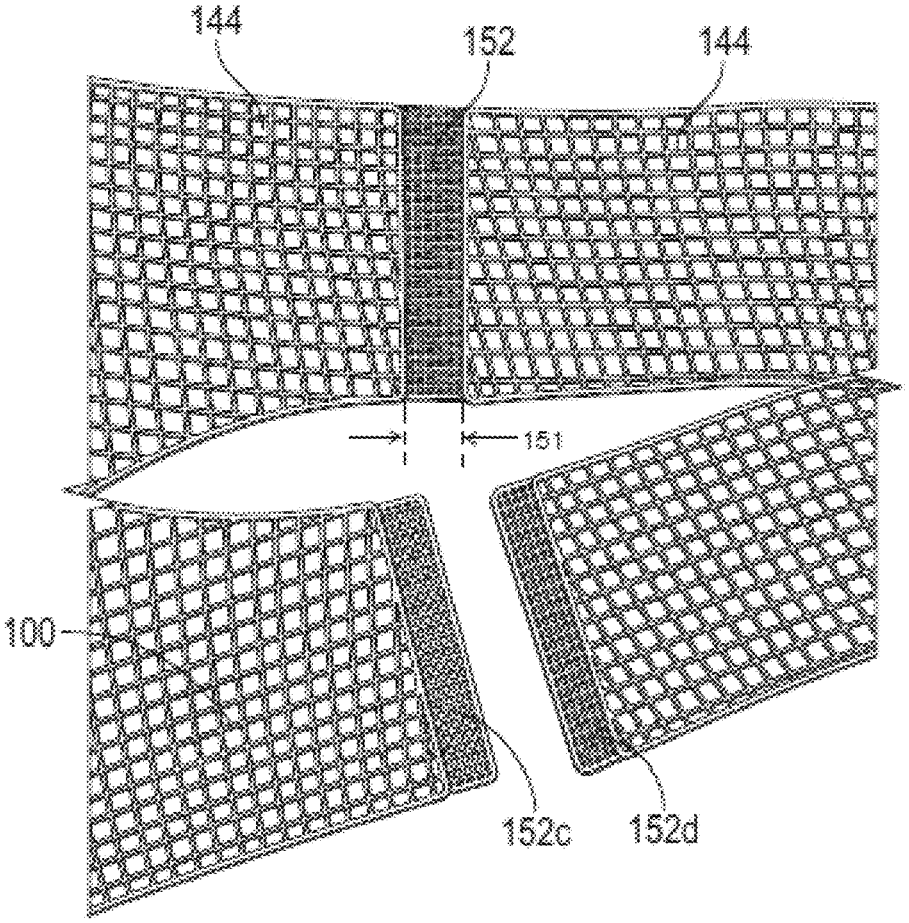
FIG. 11A is a partial view of the strap region of the support garment of FIG. 5.

Referring to FIG. 11A, the garment 100 can further comprise a plurality of coupling portions 152 (also referred to as "seam allowances") that are used to couple portions of the garment (e.g., material panels) together to form the garment into a three-dimensional structure. The garment 10 can include similar coupling portions that can be used to join portions of the mesh textile (e.g., material panels) when constructing a 3D garment from a 2D textile pattern piece. The description of FIG. 11A and the coupling portions 152 can equally apply to the support garment 10.

As shown in FIG. 11A, the coupling portions 152 can be an extension of the pattern or the mesh textile, that is, they can be formed using the filament layers 150 or as part of the same casting. As such, the coupling portions 152 (or parts thereof) can be a unitary structure with the other parts of the mesh or filament layers 150 (e.g., continuous and unitary with the material panel formed by the mesh or filament layers). In examples, the coupling portions 152 can include one or more properties that are similar (e.g., the same) and can also include one or more properties that are different (e.g., different from the material panels).

In at least some examples, the coupling portions 152 and the mesh (e.g., material panels) can include a homogenous material composition, which in some cases can arise at least partially from the structures being unitary with one another and formed as part of the same process (e.g., extrusion, cast, etc.). For example, both the material panels (e.g., the mesh panels) and the coupling portions 152 can include TPU, silicone, or another elastomer.

The coupling portions 152 and the mesh textile can include various differences. For instance, in at least some examples, the coupling portions 152 can have a thickness between the first side and the second side that is less than the thickness of the filament layers 150 or the mesh. For example, the thickness of the coupling portions can be about half the thickness of the totality of the filament layers or the mesh. As such, when the coupling portions are overlapped for joining (e.g., in a lap joint manner), the thickness of the joint or seam will be similar to the thickness of the filament layers 150 and the mesh (e.g., similar to the two material-panel portions that are joined). In some examples, the thickness is substantially constant, such that the thickness of the seam is within at least +/−15% of the thickness of the material panel, or in some examples within at least +/−10% of the thickness of the material panel(s), or in some examples within at least +/−5% of the thickness of the material panel(s). For example, if the material panel(s) include(s) a thickness of about 0.50 mm, then the seam having a substantially constant thickness can have a thickness that is within at least +/−15% of 0.50 mm. In examples, the substantially constant thickness can contribute to a "seamless" feel and reduced likelihood of chaffing or skin irritation.

In some examples in which both the mesh and the coupling portions are constructed of filament layers or extruded layers (e.g., extruded elongated members), the coupling portions 152 can include about half the number of layers as the mesh. For example, if the mesh includes four filament layers then the coupling portions can include fewer filament layers (e.g., 1, 2, or 3 filament layers). The coupling portions 152 can, in some examples, include different cell properties, such as smaller cells, higher cell density, cells with higher aspect ratio, or any combination thereof. In at least some cases, the cell properties of the coupling portions 152 can contribute to better bonding as between the overlapped coupling portions, such as where increased cell density and/or smaller cell size provides more surface area for bonding (e.g., thermal bonding by heating and pressing overlapped coupling portions 152).

Exemplary locations for the coupling portions 152 are shown in FIGS. 7 and 8. As shown, in some examples, the garment 100 can comprise six coupling portions 152. Coupling portions 152*a*, 152*d*, 152*e*, and 152*f* can extend from the back region 110, and coupling portions 152*b* and 152*c* can extend from the straps 114 respectively. Coupling portion 152*a* can be configured to be coupled to coupling portion 152*b*, coupling portion 152*c* can be configured to be coupled to coupling portion 152*d*, and coupling portion 152*e* can be configured to be coupled to coupling portion 152*f*. In some examples, the support garment 10 or 100 can include the coupling portions 152*a*, 152*b*, 152*c*, and 152*d*. In examples, any material-panel portion can include a coupling portion that can be used to join the material-panel portion to another material-panel portion, which can also include a respective coupling portion.

Figure 11B:
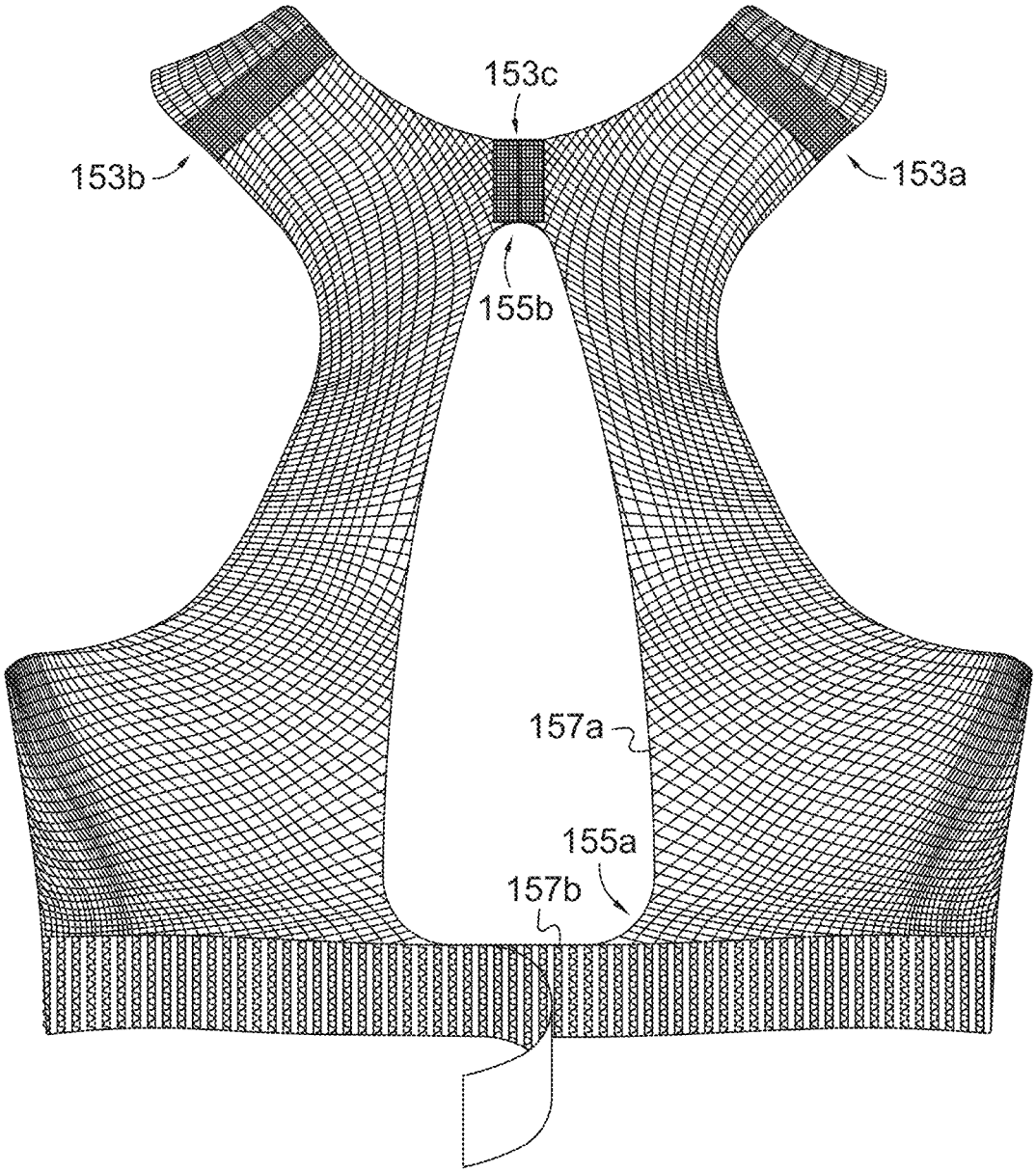
FIG. 11B is a view of the back of a support garment.

In at least one example, and referring to FIG. 11B, a back portion is illustrated that can be associated with the garment 10 or the garment 110. In examples, at position 153*a*, the coupling portion 152*a* is coupled to the coupling portion 152*b*. In addition, at position 153*b*, the coupling portion 152*c* is coupled to the coupling portion 152*d*. Furthermore, at position 153*c*, the coupling portion 152*e* is coupled to the coupling portion 152*f*, and in the example of FIG. 11B, a size of the coupling portions 152*e* and 152*f* has been modified (as compared to the example in FIGS. 7 and 8) to create an open back structure.

The coupling portions 152 can be coupled to one another using any known method. For example, the coupling portions 152 can be ultrasonically welded, fused together using a heat press, sewn together, and/or joined together using fasteners (e.g., buttons, hook and eye closures, snaps, etc.). In at least some instances, a first coupling portion (e.g., 152*a*) is overlapped with a second coupling portion (e.g., 152*b*) to form a lap joint, and the two overlapped coupling portions are thermally joined (e.g., by heating the material to a softening point, pressing the coupling portions together, and cooling the overlapped coupling portions). In examples, the thickness of the seams (e.g., at positions 153*a*, 153*b*, and 153*c*) as between the front side and the back side can be similar to (e.g., substantially constant with) the thickness of the mesh, based on the thickness of the coupling portions (prior to joining) being less than (e.g., about half) of the mesh. In addition, once coupling portions are joined, the outer sides or faces of the resulting panel can include a relatively constant outermost height in the z-direction as the panel extends from a first mesh portion, across the seam, and into a second mesh portion. Stated differently, a height of the resulting panel in the seam can be relatively constant with a height of the panel in the mesh portions.

In some examples, the seams (e.g., the bonded coupling portions 152) can include different material properties as compared to the mesh textile. For example, the seams can include a higher basis weight (e.g., based on the joining of coupling portions having higher cell densities). In some examples, the seams can include lower stretch properties as compared to the mesh textile (e.g., the seams stretch by smaller amount as compared to the mesh textile when under a same load and/or the seams have a higher modulus of elasticity). In some examples, the seams can include a higher tear strength as compared to the mesh textile (the material panels).

In at least some examples, a seam can include portions of the homogenous material composition in broad, flat material band, which can include a "film form" or a "film-like form." For example, when the coupling portions are heated and pressed structures of the coupling portions (e.g., elongated members) can be flattened, and sometimes combined, into a broad, flat band-like structure. As such, the outer surfaces of the seam can be broader and flatter (e.g., similar to a broad, flat band of material), as compared to the mesh structure in the material portions that have been joined. While in some cases the elongated members can still be discernible to some degree in the seam, the individual elongated members might be less discrete on account of being heated, pressed, and joined into other elongated members. In examples, the broad, flat band structure can having a thickness between the first side (e.g., outermost face) and the second side (e.g., innermost face) that is substantially constant with the material panels joined by the seam.

In at least some examples, the seam (e.g., bonded coupling portions 152 in FIG. 11A) can include a width (e.g., see reference lines indicating the width 151 in FIG. 11A) that extends between a first interface between the seam 152 and the first material panel and a second interface between the seam 152 and the second material panel. The seam can have various widths, and within the same support garment multiple seams can have different widths (e.g., depending on a location and/or a size of the joined material panels). In some examples, the width is in a range of about 5 mm to about 10 mm, or about 6 mm to about 9 mm, or about 7 mm. The width of the seam, in contrast to some conventional seams, is relatively small, but the seam provides a more robust connection with improved tear stretch and a low profile.

In at least some examples, an edge of the mesh textile can include a curved profile, which can reduce the likelihood of ripping or tearing, and in turn increases the tear strength along the edge. For example, arrows 155*a* and 155*b* indicate segments of the edge (curved transition segments 155*a* and 155*b*) of the mesh textile that curvedly transition between parts. In examples, curved transition segments can transition between a first edge segment and a second edge segment that meet at the curved transition segments. In at least some examples, at least one of the first edge segments can include a portion of a seam, and as such, the increased tear strength along the curved transition segment advantageously reduces the likelihood of tearing, which could otherwise be increased based on the seam having an increased tear strength and less stretch. That is, since the seam can have an increased tear strength and less stretch, tensional forces might be distributed more to the mesh portions adjacent to the seam, so the curved transitions can help reduce the likelihood of tearing due to the increased tensional forces.

In at least some instances the first edge segment and the second edge segment can, when laid flat, form an angle that is equal to or less than 90 degrees. For example, the curved transition segment 155*a* transitions between a first edge segment 157*a* and a second edge segment 157*b*, and the first edge segment 157*a* and the second edge segment 157*b* (if extended) would form an angle (intersect at an angle) that is equal to or less than 90 degrees. The curved transition segments can include various radii. In example, the radii can be in a range between about 0.375" and 0.500".

In some examples, the garment 100 can be formed using a 3D printer to print the filament layers 150 one on top of the other. In such examples, the garment 100 can be printed as a two-dimensional unitary or continuous garment, which can then be assembled into a three-dimensional garment using the coupling portions 152. In other examples, the garment 100 can be formed using molding. In some instances, the garment 100 or 10 can be formed of multiple, discrete panels (e.g., 3D printed or cast panels) that are joined (e.g., such as by overlapping and thermally bonding the coupling portions).

Figure 32:
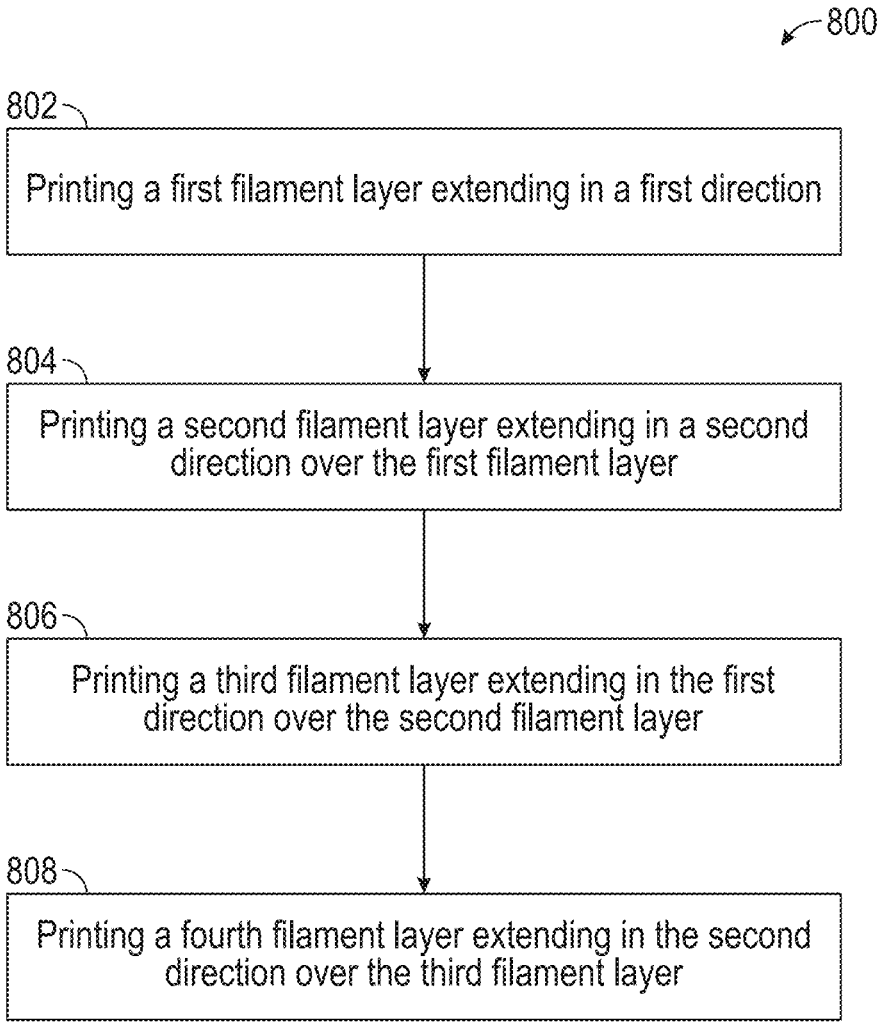
FIG. 32 is a flow chart depicting an exemplary method of making a support garment.

An exemplary method 800 of forming the garment 100 is shown in FIG. 32 and can proceed as follows. At 802, a first filament layer 150*a* can be printed extending in a first direction. At 804, a second filament layer 150*b* can be printed extending in a second direction over the first filament layer. The second filament layer 150*b* can overlap the first filament layer 150*a* at a plurality of first overlap points. At 806, a third filament layer 150*a* can be printed extending in the first direction over the second filament layer 150*b*. The third filament layer can overlap the second filament layer at a plurality of second overlap points. At 808, a fourth filament layer 150*b* can be printed extending in the second direction over the third filament layer 150*a*. The fourth filament layer 150*b* can overlap the third filament layer 150*a* at a plurality of third overlap points.

In some examples, the garment 100 as previously described can comprise one or more additional layers. In some examples, the additional layers can be additional layers of printed material, which are oriented in such a manner to create areas of increased modesty. For example, multiple layers can be printed on top of one another in a 'cross-hatched' configuration to create areas of increased opacity, e.g., in the cup region to provide increased modesty.

Figure 16A:
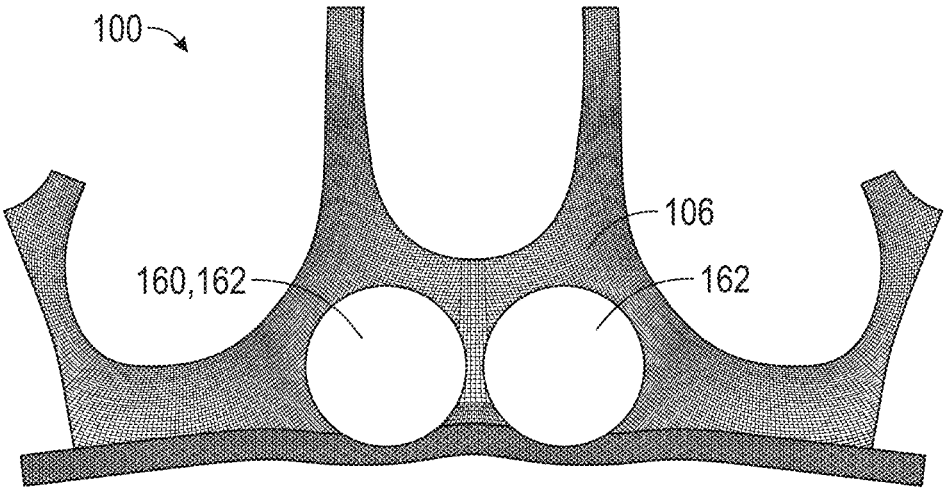
FIG. 16A illustrates another example of a support garment (e.g., with a multi-layer construction in the breast covering portion), shown in a flattened configuration.
Figure 17:
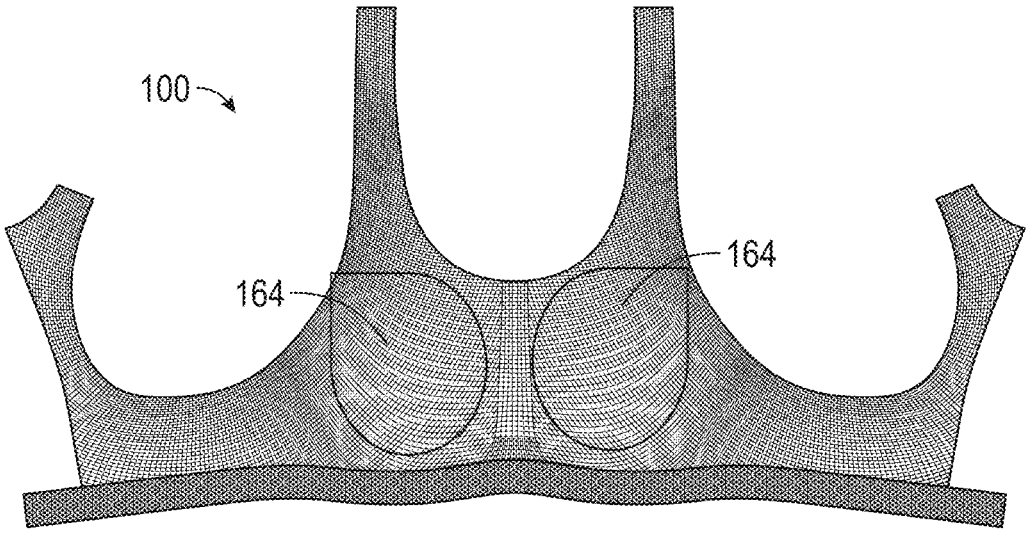
FIG. 17 illustrates another example of a support garment, shown in a flattened configuration.

In other examples, additional layers can be fabric layers 160. The fabric layer(s) 160 can extend over the entire area of the garment 100, or they can be disposed in specific regions, e.g., for modesty and/or to prevent chafing. For example, FIG. 16A illustrates a garment 100 including a fabric layer 160 that comprises two modesty regions 162. In some examples, the fabric layer 160 can comprise a knit material that can be bonded, stitched, and/or adhered to the cup region 106 or to each specific cup 108. FIG. 16A shows two separate modesty regions 162, one on the left and one on the right. In some examples, each modesty region can include a separate fabric or textile piece, which are discontinuous with one another (e.g., the fabric/textile pieces may be omitted from the center bridge). In some instances a single textile panel can continuously extend from one modesty region 162 to the other modesty region 162. In some examples, a plurality of textile panels can extend from one modesty region 162 to the other modesty region 162.

Figure 16B:
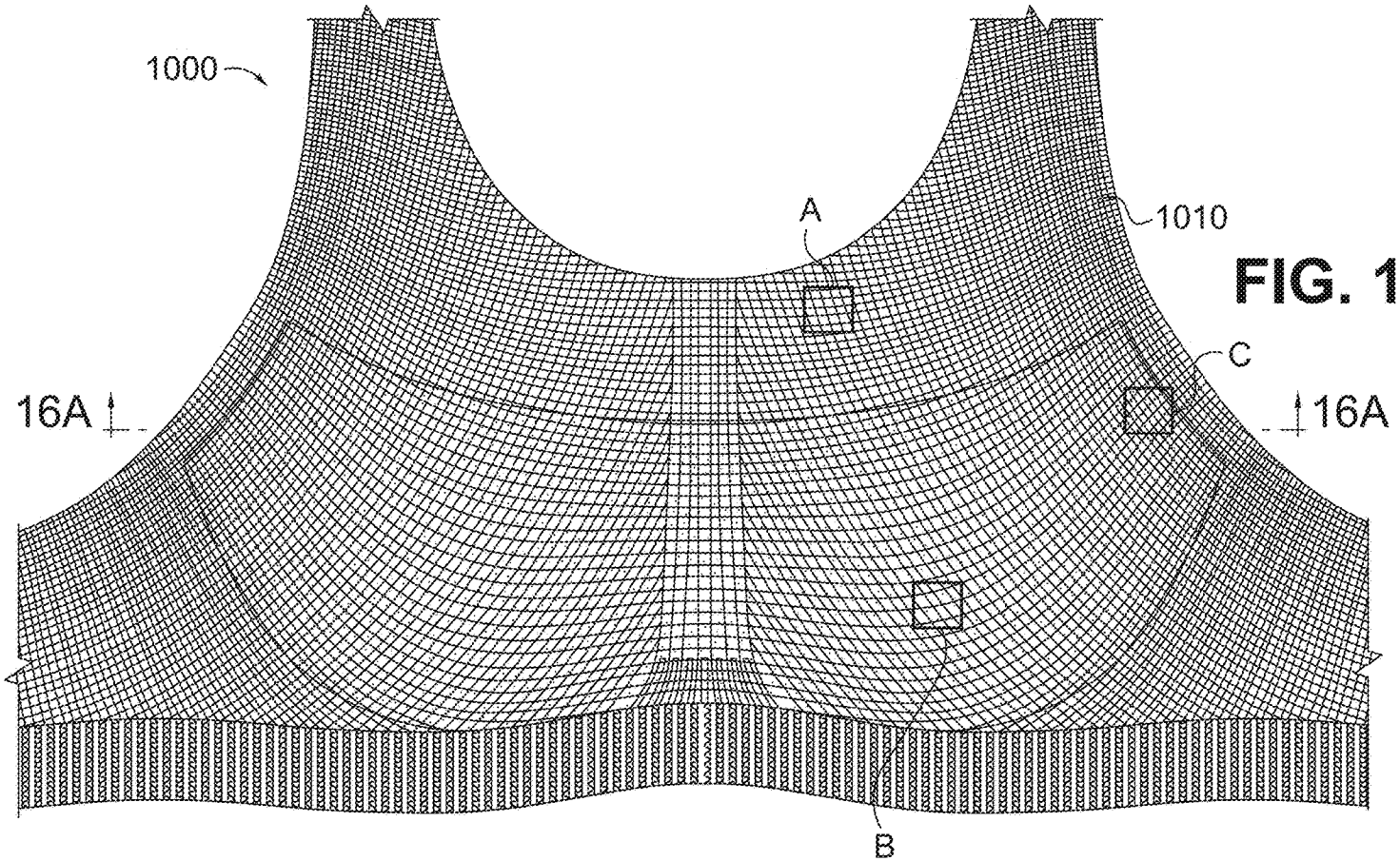
FIG. 16B illustrates another example of a front portion of a support garment with a multi-layer construction, based on an example of the present disclosure.
Figure 16D:
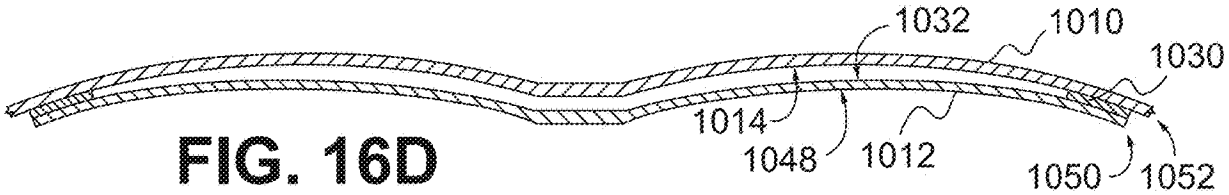
FIG. 16D illustrates a cross-section taken along the reference line in FIG. 16B.
Figure 16C:
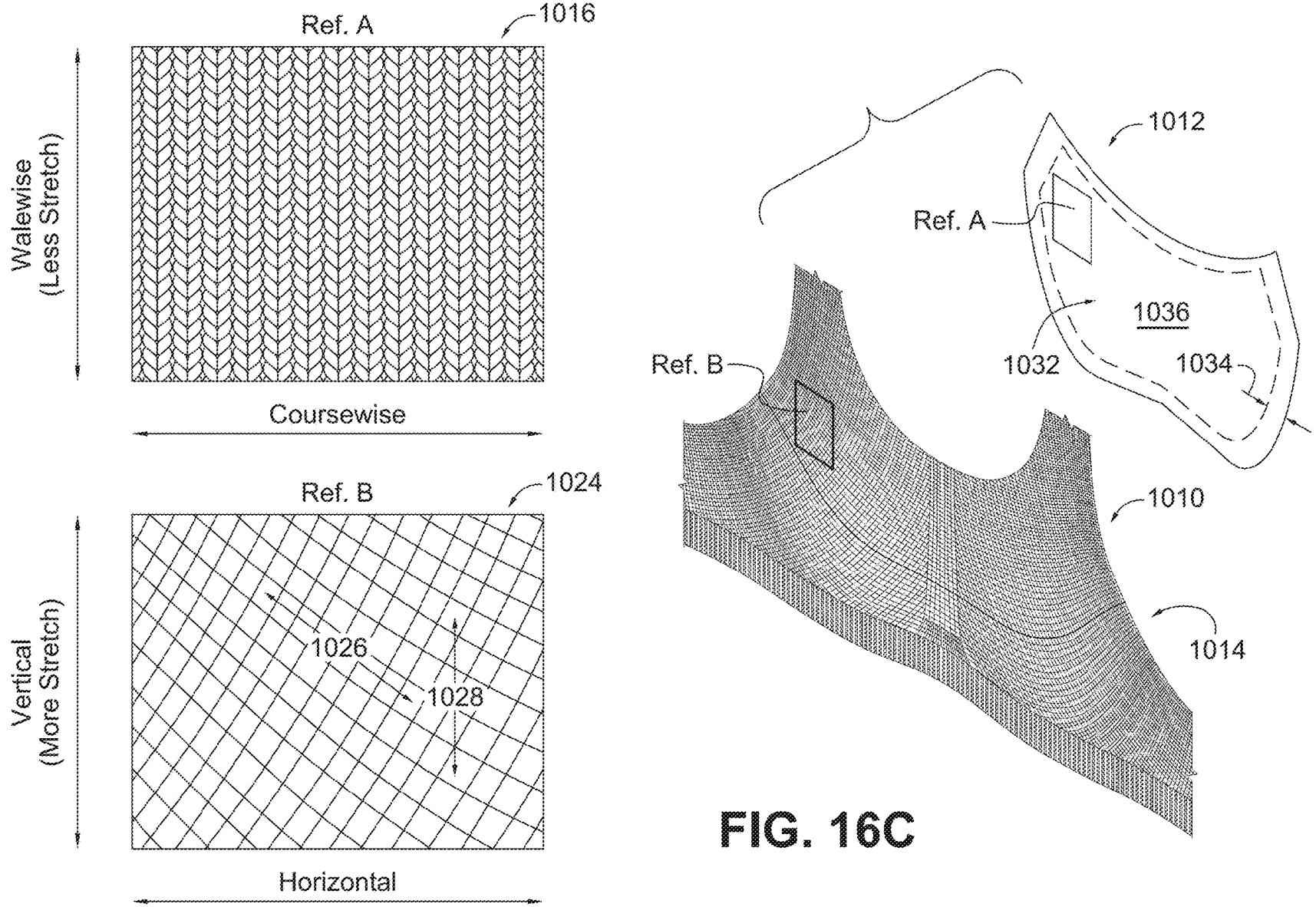
FIG. 16C illustrates a deconstructed view of the front portion of FIG. 16C.

Referring to FIGS. 16B to 16D another support garment 1000 is illustrated based on another example of the present disclosure. In examples, the support garment 1000 can include a multi-layer construction, including two or more layers of textiles in a stacked arrangement (e.g., see FIG.

16C showing an exploded view). For example, the support garment 1000 can include a mesh textile 1010 (e.g., material panel) and one or more additional textiles (e.g., textile 1012). The one or more additional textiles can be affixed to an inner side and/or an outer side of the mesh textile 1010. In at least one example, the second textile 1012 is arranged adjacent the inner facing side 1014 of the mesh textile 1010. The one or more additional textiles can impart one or more various properties, such as modesty in the breast-covering portions, tailored stretch properties, moisture management (e.g., wicking), handfeel, thermal management, and the like. In addition, the one or more additional textiles can include one or more various kinds of textiles, such as knit, woven, nonwoven, films, braided, etc.

In examples, the mesh textile 1010 can include any combination of properties described with respect to the mesh(es) in FIGS. 1A through 15. For example, the mesh textile 1010 can include elongated unitary members that converge with one another at nodes to form a grid of cells. The mesh textile 1010 can be formed by 3D printing elongated extrudates (e.g., filaments) or by casting the mesh textile. In some examples, the grid of cells can include unit areas A, B, and C in different parts of the support garment 1000, and in some instances, those unit areas A, B, and C can include similar features to those unit areas described with respect to FIG. 1C. For example, the unit areas A, B, and C can include properties that different from one another in one or more respects, such as cell size, cell density, elongated member size, elongated member shape (e.g., waveform or cross-sectional shape), elongated member orientation, and the like. These differences can also include differences in material properties, such as stretch properties, breathability, absorption, and the like.

In at least some examples, the second textile 1012 can include a knit textile (e.g., 1016 in Ref. A in FIG. 16C). For example, the second textile can include a double-knit or a spacer-knit textile. The knit textile can include various basis weights, and in some examples, the knit textile can include a basis weight in a range of about 150 gsm to about 300 gsm, or about 170 gsm to about 250 gsm. In some examples, the knit textile can include a double-knit textile having a basis weigh of about 170 gsm. In some examples, the knit textile can include a spacer knit textile having a basis weight of about 250 gsm.

The knit textile 1016 can include yarns of various types of material compositions. For example, the yarn can include natural fibers or synthetic. Natural fibers can include cotton, wool, and the like. Synthetic fibers can include various polymers, such as polyamides or polyester. In some examples, the knit textile can include elastic yarns, such as yarns with spandex or elastane. In some examples, the yarns can include recycled fibers, such as fibers that include recycled PET.

In at least some examples, the knit textile can include a weft knit textile having knit stitches arranged in a series of courses and a series of wales. In at least some examples, the courses and wales can be arranged relative to the mesh 1010 to yield desired stretch properties. For example, referring to Ref. A in FIG. 16C, the enlarged view depicts the knit textile 1016 having a series of courses and wales, and Ref. A is also labeled to indicate a walewise orientation (an orientation in which each wale generally longitudinally extends) and a coursewise orientation (an orientation in which each course generally longitudinally extends). In addition, Ref. B of FIG. 16C includes the enlarged view depicting the mesh textile 1024 with orientation of the elongated members.

In at least some examples, the knit textile 1016 includes anisotropic stretch properties and can be less stretchy (e.g., stretch to a lesser relative extent based on a given load) in a direction that is aligned with the wales and can be stretchier (e.g., stretch to a greater relative extent based on the given load) in a direction that is aligned with the courses. In addition, the mesh textile 1024 (e.g., part of 1010) can also include anisotropic stretch properties and can generally be less stretchy along an orientation (e.g., see reference numeral 1026) that is aligned with the longitudinal orientation of the elongated members and is generally stretchier in a direction that extends diagonally across the cells (e.g., see reference numeral 1028).

In at least some examples, the mesh textile 1010/1024 and the knit textile 1016 can be arranged such that the anisotropic stretch properties are aligned in different orientations (e.g., the lower stretch orientations of each layer are misaligned). For example, in some instances the mesh textile 1010/1024 and the knit textile 1016 can be arranged such that the wales of the knit textile 1016 are oriented in a direction that does not align with the longitudinal orientation of the elongated members (e.g., the orientation of the wales is skew relative to the orientation of the elongated members). For example, the cells of the mesh textile can include quadrilateral, and one or more wales of the knit textile can extend in an orientation aligned diagonally across the quadrilateral, from one corner to an opposite, non-adjacent corner. In at least some instances, misalignment of the wales with the elongated members can reduce the likelihood of the multi-layer construction being overly stable with too low of stretch in that particular area of the support garment. In addition, misalignment of the wales with the elongated members can result in the multi-layer construction having more balanced stretch properties across multiple axes (e.g., in the x-direction, y-direction, and axes between the x-direction and y-direction).

In at least some examples, the wales of the knit textile 1016 can be oriented in the superior-inferior orientation when the support garment is worn. In contrast, the elongated members can be oriented at an angle relative to the superior-inferior orientation of the wales (e.g., at an angle between 30 degrees and 60 degrees).

In at least some examples, the mesh textile 1010/1024 and the knit textile 1016 can be arranged (in at least a portion of the support garment) such that the anisotropic stretch properties are aligned in the same orientation (e.g., the lower stretch orientations of each layer are aligned in a same direction). For example, in some instances the mesh textile 1010/1024 and the knit textile 1016 can be arranged such that the wales of the knit textile 1016 are oriented in a direction that substantially aligns with the longitudinal orientation of the elongated members (e.g., the orientation of the wales is substantially co-planar relative to the orientation of the elongated members). In at least some instances, alignment of the wales with the elongated members can result in higher stability with lockout and reduced stretch in that area of the support garment, which can be beneficial in regions or zones that benefit from more support (e.g., zones aligned with larger muscle groups).

The mesh textile 1010 and the second textile 1012 (e.g., knit textile in some cases) can have different material properties. In at least some examples, the mesh textile 1010 can be stretchier than the second textile 1012 under a same load (e.g., the mesh textile has a lower modulus of elasticity). That is, when both the mesh textile 1010 and the second textile 1012 are subjected to a same load, the mesh textile 1010 can stretch to a longer length. In at least some instances, by configuring the multi-layer construction to include the mesh textile 1010 (with greater stretch) on the outside, the multi-layer construction is less likely to pucker, or otherwise deform, inward or cause the inner second textile 1012 to wrinkle.

The mesh textile 1010 and the second textile 1012 can be joined in various manners. In examples, the multi-layer construction includes one or more couplings (e.g., see coupling component 1030 in FIGS. 16B and 16D) joining the mesh textile 1010 to the second textile 1012. The coupling(s) can include a mechanical coupling, chemical coupling, and the like. Examples of mechanical couplings can include, among other things, stitches, hot melt adhesive, sonic welding, and the like. Examples of chemical couplings can include chemical adhesives. In some examples, one or more portions of the second textile 1012 can be joined to the mesh textile, such as around the periphery and/or at one or more tack points. In some examples, at least most of a side or face (e.g., all of a side or face) of the second textile 1012 can be joined to the mesh textile 1010, such as where most of, or all of, the second textile 1012 is laminated with the mesh textile 1010.

In at least some examples, at least part of an edge or periphery of the second textile 1012 is joined to the mesh textile 1010. For example, referring to FIGS. 16C and 16D the second textile 1012 can include textile panel having a mesh-facing side 1032 that is oriented towards the mesh textile 1010. In examples, the mesh-facing side 1032 can be an outer side or face of the second textile 1012 when the second textile 1012 is an inner layer (relative to the mesh textile 1010). The second textile 1012 and the mesh-facing side 1032 can include a periphery margin or perimeter portion 1034 that extends entirely around the periphery of the second textile 1012. That is, the second textile 1012 can include a textile panel having a perimeter, and the portion 1034 can include a margin that extends along the perimeter. In addition, the second textile 1012 and the mesh-facing side 1032 can include a central portion 1036 that is bounded by, and interior to, the periphery margin 1034.

In some examples, at least part of the periphery margin 1034 is joined to the mesh textile 1010 and the central portion 1036 is not directly joined to the mesh textile 1010. As such, the central portion 1036 can stretch and move independently of the corresponding portion of the mesh textile, and the corresponding portion of the mesh textile 1010 can exhibit and impart uninhibited stretch and support properties without being restrained by the second textile 1012.

The periphery margin 1034 (e.g., perimeter portion) of the second textile 1012 can be coupled (e.g., by the coupling 1030) to varying degrees to the mesh textile 1010. In at least some examples, the periphery margin 1034 includes a length extending around the entirety of the perimeter (e.g., the perimeter of the second-textile panel), and at least 50% of the perimeter can be attached to the mesh textile, or at least 60%, or at least 70%, or at least 80%, or at least 90%, or 100%. In some examples, the coupling 1030 continuously extends around the entirety of the perimeter.

In some examples, the coupling 1030 extends along a portion of the perimeter, which can define a panel shape associated with the second textile 1012. For example, the second textile 1012 can include panel (e.g., FIG. 16C) having a right lateral side edge 1013*a* (extending across a lateral portion of the right breast-covering portion), a left lateral edge 1013*b* (extending across a lateral portion of the left breast-covering portion), and a top edge 1013*c* continuously extending across the right and left breast covering portions, from the right lateral side edge 1013*a* to the left lateral side edge 1013*b*. The panel can also include a lower edge 1013*d* that curves from one lateral side edge, towards the underband, and to the other lateral side edge. In examples, coupling component 1030 can extend along one or more of the edges 1013*a*-1013*d*. In some examples, the coupling component can extend along at least 75% of the right lateral side edge 1013*a*, the top edge 1013*c*, and the left lateral side edge 1013*b*. The coupling component 1030 can also extend along at least part of the lower edge 1013*d*.

In at least some examples, the right lateral side edge 1013*a* extends at least partially parallel to, and spaced apart from, the right armhole edge 11*b* of the mesh textile 1010. Similarly, the left lateral side edge 1013*b* can extend at least partially parallel to, and spaced apart from, the left armhole edge 11*a* of the mesh textile 1010. Each lateral edge can be spaced apart from a respective armhole by a distance in a range of about 0.5 cm to about 2 cm, or about 0.75 cm to about 1.25 cm, or about 1.0 cm. In at least some cases, providing a margin of the of the mesh textile 1010 between the lateral edge of the second textile and the armhole edge can reduce the likelihood of gaping along the armhole edge and can contribute to a more form-fitting support garment that lays flat against the wearer's body.

In at least some examples, the coupling portion 1030 can include a hotmelt film. In examples, the hotmelt film can be integrated into the multi-layer construction to join the layers 1010 and 1012 by applying heat and/or pressure. For example, layers 1010 and 1012 can be joined by applying an iron or other heated plate or heated roller to portions of the multi-layer construction that have the hotmelt film positioned between the layers 1010 and 1012 (e.g., in the region aligned with the periphery margin 1034).

Figure 16E:
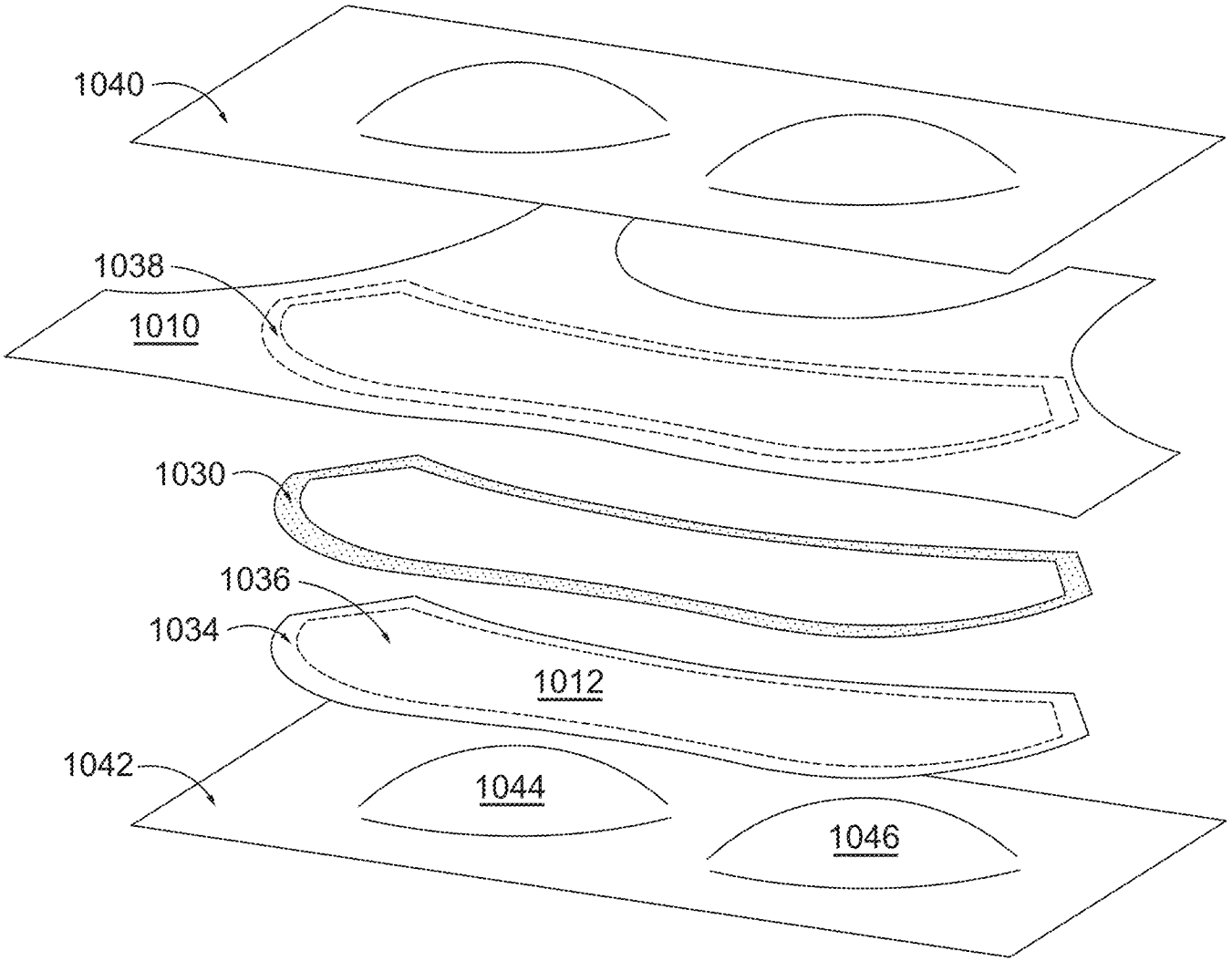
FIG. 16E illustrates construction of the front portion of FIG. 16B.

In at least some examples and referring to FIG. 16E, the layers 1010 and 1012 can be joined by layering a coupling component 1030 (e.g., hotmelt film, adhesive strip, etc.) directly between the mesh layer 1010 and the second textile 1012. The coupling component 1030 can align with the periphery margin 1034 of the second textile 1012. In addition, the mesh textile 1010 can include a bonded portion 1038 that corresponds to the coupling portion 1030 and the periphery margin 1034. In addition, the stacked arrangement of the layers 1010 and 1012 and the coupling component 1030 can be placed in a hot press 1040 and 1042. Upon the application of heat and pressure, the coupling component 1030 can at least partially soften (e.g., melt) or otherwise activate and at least partially encapsulate portions of the second textile 1013 (e.g., in the periphery margin 1034) and portions of the mesh textile 1010 (e.g., in the region 1038). Upon cooling (or otherwise curing), the coupling component 1030 can solidify and join the layers 1010 and 1012.

In at least some examples, the combination of the perimeter portion 1034, the coupling 1030, and the portion 1038 can form a laminated joint. In at least some examples, the laminated joint can be associated with lower stretch and can contribute to breast encapsulation. For example, the laminated joint can include a portion that extends along the lateral quadrants of each breast to dampen lateral movement.

In some examples, the press 1040 and 1042 can be flat. In some examples, the press 1040 and 1042 can be shaped to impart a 3D shape to the layers 1010 and 1012. For example, the press 1040 and 1042 can include cup-shaped portions 1044 and 1046 that are configured to mold cup-shaped portions into the breast-covering portions. In at least some examples, the mesh textile 1010 and the second textile 1012 can compositionally include materials that are thermoplastic and that will at least partially soften upon application of heat from the press 1040 and 1042 and that will retain a molded shape upon cooling and solidifying. For example, the mesh textile 1010 can include any of the thermoplastic materials described in the disclosure (e.g., TPU), and the second textile can include any of the thermoplastic materials described in the disclosure (e.g., rPET). Based on the molding, the inner facing sides of both the mesh textile (e.g., 1014) and the second textile (e.g., 1048) can include respective concave portions (e.g., FIG. 16D) that correspond with one another.

In at least some examples, the mesh textile 1010 can include the portion 1038 that corresponds with the perimeter portion 1034 of the second textile 1012 and that is joined directly to the second textile 1012. For example, unit area C (e.g., FIG. 16B) can be positioned in the portion 1038. In at least some instances, the portion 1038 can include a higher density of cells and/or elongated members (quantity and/or size) as compared with other parts of the mesh textile that are not joined directly to the second textile (e.g., portions associated with unit area A and unit area B) and that might overlap with (or correspond to) the central portion 1036. Among other things, the higher density of cells and/or elongated members in the portion 1038 can contribute to a stronger bond with the coupling 1030, and in turn, to the second textile 1012. For example, a higher density of cells and/or elongated members can provide more structures to encapsulate for thermal bonding and/or more surface area to bond to. In addition, the higher density of cells and/or elongated members can reduce the likelihood of the mesh textile 1010 tearing, such as when tension can pull the coupling 1030 away from the mesh textile 1010. In at least some examples, regions or zones having a lower density of cells and/or elongated members is positioned directly adjacent the portion 1038, which can offset (or at least help to reduce) any reduction in stretch properties that might arise from the higher density and/or the joining to the coupling component 1030.

In examples, a size and or shape of the panel associated with the second textile 1012 can be configured to achieve various properties and functionality associate with the support garment. For example, the shape of the panel can be configured to avoid and not overlap with one or more various zones associated with the support garment. Among other things, selective placement of the second textile 1012 can contribute to differential or zonal breathability in different parts of the support garment. For example, the second textile 1012 can be strategically omitted from some zones or portions of the support garment to provide a greater degree of breathability (e.g., where the mesh material panel includes the innermost and outermost sides/faces of the support garment), while still providing modesty properties in the breast-covering portion. In at least some examples, the panel can include the lower edge 1013*d*, which can be configured to extend along the outer edge of the lower lateral quadrant of the wearer's breast tissue. Stated differently, the lower edge 1013*d* can be configured to terminate the panel before extending entirely into the side or wings of the support garment. In such an example, in at least a portion of the wings and sides of the underarm portions, the mesh textile can form both the innermost side and the outermost side of the support garment, which can contribute to a higher degree of breathability in those regions (as compared to regions that include the multi-layer construction with the mesh material panel and the second textile). In at least some examples, the panel can be configured to be at least partially (or entirely) omitted from the center portion, such that the panel can be divided into a right panel associated with the right breast covering portion and a left panel associated with the left breast covering portion. In such an example, in at least the center portion (e.g., center 5), the mesh textile can form both the innermost side and the outermost side of the support garment.

In some examples, the garment 100 can comprise one or more pockets 164 configured to receive an insert, for example, a modesty insert, and maintain it in a desired position. The pockets 164 can be formed, for example, by positioning a removable barrier in selected regions during deposition of the filament layers 150. After the layer deposition is finished the removable barrier can be removed, leaving a pocket 164 between selected layers that is configured to receive an insert, such as a fabric insert or a 3D printed insert comprising the same 3D printed material as the garment 100. In some examples, the pockets 164 can be sealed after insertion of the insert, however, in other examples, the pockets 164 can be left open to allow the wearer to remove and/or replace the insert.

In at least some examples, a pocket (e.g., similar to pockets 164) can be positioned along the back portion of a support garment. Among other things, a pocket on the back portion of the support garment can be configured to retain a GPS device or other performance monitoring electronics device.

Figure 18:
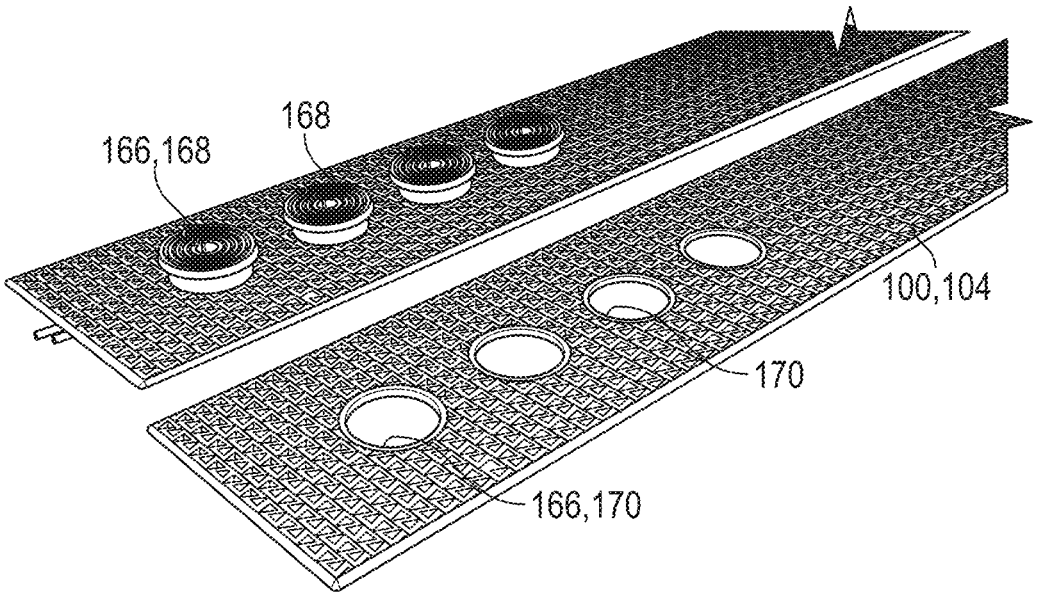
FIG. 18 illustrates a fastening mechanism for a support garment, according to one example.

Referring to FIG. 18, in some examples, in lieu of or in addition to coupling portions 152, any of the garments described herein can comprise one or more fasteners 166. In some examples, the fasteners 166 can be formed integrally with the garment 100, e.g., during the 3D printing process, and can in some examples comprise the same material as the garment 100. In other examples, the fasteners 166 can be separate structures permanently or removably coupled to the garment 100. In such examples, the fasteners can be formed from the same material as the garment 100, or can be formed from a different material. In at least some examples, the fasteners can be affixed to another textile material, which can be coupled to the mesh textile. For example, the other textile material can be coupled (e.g., stitched, bonded, adhered, etc.) to the ends 90*a* and/or 90*b* of the underband 16 to provide a fastening mechanism along the underband 16 (e.g., in the back). The fastening mechanism can include any one or more different fasteners that could be coupled to the textile material, such as hook-and-loop, clasps, snaps, hook and eyelet, clips, and the like.

The fasteners 166 can be used, for example, to form the garment into a three-dimensional structure, and/or to allow the garment to be adjusted to different sizes. For example, the fasteners 166 can be located on the band region 104 and/or straps 114 in order to allow the length of the band region 104 and/or straps 114 to be adjusted. As shown in FIG. 18, in some examples, the fasteners 166 can comprise one or more buttons 168 and one or more button-holes 170 through which the one or more buttons can be inserted. In other examples, the fasteners can be, for example, lacing (e.g., corseting), hook and eye closures, zippers, snaps, buckles, hook and loop (e.g., Velcro), etc.)

Figure 19:
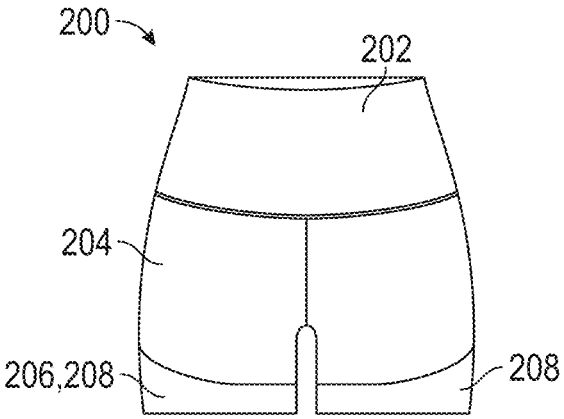
FIGS. 19-21 illustrate an example of a support garment.
Figure 20:
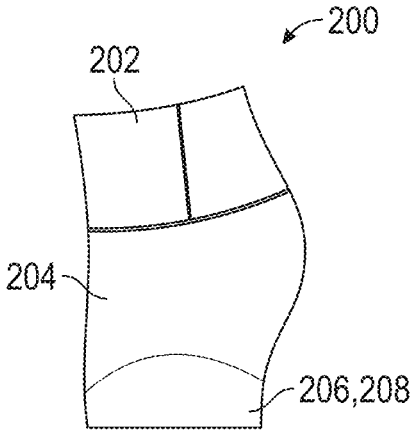
Figure 21:
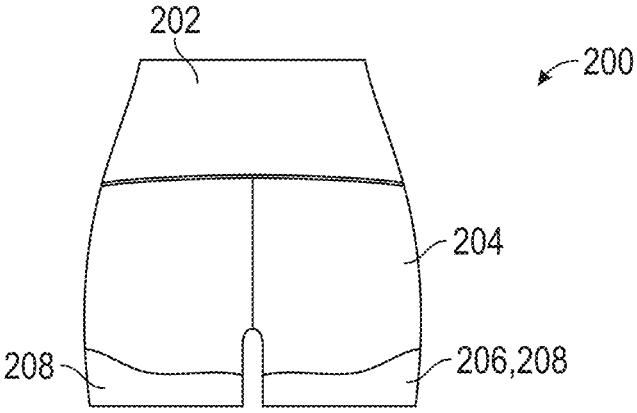
Figure 22:
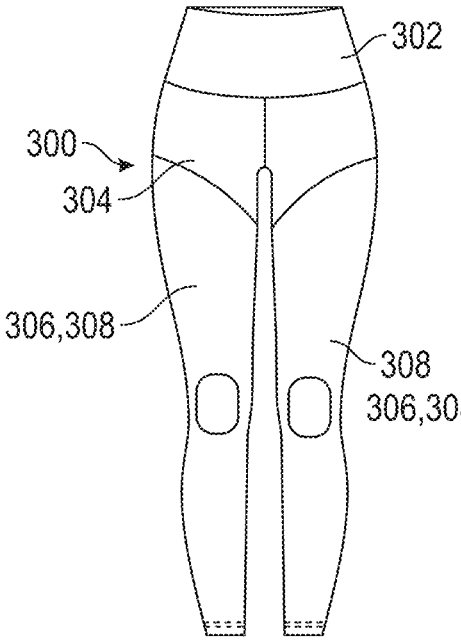
FIGS. 22-25 illustrate an example of a support garment.
Figure 23:
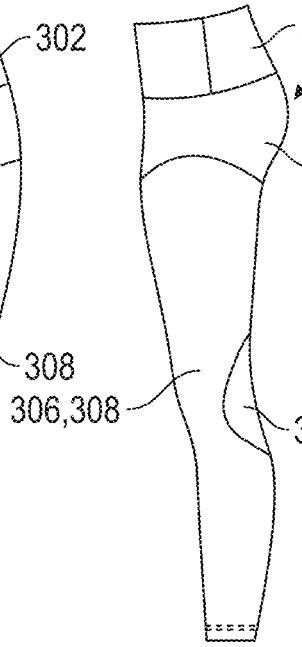
Figure 24:
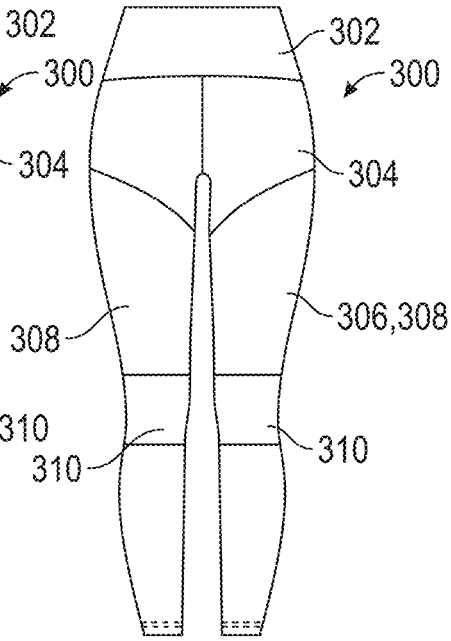

FIGS. 19-21 illustrate another example of a garment 200. In the illustrated example, the garment 200 is a pair of shorts that includes a waistband region 202, a brief region 204, and a leg region 206 that includes two leg bands 208. Garment 200 can comprise a mesh, open cell material (similar to the mesh, open cell material described previously for garment 100) and/or a fabric material. As described previously, the mesh material can advantageously provide increased breathability and increased sweat evaporation as well as decreased weight. The shape, orientation, and density of the cells that comprise the mesh material can be selected depending on the location (i.e., region) in which the cells are disposed to provide selected properties (e.g., a desired amount of stretch and/or support) in certain regions.

In some examples, the waistband region 202 and the leg bands 208 can comprise the open cell material, and the brief region 204 can comprise the knit material. Such a configuration can advantageously provide increased breathability and sweat efficiency at the waistband region 204 (which is a high heat/sweat region), as well as providing a better contour and fit to the wearer's body than a traditional material. The use of the open cell material to form the leg bands 208 can advantageously help hold the legs of the garment in place and prevent them from rolling or moving up the body. In other examples, the entire garment 200 can comprise the open cell material, and portions of the garment 200 can optionally comprise additional knit layers, e.g., for modesty.

FIGS. 22-25 illustrate another example of a garment 300. In the illustrated example, the garment 300 is a pair of leggings that includes a waistband region 302, a brief region 304, and a leg region 306 that includes two leg members 308. Garment 200 can comprise a mesh, open cell material (similar to the mesh, open cell material described previously for garment 100) and/or a fabric material. As described previously, the mesh material can advantageously provide increased breathability and increased sweat evaporation as well as decreased weight. The shape, orientation, and density of the cells that comprise the mesh material can be selected depending on the location (i.e., region) in which the cells are disposed to provide selected properties (e.g., a desired amount of stretch and/or support) in certain regions.

In some examples, the waistband region 302 and the leg members 308 can comprise the open cell material, and the brief region 304 can comprise the knit material. Portions of the waistband 302 and leg members 308 can be configured (e.g., the cells can be sized, shaped, oriented, and provided in a specific density) to provide different properties. For example, waistband 304 and the region behind the knee 310 can be configured to provide increased breathability.

Figure 25:
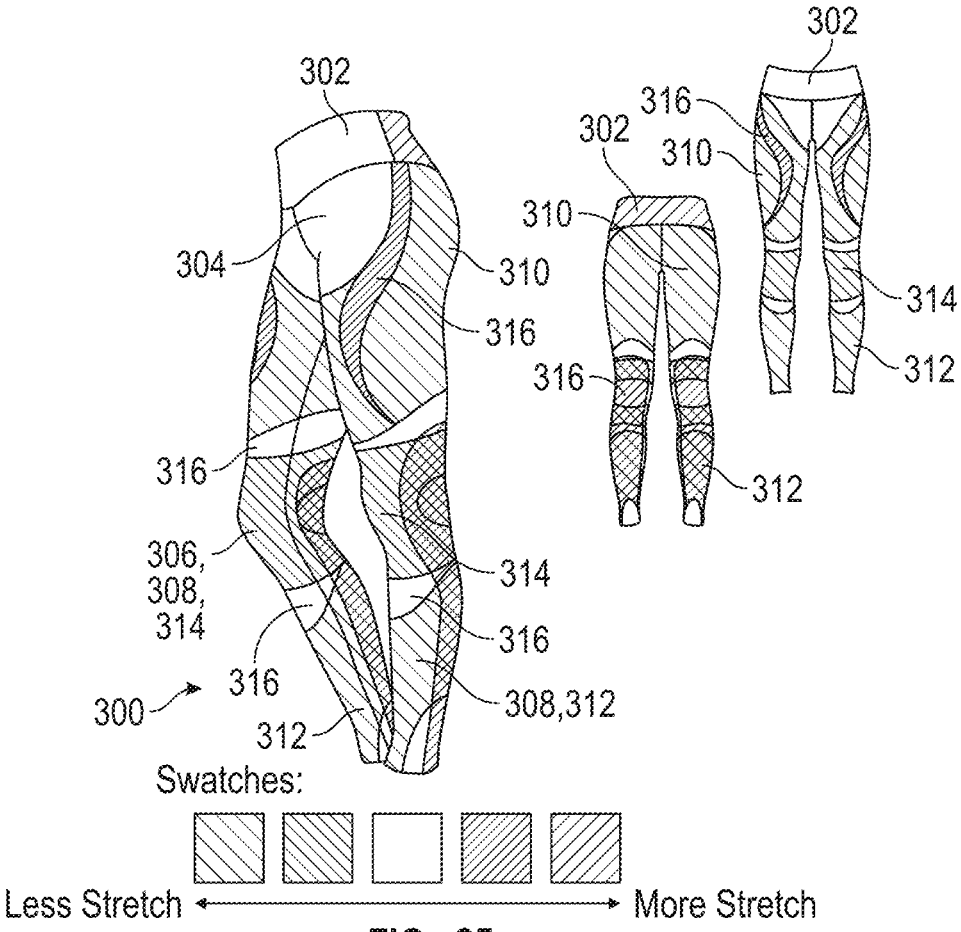
Figure 26:
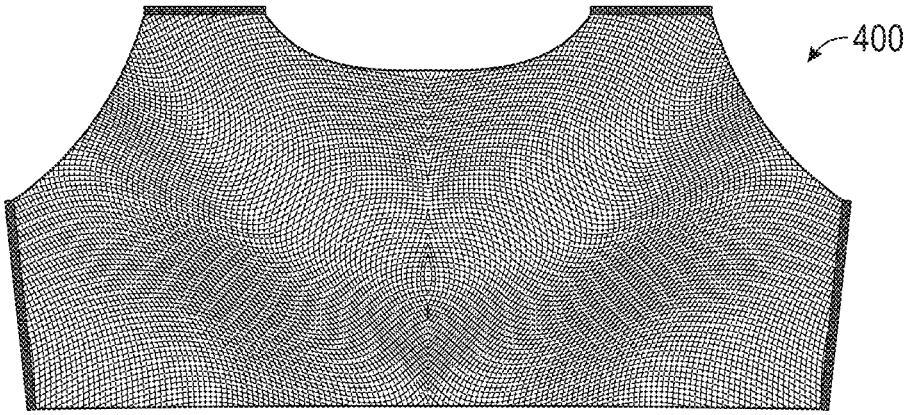
FIGS. 26-29 illustrates various other examples of support garments, shown in a flattened configuration.

Referring to FIG. 25, in some examples, selected regions can be configured to provide support/compression (e.g., by allowing for less stretch/having a higher modulus of elasticity), while other selected regions are configured to provide increased stretch (e.g., by having a lower modulus of elasticity). For example, the thigh/butt region 310 and the shin region 312 can be configured to provide support/compression, and the knee region 314 can be configured to provide increased stretch. A front portion of the waistband region 302 can provide more support (e.g., less stretch) than a back portion of the waistband region.

As shown in the illustrated example, in some examples, the garment 300 can comprise one or more patterned regions 316 that can be designed to provide areas of more or less support. For example, the garment 300 can comprise patterned regions 316 along the thigh portion of the leg members 308, above and below the knee region 314, on the back of the knee region 314, and/or adjacent the wearer's ankles. In some examples, the patterned regions 316 can be configured to provide additional stretch. In other examples, patterned regions can be configured to provide additional support to selected regions.

Figure 27:
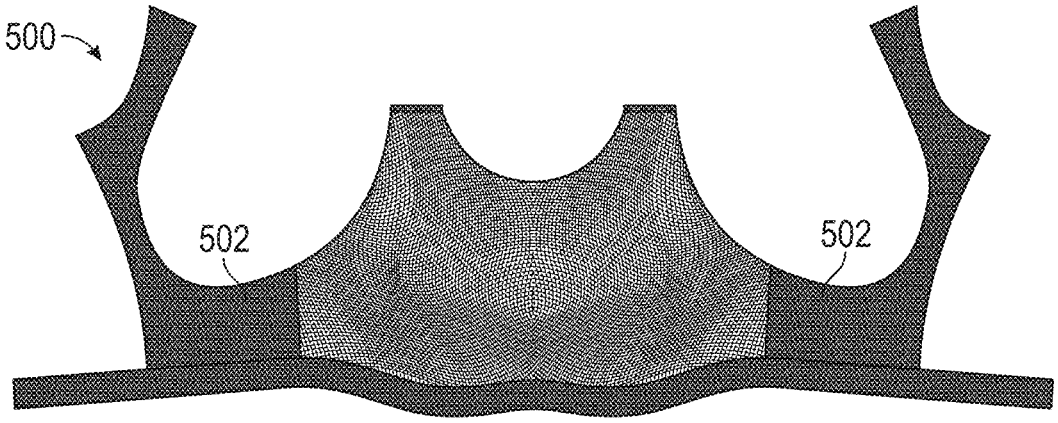
Figure 28:
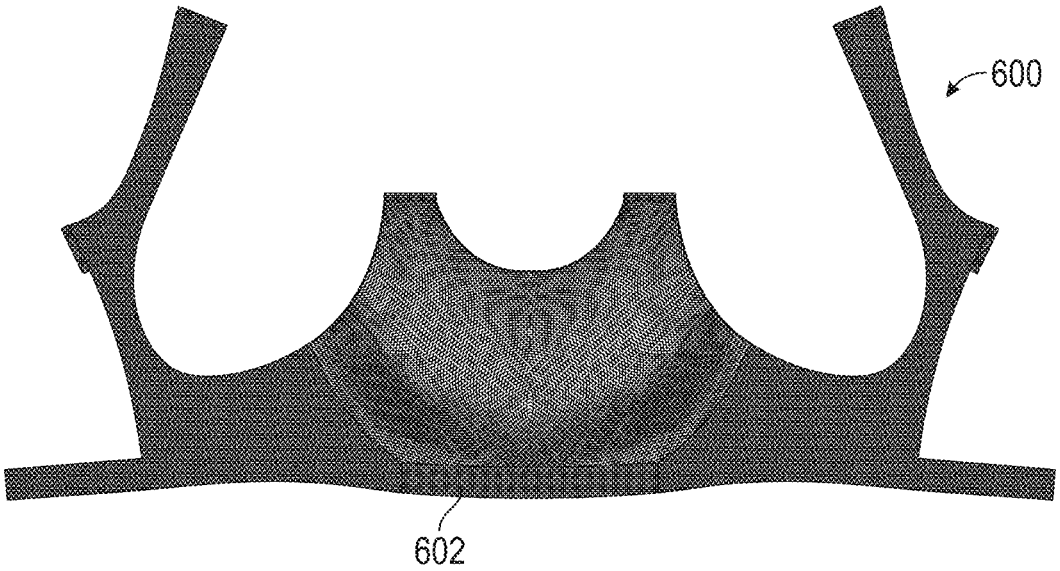
Figure 29:
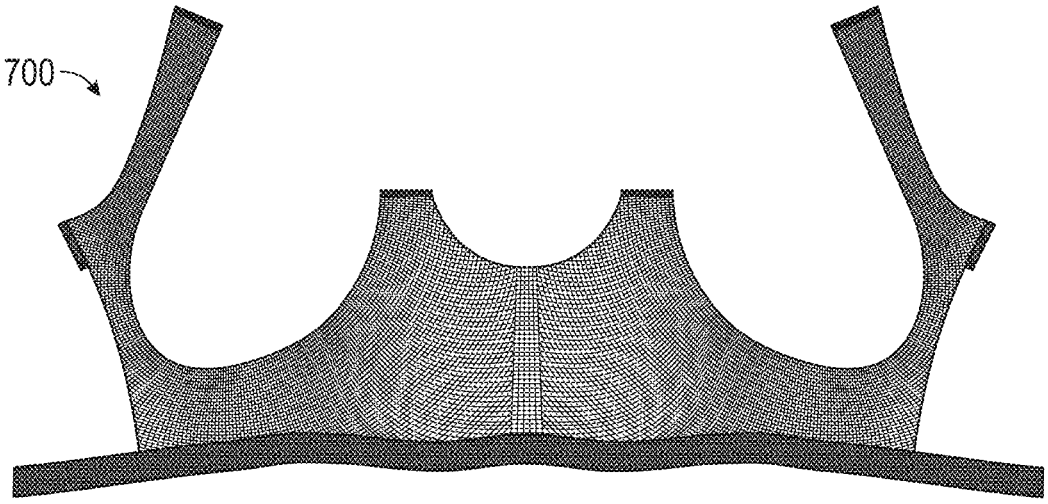

FIGS. 5-17 illustrate one example of a garment 100 with selected regions of stretch and support defined by cell orientation, cell density, and cell pattern. However, it should be understood that the cell orientations, cell densities, and cell patterns can be modified and re-arranged to provide the selected amounts of stretch and support. For example, FIGS. 26-29 illustrate exemplary garments 400, 500, 600, and 700 having different cell orientations, regions of stretch, support regions, etc. Darker regions indicate regions of increased cell density and/or regions having auxetic patterns. For example, FIG. 27 illustrates a garment 500 having increased cell density in the side and back region 502 which can result in additional back support. FIG. 28 illustrates a garment 600 having a shortened band region 602.

Additional Examples of the Disclosed Technology

In view of the above-described implementations of the disclosed subject matter, this application discloses the additional examples enumerated below. It should be noted that one feature of an example in isolation or more than one feature of the example taken in combination and, optionally, in combination with one or more features of one or more further examples are further examples also falling within the disclosure of this application.

Example 1. A support garment comprising: a material comprising a plurality of regions, each region comprising a plurality of open cells arranged in a pattern, wherein each cell of the plurality of open cells has a minimum width of 1.8 mm and a minimum height of 1.2 mm and a maximum width of 3.5 mm and a maximum height of 5.1 mm when the support garment is in a relaxed configuration.

Example 2. The garment of any example herein, particularly example 1, wherein the plurality of regions comprises a band region configured to be disposed around a wearer's ribcage, and wherein the plurality of open cells in the band region comprises an auxetic pattern.

Example 3. The garment of any example herein, particularly any one of examples 1-2, wherein each cell of the plurality of open cells comprising the auxetic pattern has a bowtie shape.

Example 4. The garment of any example herein, particularly example 3, wherein each cell having a bowtie shape has a width, a first height at a first and a second end portion of the cell, and a second height at a center portion of the cell, the second height being less than the first height.

Example 5. The garment of any example herein, particularly example 4, wherein each cell comprising the auxetic pattern has a minimum width of 3.0 mm, a minimum first height of 1.8 mm, and a minimum second height of 0.6 mm when in the relaxed configuration.

Example 6. The garment of any example herein, particularly example 1, wherein the material has a homogenous composition comprising thermoplastic polyurethane (TPU).

Example 7. A support garment comprising: a plurality of open cells, the plurality of open cells being arranged in one or more patterns to form one or more regions; wherein each region comprises a selected modulus of elasticity; and wherein at least one region of the one or more regions is a first region comprising an auxetic pattern.

Example 8. The garment of any example herein, particularly example 7, wherein the first region is a band zone configured to be disposed around a wearer's ribcage.

Example 9. The garment of any example herein, particularly example 8, wherein each of the cells in the first region has a bow-tie shape.

Example 10. The garment of any example herein, particularly any one of examples 7-9, wherein the garment is a unitary piece of material.

Example 11. The garment of any example herein, particularly any one of examples 7-10, wherein the one or more regions further comprise a second region configured to be disposed over a wearer's breastbone, and wherein each of the cells in the second region is positioned in a square orientation.

Example 12. The garment of any example herein, particularly any one of examples 7-11, wherein the one or more regions comprise a third region configured as a cup region, and wherein the plurality of cells that make up the cup region have a modulus of elasticity that is lower than the cells that make up the second region.

Example 13. The garment of any example herein, particularly example 12, wherein the one or more regions comprise a fourth region configured as a strap region, and wherein the plurality of cells that make up the strap region have a modulus of elasticity that is higher than the cells that make up the third region.

Example 14. The garment of any example herein, particularly any one of examples 7-13, wherein the one or more regions further comprise a third region configured as a cup region, and wherein the cup region comprises one or more integrated pockets configured to accept one or more modesty inserts.

Example 15. The garment of any example herein, particularly any one of examples 6-13, wherein the material comprises thermoplastic polyurethane (TPU).

Example 16. An upper body garment comprising: a material comprising a plurality of open cells, the plurality of open cells being arranged in one or more patterns to form a breast cup region, a sternum region, a band region, and a strap region, each region having a different modulus of elasticity; wherein the breast cup region comprises a first breast cup portion and a second breast cup portion; wherein the sternum region is disposed between the first breast cup portion and the second breast cup portion; wherein the band region is configured to extend around a wearer's ribcage; and wherein the strap region comprises a first strap portion and a second strap portion.

Example 17. The upper body garment of any example herein, particularly example 16, wherein the band region comprises a structure having a negative Poisson's ratio.

Example 18. The upper body garment of any example herein, particularly any one of examples 16-17, wherein the breast cup region, sternum region, band region, and strap region each comprises a different cell density.

Example 19. The upper body garment of any example herein, particularly any one of examples 16-18, wherein the modulus of elasticity of the breast cup region is lower than the modulus of elasticity of each of the sternum, band, and strap regions.

Example 20. A method comprising: 3D printing a garment comprising: a material comprising a plurality of open cells, the plurality of open cells being arranged in one or more patterns to form first, second, third, and fourth regions, each region having a modulus of elasticity different from the modulus of elasticity of each of the other regions, the first region being configured as a cup region comprising a first cup portion and a second cup portion, the second region being disposed between the first cup portion and the second cup portion, the third region being configured as a band region configured to extend around a wearer's ribcage, and the fourth region being configured as a strap region comprising a first strap portion and a second strap portion.

Example 21. The method of any example herein, particularly example 20, wherein 3D printing the garment includes printing a first filament layer extending in a first direction and printing a second filament layer over the first filament layer, the second filament layer extending in a second direction such that the first and second filament layers overlap one another at a plurality of overlap points.

Example 22. The method of any example herein, particularly example 21, further comprising printing a third filament layer over the second filament layer, the third filament layer extending in the first direction.

Example 23. The method of any example herein, particularly example 22, further comprising printing a fourth filament layer over the third filament layer, the fourth filament layer extending in the second direction.

In view of the many possible ways in which the principles of the disclosure may be applied, it should be recognized that the illustrated configurations depict examples of the disclosed technology and should not be taken as limiting the scope of the disclosure nor the claims. Rather, the scope of the claimed subject matter is defined by the following claims and their equivalents.

The garments described herein, and individual components thereof, should not be construed as being limited to the particular uses described herein in any way. Instead, this disclosure is directed toward all novel and non-obvious features and aspects of the various disclosed embodiments, alone and in various combinations and sub-combinations with one another. For example, any features or aspects of the disclosed embodiments can be used in various combinations and sub-combinations with one another, as will be recognized by an ordinarily skilled artisan in the relevant field(s) in view of the information disclosed herein. In addition, the disclosed garments, methods, and components thereof are not limited to any specific aspect or feature or combinations thereof, nor do the disclosed garments and methods require that any one or more specific advantages be present or problems be solved.

We claim:

1. An upper-torso support garment comprising:

a main body and an underband;

the underband comprising an upper portion coupled to the main body and comprising a lower portion opposite the upper portion; and the underband comprising a first elongated member that extends from the upper portion to the lower portion and that comprises a waveform, wherein the first elongated member comprises an upper segment closer to the upper portion, a lower segment closer to the lower portion, and a middle segment between the upper segment and the lower segment; and wherein a first amplitude of the waveform in the middle segment is smaller than a second amplitude of the waveform in the upper segment; or wherein the first amplitude is smaller than a third amplitude of the waveform in the lower segment; or wherein the first amplitude is smaller than both the second amplitude and the third amplitude.

2. The upper-torso support garment of claim 1, wherein:

the underband further comprises a second elongated member that is separate from the first elongated member and extends from the upper portion to the lower portion and that comprises a second waveform;

the second elongated member comprises an upper segment closer to the upper portion, a lower segment closer to the lower portion, and a middle segment between the upper segment and the lower segment; and a fourth amplitude of the middle segment of the second elongated member is larger than the first amplitude of the waveform of the middle segment of the first elongated member.

3. The upper-torso support garment of claim 2, wherein the main body comprises a front portion comprising a center, and wherein the first elongated member comprises a first position in the underband that is, as compared to a second position of the second elongated member, closer to the center.

4. The upper-torso support garment of claim 2, wherein the upper-torso support garment comprises a front portion and a back portion; wherein the underband comprises an underband fastener positioned in the back portion; and wherein the second elongated member is, as compared to the first elongated member, closer to the underband fastener.

5. The upper-torso support garment of claim 2, wherein the second elongated member comprises a second position in the underband that is, as compared to a first position of the first elongated member, closer to a back portion of the upper-torso support garment.

6. The upper-torso support garment of claim 3, wherein the underband comprises a lengthwise orientation; wherein the first elongated member and the second elongated member extend transverse to the lengthwise orientation; wherein the upper-torso support garment further comprises a third elongated member that longitudinally extends in the lengthwise orientation and intersects with the first elongated member and with the second elongated member; and wherein the third elongated member comprises a third waveform.

7. The upper-torso support garment of claim 6, wherein the third elongated member comprises a first segment that intersects with the first elongated member and a second segment that intersects with the second elongated member; and wherein a fifth amplitude of the first segment is smaller than a sixth amplitude of the second segment.

8. The upper-torso support garment of claim 6, wherein the first elongated member, the second elongated member, and the third elongated member comprise a homogenous material.

9. The upper-torso support garment of claim 1, wherein the first elongated member comprises a unitary elongated member.

10. An upper-torso support garment comprising:

a main body and an underband;

the underband comprising an upper portion coupled to the main body and comprising a lower portion opposite the upper portion; and the underband comprising:

a first elongated member that extends from the upper portion to the lower portion and that comprises a first waveform; and a second elongated member that is separate from the first elongated member and is spaced apart from the first elongated member along the underband, wherein the second elongated member extends from the upper portion to the lower portion and comprises a second waveform, and wherein a first amplitude of the first elongated member is different than a second amplitude of the second elongated member.

11. The upper-torso support garment of claim 10, wherein the first elongated member comprises an upper segment closer to the upper portion, a lower segment closer to the lower portion, and a middle segment between the upper segment and the lower segment; and wherein the first amplitude is in the middle segment.

12. The upper-torso support garment of claim 10, wherein the main body comprises a front portion comprising a center, and wherein the first elongated member is, as compared to the second elongated member, closer to the center.

13. The upper-torso support garment of claim 10, wherein the upper-torso support garment comprises a front portion and a back portion; wherein the underband comprises an underband fastener positioned in the back portion; and wherein the second elongated member is, as compared to the first elongated member closer to the underband fastener.

14. The upper-torso support garment of claim 10, wherein the second elongated member is, as compared to the first elongated member closer to a back portion of the upper-torso support garment.

15. The upper-torso support garment of claim 10 further comprising, a third elongated member that intersects with the first elongated member and with the second elongated member; wherein the third elongated member comprises a third waveform.

16. The upper-torso support garment of claim 15, wherein the third elongated member comprises a medial segment that intersects with the first elongated member and a lateral segment that intersects with the second elongated member; and wherein a third amplitude of the medial segment is smaller than a fourth amplitude of the lateral segment.

17. The upper-torso support garment of claim 16, wherein the first elongated member, the second elongated member, and the third elongated member comprise a homogenous material.

18. The upper-torso support garment of claim 10, wherein the first amplitude is smaller than the second amplitude.

19. An upper-torso support garment comprising:

a main body and an underband;

the underband comprising an upper portion coupled to the main body and comprising a lower portion opposite the upper portion;

the underband comprising widthwise orientation extending from the upper portion to the lower portion and a lengthwise orientation; and the underband comprising a first elongated member that longitudinally extends in the lengthwise orientation and that comprises a first waveform, wherein the first elongated member comprise a first segment and a second segment; wherein the first segment is, as compared to the second segment, closer to a midpoint of the underband on a front of the upper-torso support garment; and wherein the first segment of the first elongated member comprises a first amplitude and the second segment of the first elongated member comprises a second amplitude, which is different from the first amplitude.

20. The upper-torso support garment of claim 19, wherein the first amplitude is smaller than the second amplitude.

21. The upper-torso support garment of claim 20, wherein the first elongated member comprises a third segment that is positionally between the first segment and the second segment and that is larger than the first amplitude and smaller than the second amplitude.

22. The upper-torso support garment of claim 19, wherein the underband comprises a fastener on a back of the upper-torso support garment; and wherein the second segment is, as compared to the first segment, closer to the fastener.

23. The upper-torso support garment of claim 19, wherein the underband comprises a second elongated member that longitudinally extends in the widthwise orientation and that intersects with the first elongated member.

24. The upper-torso support garment of claim 23, wherein the second elongated member comprises a second waveform.

25. The upper-torso support garment of claim 24, wherein the second elongated member comprises an upper segment closer to the upper portion, a lower segment closer to the lower portion, and a middle segment between the upper segment and the lower segment; and wherein a fourth amplitude of the second waveform in the middle segment is smaller than a fifth amplitude of the second waveform in the upper segment or is smaller than a sixth amplitude of the second waveform in the lower segment or any combination thereof.

26. The upper-torso support garment of claim 25, wherein the first elongated member and the second elongated member comprise a homogenous material.

* * * * *